US010424309B2

(12) United States Patent
Fuchs et al.

(10) Patent No.: US 10,424,309 B2
(45) Date of Patent: Sep. 24, 2019

(54) APPARATUSES AND METHODS FOR ENCODING OR DECODING A MULTI-CHANNEL SIGNAL USING FRAME CONTROL SYNCHRONIZATION

(71) Applicant: Fraunhofer-Gesellschaft zur Foerderung der angewandten Forschung e.V., Munich (DE)

(72) Inventors: Guillaume Fuchs, Bubenreuth (DE); Emmanuel Ravelli, Erlangen (DE); Markus Multrus, Nuremberg (DE); Markus Schnell, Nuremberg (DE); Stefan Doehla, Erlangen (DE); Martin Dietz, Nuremberg (DE); Goran Markovic, Nuremberg (DE); Eleni Fotopoulou, Nuremberg (DE); Stefan Bayer, Nuremberg (DE); Wolfgang Jaegers, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 16/035,471

(22) Filed: Jul. 13, 2018

(65) Prior Publication Data

US 2018/0342252 A1 Nov. 29, 2018

Related U.S. Application Data

(63) Continuation of application No. PCT/EP2017/051212, filed on Jan. 20, 2017.

(30) Foreign Application Priority Data

Jan. 22, 2016 (EP) ..... 16152450
Jan. 22, 2016 (EP) ..... 16152453

(51) Int. Cl.
*G10L 19/008* (2013.01)
*G10L 19/022* (2013.01)
(Continued)

(52) U.S. Cl.
CPC ..... *G10L 19/008* (2013.01); *G10L 19/02* (2013.01); *G10L 19/022* (2013.01); *G10L 19/04* (2013.01);
(Continued)

(58) Field of Classification Search
CPC . G10L 19/008; G10L 19/032; H04S 2400/03; H04S 3/008; H04S 2400/01; H04S 2400/11
(Continued)

(56) References Cited

U.S. PATENT DOCUMENTS 5,434,948 A 7/1995 Holt et al.
6,073,100 A 6/2000 Goodridge, Jr.
(Continued)

FOREIGN PATENT DOCUMENTS

EP 1953736 A1 8/2008
EP 2229677 B1 9/2015
(Continued)

OTHER PUBLICATIONS

Fuchs, Guillaume et al., "Low Delay LPC and MDCT-Based Audio Coding in the EVS Codec", 2015 IEEE International Conference on Acoustics, Speech and Signal Processing (ICASSP). IEEE, Apr. 19, 2015; pp. 5723-5727; XP033064796, Apr. 19, 2015, 5723-5727.
(Continued)

*Primary Examiner* — Alexander Jamal
(74) *Attorney, Agent, or Firm* — Perkins Coie LLP; Michael A. Glenn

(57) ABSTRACT

An apparatus for encoding a multi-channel signal including at least two channels includes a time-spectral converter for converting sequences of blocks of sampling values of the at least two channels into a frequency domain representation having sequences of blocks of spectral values for the at least two channels; a multi-channel processor for applying a joint
(Continued)

multi-channel processing to the sequences of blocks of spectral values to obtain at least one result sequence of blocks of spectral values including information related to the at least two channels; a spectral-time converter for converting the result sequence of blocks of spectral values into a time domain representation including an output sequence of blocks of sampling values; and a core encoder for encoding the output sequence of blocks of sampling values to obtain an encoded multi-channel signal.

40 Claims, 32 Drawing Sheets

(51) Int. Cl.

| | |
|---|---|
| ***G10L 19/02*** | (2013.01) |
| ***G10L 19/04*** | (2013.01) |
| ***G10L 25/18*** | (2013.01) |
| ***H04S 3/00*** | (2006.01) |

(52) U.S. Cl.
CPC ..... *G10L 25/18* (2013.01); *H04S 3/008* (2013.01); *H04S 2400/01* (2013.01); *H04S 2400/03* (2013.01); *H04S 2420/03* (2013.01)

(58) Field of Classification Search
USPC ..... 381/22, 23; 704/500
See application file for complete search history.

(56) References Cited

U.S. PATENT DOCUMENTS

| | | | | |
|---|---|---|---|---|
| 6,138,089 | A | 10/2000 | Guberman | |
| 6,549,884 | B1 | 4/2003 | Laroche et al. | |
| 7,089,180 | B2 | 8/2006 | Heikkinen | |
| 8,255,228 | B2 | 8/2012 | Hilpert et al. | |
| 8,315,880 | B2 | 11/2012 | Kovesi et al. | |
| 8,630,861 | B2 | 1/2014 | Chen et al. | |
| 8,700,388 | B2 | 4/2014 | Edler et al. | |
| 8,762,159 | B2 | 6/2014 | Geiger et al. | |
| 8,793,125 | B2 | 7/2014 | Breebaart et al. | |
| 8,811,621 | B2 | 8/2014 | Schuijers | |
| 2006/0190247 | A1 | 8/2006 | Lindblom | |
| 2009/0222272 | A1* | 9/2009 | Seefeldt | G10L 19/008 704/500 |
| 2009/0313028 | A1 | 12/2009 | Tammi et al. | |
| 2011/0096932 | A1 | 4/2011 | Schuijers | |
| 2011/0106542 | A1 | 5/2011 | Bayer et al. | |
| 2011/0202355 | A1 | 8/2011 | Grill et al. | |
| 2012/0045067 | A1 | 2/2012 | Oshikiri | |
| 2013/0151262 | A1 | 6/2013 | Lohwasser et al. | |
| 2013/0226570 | A1 | 8/2013 | Multrus et al. | |
| 2013/0262130 | A1* | 10/2013 | Ragot | G10L 19/008 704/500 |
| 2013/0332148 | A1 | 12/2013 | Ravelli et al. | |
| 2014/0032226 | A1 | 1/2014 | Raju et al. | |
| 2017/0133023 | A1 | 5/2017 | Disch et al. | |

FOREIGN PATENT DOCUMENTS

| | | | |
|---|---|---|---|
| EP | 2947656 | A1 | 11/2015 |
| GB | 2453117 | A | 4/2009 |
| JP | 2008530616 | A | 8/2008 |
| JP | 2011522472 | A | 7/2011 |
| JP | 2013538367 | A | 10/2013 |
| RU | 2391714 | C2 | 6/2010 |
| RU | 2420816 | C2 | 6/2011 |
| RU | 2491657 | C2 | 8/2013 |
| RU | 2542668 | C2 | 2/2015 |
| RU | 2562384 | C2 | 9/2015 |
| TW | 201334580 | A | 8/2013 |
| WO | 2006089570 | A1 | 8/2006 |
| WO | 2012020090 | A1 | 2/2012 |
| WO | 2012105886 | A1 | 8/2012 |
| WO | 2012110473 | A1 | 8/2012 |
| WO | 2014043476 | A1 | 3/2014 |
| WO | 2014044812 | A1 | 3/2014 |
| WO | 2014161992 | A1 | 10/2014 |
| WO | 2016108655 | A1 | 7/2016 |
| WO | 2016142337 | A1 | 9/2016 |

OTHER PUBLICATIONS

Helmrich, Christian R. et al., "Low-Delay Transform Coding Using the MPEG-H 3D Audio Codec", AES Convention 139; Oct. 23, 2015; XP040672209, Oct. 23, 2015.

Herre, J et al., "Spatial Audio Coding: Next-Generation Efficient and Compatible Coding", Convention Paper Presented at the 117th Convention. Audio Engineering Society Convention Paper, New York, NY, U.S.A. No. 6186., Oct. 28, 2004, 1-13.

Herre, J et al., "The Reference Model Architecture for MPEG Spatial Audio Coding", Convention Paper Presented at the 118th Convention, Audio Engineering Society, New York, NY, US. No. 6447, May 28, 2005, 1-13.

Herre, Jurgen , "From joint stereo to spatial audio coding—recent progress and standardization", Proceedings of the International Conference on Digital Audioeffects; Oct. 5, 2004; pp. 157-162; XP002367849, Oct. 5, 2004, 157-162.

Jansson, Tomas , "UPTEC F11 034 Stereo Coding for ITU-T G.719 codec", May 17, 2011; XP55114839; http://www.diva-portal.org/smash/get/diva2:417362/FULLTEXT01.pdf, May 17, 2011.

Martin, Rainer et al., "Low Delay Analysis/Synthesis Schemes for Joint Speech Enhancement and Low Bit Rate Speech Coding", 6th European Conference on Speech Communication and Technology, Eurospeech '99. Budapest, Hungary, Sept. 5-9, 1999; pp. 1463-1466; XP001075956, Sep. 5, 1999, 1463-1466.

Valero, Maria L. et al., "A New Parametric Stereo and Multichannel Extension for MPEG-4 Enhanced Low Delay AAC (AAC-ELD)", AES Convention 128; May 1, 2010; XP040509482, May 1, 2010.

Wada, Ted S. et al., "Decorrelation by resampling in frequency domain for multichannel acoustic echo cancellation based on residual echo enhancement", Applications of Signal Processing to Audio and Acoustics (WASPAA); Oct. 16, 2011; pp. 289-292; XP032011497, Oct. 16, 2011, 289-292.

Herre, J et al., "The Reference Model Architecture for MPEG Spatial Audio Coding", Proc. 118th Convention of the Audio Engineering Society, ES, AES,, May 28, 2005, p. 1-13.

* cited by examiner

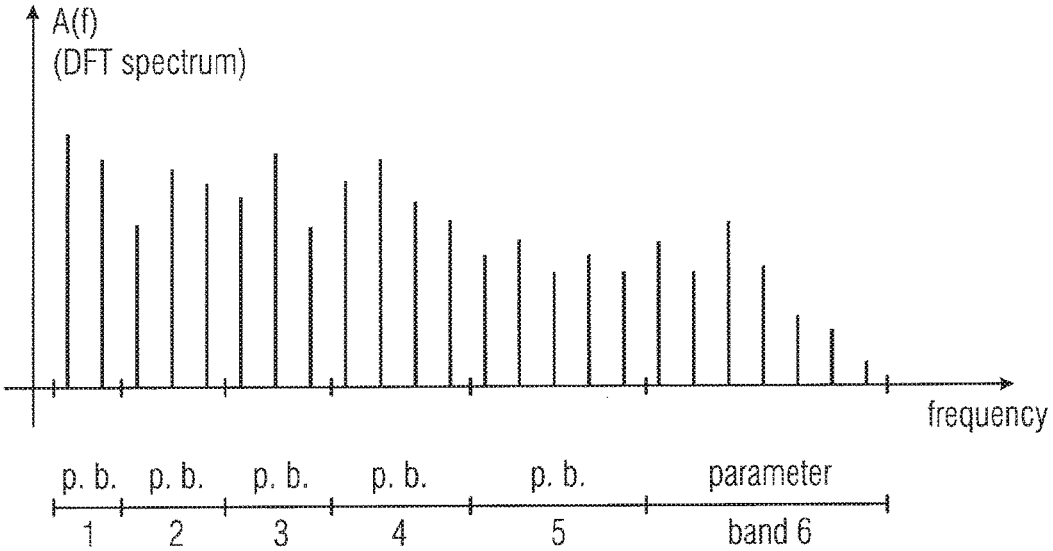

- single broadband alignment parameter for whole spectrum (e. g. p. band 1 to p. band 6);
- plurality of narrowband alignment parameters for parameter bands 1, 2, 3, 4, i. e., four narrowband parameters;
- level parameters for each parameter band, e. g. 6 level parameters;
- stereo filling parameters for parameter bands 4, 5, 6, e. g. three stereo filling parameters;
- side (residual) signal for parameter bands 1, 2, 3;
- more spectral lines in higher band, e.g. seven spectral lines in parameter band 6 versus three spectral lines in parameter band 2.

Fig. 3d

| | Duration (ms) | Samples @12.8 kHz | Samples @16 kHz | Samples @32 kHz | Samples @48 kHz |
|---|---|---|---|---|---|
| zero padding | 3.125 | 40 | 50 | 100 | 150 |
| overlapping | 8.75 | 112 | 140 | 280 | 420 |
| middle part | 1.25 | 16 | 20 | 40 | 60 |
| window size | 25 | 320 | 400 | 800 | 1200 |
| DFT max radix | | 5 | 5 | 5 | 5 |

Fig. 8a

| proposal number | filterband/ block transform type | delay total | delay encoder | delay decoder | available delay at decoder side after core decoder | freq. resolution of filterband/ block transform | time resolution of filterband/ block transform |
|---|---|---|---|---|---|---|---|
| 1 | DFT | 38.75 ms | 8.75 ms | 10 ms | 1.25 ms | 53.3 Hz | 10 ms |
| 2 | DFT | 38.75 ms | 8.75 ms | 10 ms | 0 ms | 53.3/34.8 Hz | 10/20 ms |
| 3 | CLDFB | 38.75 + x ms | 13.75 ms | 5 + x ms | x ms | 400 Hz | 1.25 ms |
| 4 | DFT | 48.75 ms | 17.5 ms | 11.25 ms | 2.5 ms | 53.3 Hz | 10 ms |
| 5 | DFT | 40 ms | 13.75 ms | 6.25 ms | 1.25 ms | 100 Hz | 5 ms |

Fig. 8b the ascending ovlp_size coefficients are given by:

win_ovlp(k) = sin(pi*(k + 0.5)/(2*ovlp_size));, for k = 0..ovlp_size - 1 the descending ovlp_size coefficients are given by:

win_ovlp(k) = sin(pi*(ovlp_size - 1 - k + 0.5)/(2*ovlp_size));, for k = 0..ovlp_size - 1 where ovlp_size is function of the sampling rate and given in Fig. 8a.

proposal 1 encoder schematic windowing proposal 1 decoder schematic windowing proposal 1 windows at encoder and decoder proposal 4 encoder schematic windowing proposal 4 decoder schematic windowing proposal 4 windows at encoder and decoder proposal 5 encoder schematic windowing proposal 5 decoder schematic windowing proposal 5 windows at encoder and decoder

APPARATUSES AND METHODS FOR ENCODING OR DECODING A MULTI-CHANNEL SIGNAL USING FRAME CONTROL SYNCHRONIZATION

CROSS-REFERENCES TO RELATED APPLICATIONS

This application is a continuation of copending International Application No. PCT/EP2017/051212, filed Jan. 20, 2017, which is incorporated herein by reference in its entirety, and additionally claims priority from European Applications Nos. EP 16152450.9, filed Jan. 22, 2016, and EP 16152453.3, filed Jan. 22, 2016, both of which are incorporated herein by reference in their entirety.

The present application is related to stereo processing or, generally, multi-channel processing, where a multi-channel signal has two channels such as a left channel and a right channel in the case of a stereo signal or more than two channels, such as three, four, five or any other number of channels.

BACKGROUND OF THE INVENTION

Stereo speech and particularly conversational stereo speech has received much less scientific attention than storage and broadcasting of stereophonic music. Indeed in speech communications monophonic transmission is still nowadays mostly used. However with the increase of network bandwidth and capacity, it is envisioned that communications based on stereophonic technologies will become more popular and bring a better listening experience.

Efficient coding of stereophonic audio material has been for a long time studied in perceptual audio coding of music for efficient storage or broadcasting. At high bitrates, where waveform preserving is crucial, sum-difference stereo, known as mid/side (M/S) stereo, has been employed for a long time. For low bit-rates, intensity stereo and more recently parametric stereo coding has been introduced. The latest technique was adopted in different standards as HeAACv2 and Mpeg USAC. It generates a downmix of the two-channel signal and associates compact spatial side information.

Joint stereo coding are usually built over a high frequency resolution, i.e. low time resolution, time-frequency transformation of the signal and is then not compatible to low delay and time domain processing performed in most speech coders. Moreover the engendered bit-rate is usually high.

On the other hand, parametric stereo employs an extra filter-bank positioned in the front-end of the encoder as pre-processor and in the back-end of the decoder as post-processor. Therefore, parametric stereo can be used with conventional speech coders like ACELP as it is done in MPEG USAC. Moreover, the parametrization of the auditory scene can be achieved with minimum amount of side information, which is suitable for low bit-rates. However, parametric stereo is as for example in MPEG USAC not specifically designed for low delay and does not deliver consistent quality for different conversational scenarios. In conventional parametric representation of the spatial scene, the width of the stereo image is artificially reproduced by a decorrelator applied on the two synthesized channels and controlled by Inter-channel Coherence (ICs) parameters computed and transmitted by the encoder. For most stereo speech, this way of widening the stereo image is not appropriate for the recreating the natural ambience of speech which is a pretty direct sound since it is produced by a single source located at a specific position in the space (with sometimes some reverberation from the room). By contrast, music instruments have much more natural width than speech, which can be better imitated by decorrelating the channels.

Problems also occur when speech is recorded with non-coincident microphones, like in A-B configuration when microphones are distant from each other or for binaural recording or rendering. Those scenarios can be envisioned for capturing speech in teleconferences or for creating a virtually auditory scene with distant speakers in the multi-point control unit (MCU). The time of arrival of the signal is then different from one channel to the other unlike recordings done on coincident microphones like X-Y (intensity recording) or M-S (Mid-Side recording). The computation of the coherence of such non time-aligned two channels can then be wrongly estimated which makes fail the artificial ambience synthesis.

Conventional-technology references related to stereo processing are U.S. Pat. No. 5,434,948 or 8,811,621.

Document WO 2006/089570 A1 discloses a near-transparent or transparent multi-channel encoder/decoder scheme. A multi-channel encoder/decoder scheme additionally generates a waveform-type residual signal. This residual signal is transmitted together with one or more multi-channel parameters to a decoder. In contrast to a purely parametric multi-channel decoder, the enhanced decoder generates a multi-channel output signal having an improved output quality because of the additional residual signal. On the encoder-side, a left channel and a right channel are both filtered by an analysis filter-bank. Then, for each subband signal, an alignment value and a gain value are calculated for a subband. Such an alignment is then performed before further processing. On the decoder-side, a de-alignment and a gain processing is performed and the corresponding signals are then synthesized by a synthesis filter-bank in order to generate a decoded left signal and a decoded right signal.

On the other hand, parametric stereo employs an extra filter-bank positioned in the front-end of the encoder as pre-processor and in the back-end of the decoder as post-processor. Therefore, parametric stereo can be used with conventional speech coders like ACELP as it is done in MPEG USAC. Moreover, the parametrization of the auditory scene can be achieved with minimum amount of side information, which is suitable for low bit-rates. However, parametric stereo is as for example in MPEG USAC not specifically designed for low delay and the overall system shows a very high algorithmic delay.

SUMMARY

According to an embodiment, an apparatus for encoding a multi-channel signal including at least two channels may have: a time-spectral converter for converting sequences of blocks of sampling values of the at least two channels into a frequency domain representation having sequences of blocks of spectral values for the at least two channels; a multi-channel processor for applying a joint multi-channel processing to the sequences of blocks of spectral values to obtain at least one result sequence of blocks of spectral values including information related to the at least two channels; a spectral-time converter for converting the result sequence of blocks of spectral values into a time domain representation including an output sequence of blocks of sampling values; and a core encoder for encoding the output sequence of blocks of sampling values to obtain an encoded multi-channel signal, wherein the core encoder is configured to operate in accordance with a first frame control to provide a sequence of frames, wherein a frame is bounded by a start frame border and an end frame border, and wherein the time-spectral converter or the spectral-time converter are configured to operate in accordance with a second frame control being synchronized to the first frame control, wherein the start frame border or the end frame border of each frame of the sequence of frames is in a predetermined relation to a start instant or an end instant of an overlapping portion of a window used by the time-spectral converter for each block of the sequence of blocks of sampling values or used by the spectral-time converter for each block of the output sequence of blocks of sampling values.

According to another embodiment, a method of encoding a multi-channel signal including at least two channels may have the steps of: converting sequences of blocks of sampling values of the at least two channels into a frequency domain representation having sequences of blocks of spectral values for the at least two channels; applying a joint multi-channel processing to the sequences of blocks of spectral values to obtain at least one result sequence of blocks of spectral values including information related to the at least two channels; converting the result sequence of blocks of spectral values into a time domain representation including an output sequence of blocks of sampling values; and core encoding the output sequence of blocks of sampling values to obtain an encoded multi-channel signal, wherein the core encoding operates in accordance with a first frame control to provide a sequence of frames, wherein a frame is bounded by a start frame border and an end frame border, and wherein the time-spectral converting or the spectral-time converting operates in accordance with a second frame control being synchronized to the first frame control, wherein the start frame border or the end frame border of each frame of the sequence of frames is in a predetermined relation to a start instant or an end instant of an overlapping portion of a window used by the time-spectral converting for each block of the sequence of blocks of sampling values or used by the spectral-time converting for each block of the output sequence of blocks of sampling values.

According to another embodiment, an apparatus for decoding an encoded multi-channel signal may have: a core decoder for generating a core decoded signal; a time-spectral converter for converting a sequence of blocks of sampling values of the core decoded signal into a frequency domain representation having a sequence of blocks of spectral values for the core decoded signal; a multi-channel processor for applying an inverse multi-channel processing to a sequence including the sequence of blocks to obtain at least two result sequences of blocks of spectral values; and a spectral-time converter for converting the at least two result sequences of blocks of spectral values into a time domain representation including at least two output sequences of blocks of sampling values, wherein the core decoder is configured to operate in accordance with a first frame control to provide a sequence of frames, wherein a frame is bounded by a start frame border and an end frame border, wherein the time-spectral converter or the spectral-time converter is configured to operate in accordance with a second frame control being synchronized to the first frame control, wherein the time-spectral converter or the spectral-time converter are configured to operate in accordance with a second frame control being synchronized to the first frame control, wherein the start frame border or the end frame border of each frame of the sequence of frames is in a predetermined relation to a start instant or an end instant of an overlapping portion of a window used by the time-spectral converter for each block of the sequence of blocks of sampling values or used by the spectral-time converter for each block of the at least two output sequences of blocks of sampling values.

According to another embodiment, a method of decoding an encoded multi-channel signal may have the steps of: generating a core decoded signal; converting a sequence of blocks of sampling values of the core decoded signal into a frequency domain representation having a sequence of blocks of spectral values for the core decoded signal; applying an inverse multi-channel processing to a sequence including the sequence of blocks to obtain at least two result sequences of blocks of spectral values; and converting the at least two result sequences of blocks of spectral values into a time domain representation including at least two output sequences of blocks of sampling values, wherein the generating the core decoded signal operates in accordance with a first frame control to provide a sequence of frames, wherein a frame is bounded by a start frame border and an end frame border, wherein the time spectral converting or the spectral time converting operates in accordance with a second frame control being synchronized to the first frame control, wherein the time-spectral converting or the spectral-time converting operate in accordance with a second frame control being synchronized to the first frame control, wherein the start frame border or the end frame border of each frame of the sequence of frames is in a predetermined relation to a start instant or an end instant of an overlapping portion of a window used by the time spectral converting for each block of the sequence of blocks of sampling values or used by the spectral time converting for each block of the at least two output sequences of blocks of sampling values.

According to another embodiment, a non-transitory digital storage medium may have a computer program stored thereon to perform the inventive methods.

The present invention is based on the finding that at least a portion and advantageously all parts of the multi-channel processing, i.e., a joint multi-channel processing are performed in a spectral domain. Specifically, it is advantageous to perform the downmix operation of the joint multi-channel processing in the spectral domain and, additionally, temporal and phase alignment operations or even procedures for analyzing parameters for the joint stereo/joint multi-channel processing. Furthermore, a synchronization of the frame control for the core encoder and the stereo processing operating in the spectral domain is performed.

The core encoder is configured to operate in accordance with a first frame control to provide a sequence of frames, wherein a frame is bounded by a start frame border and an end frame border, and the time-spectral converter or the spectral-time converter are configured to operate in accordance with a second frame control being synchronized to the first frame control, wherein the start frame border or the end frame border of each frame of the sequence of frames is in a predetermined relation to a start instant or an end instant of an overlapping portion of a window used by the time-spectral converter (1000) for each block of the sequence of blocks of sampling values or used by the spectral-time converter for each block of the output sequence of blocks of sampling values.

In the invention, the core encoder of the multi-channel encoder is configured to operate in accordance with a framing control, and the time-spectral converter and the spectrum-time converter of the stereo post-processor and resampler are also configured to operate in accordance with a further framing control which is synchronized to the framing control of the core encoder. The synchronization is performed in such a way that a start frame border or an end frame border of each frame of a sequence of frames of the core encoder is in a predetermined relation to a start instant or an end instant of an overlapping portion of a window used by the time-spectral converter or the spectral time converter for each block of the sequence of blocks of sampling values or for each block of the resampled sequence of blocks of spectral values. Thus, it is assured that the subsequent framing operations operate in synchrony to each other.

In further embodiments, a look-ahead operation with a look-ahead portion is performed by the core encoder. In this embodiment, it is advantageous that the look-ahead portion is also used by an analysis window of the time-spectral converter where an overlap portion of the analysis window is used that has a length in time being lower than or equal to the length in time of the look-ahead portion.

Thus, by making the look-ahead portion of the core encoder and the overlap portion of the analysis window equal to each other or by making the overlap portion even smaller than the look-ahead portion of the core encoder, the time-spectral analysis of the stereo pre-processor can't be implemented without any additional algorithmic delay. In order to make sure that this windowed look-ahead portion does not influence the core encoder look-ahead functionality too much, it is advantageous to redress this portion using an inverse of the analysis window function.

In order to be sure that this is done with a good stability, a square root of sine window shape is used instead of a sine window shape as an analysis window and a sine to the power of 1.5 synthesis window is used for the purpose of synthesis windowing before performing the overlap operation at the output of the spectral-time converter. Thus, it is made sure that the redressing function assumes values that are reduced with respect to their magnitudes compared to a redressing function being the inverse of a sine-function.

Advantageously, a spectral domain resampling is performed either subsequent to the multi-channel processing or even before the multi-channel processing in order to provide an output signal from a further spectral-time converter that is already at an output sampling rate that may be used by a subsequently connected core encoder. But, the inventive procedure of synchronizing the frame control of the core encoder and the spectral time or time spectral converter can also be applied in a scenario where any spectral domain resampling is not executed.

On the decoder-side, it is advantageous to once again perform at least an operation for generating a first channel signal and a second channel signal from a downmix signal in the spectral domain and, advantageously, to perform even the whole inverse multi-channel processing in the spectral domain. Furthermore, the time-spectral converter is provided for converting the core decoded signal into a spectral domain representation and, within the frequency domain, the inverse multi-channel processing is performed.

The core decoder is configured to operate in accordance with a first frame control to provide a sequence of frames, wherein a frame is bounded by a start frame border and an end frame border. The time-spectral converter or the spectral-time converter is configured to operate in accordance with a second frame control being synchronized to the first frame control. Specifically, the time-spectral converter or the spectral-time converter are configured to operate in accordance with a second frame control being synchronized to the first frame control, wherein the start frame border or the end frame border of each frame of the sequence of frames is in a predetermined relation to a start instant or an end instant of an overlapping portion of a window used by the time-spectral converter for each block of the sequence of blocks of sampling values or used by the spectral-time converter for each block of the at least two output sequences of blocks of sampling values.

It is advantageous to use the same analysis and synthesis window shapes, since there is no redressing required, of course. On the other hand, it is advantageous to use a time gap on the decoder-side, where the time gap exists between an end of a leading overlapping portion of an analysis window of the time-spectral converter on the decoder-side and a time instant at the end of a frame output by the core decoder on the multi-channel decoder-side. Thus, the core decoder output samples within this time gap are not required for the purpose of analysis windowing by the stereo post-processor immediately, but may be used only for the processing/windowing of the next frame. Such a time gap can be, for example, implemented by using a non-overlapping portion typically in the middle of an analysis window which results in a shortening of the overlapping portion. However, other alternatives for implementing such a time gap can be used as well, but implementing the time gap by the non-overlapping portion in the middle is the advantageous way. Thus, this time gap can be used for other core decoder operations or smoothing operations between advantageously switching events when the core decoder switches from a frequency-domain to a time-domain frame or for any other smoothing operations that may be useful when the parameter changes or coding characteristic changes have occurred.

In an embodiment, a spectral domain resampling is either performed before the multi-channel inverse processing or is performed subsequent to the multi-channel inverse processing in such a way that, in the end, a spectral-time converter converts a spectrally resampled signal into the time domain at an output sampling rate that is intended for the time domain output signal.

Therefore, the embodiments allow to completely avoid any computational intensive time-domain resampling operations. Instead, the multi-channel processing is combined with the resampling. The spectral domain resampling is, in advantageous embodiments, either performed by truncating the spectrum in the case of downsampling or is performed by zero padding the spectrum in the case of upsampling. These easy operations, i.e., truncating the spectrum on the one hand or zero padding the spectrum on the other hand and advantageous additional scalings in order to account for certain normalization operations performed in spectral domain/time-domain conversion algorithms such as DFT or FFT algorithm complete the spectral domain resampling operation in a very efficient and low-delay manner.

Furthermore, it has been found that at least a portion or even the whole joint stereo processing/joint multi-channel processing on the encoder-side and the corresponding inverse multi-channel processing on the decoder-side is suitable for being executed in the frequency-domain. This is not only valid for the downmix operation as a minimum joint multi-channel processing on the encoder-side or an upmix processing as a minimum inverse multi-channel processing on the decoder-side. Instead, even a stereo scene analysis and time/phase alignments on the encoder-side or phase and time de-alignments on the decoder-side can be performed in the spectral domain as well. The same applies to the advantageously performed Side channel encoding on the encoder-side or Side channel synthesis and usage for the generation of the two decoded output channels on the decoder-side.

Therefore, an advantage of the present invention is to provide a new stereo coding scheme much more suitable for conversion of a stereo speech than the existing stereo coding schemes. Embodiments of the present invention provide a new framework for achieving a low-delay stereo codec and integrating a common stereo tool performed in frequency-domain for both a speech core coder and an MDCT-based core coder within a switched audio codec.

Embodiments of the present invention relate to a hybrid approach mixing elements from a conventional M/S stereo or parametric stereo. Embodiments use some aspects and tools from the joint stereo coding and others from the parametric stereo. More particularly, embodiments adopt the extra time-frequency analysis and synthesis done at the front end of the encoder and at the back-end of the decoder. The time-frequency decomposition and inverse transform is achieved by employing either a filter-bank or a block transform with complex values. From the two channels or multi-channel input, the stereo or multi-channel processing combines and modifies the input channels to output channels referred to as Mid and Side signals (MS).

Embodiments of the present invention provide a solution for reducing an algorithmic delay introduced by a stereo module and particularly from the framing and windowing of its filter-bank. It provides a multi-rate inverse transform for feeding a switched coder like 3GPP EVS or a coder switching between a speech coder like ACELP and a generic audio coder like TCX by producing the same stereo processing signal at different sampling rates. Moreover, it provides a windowing adapted for the different constraints of the low-delay and low-complex system as well as for the stereo processing. Furthermore, embodiments provide a method for combining and resampling different decoded synthesis results in the spectral domain, where the inverse stereo processing is applied as well.

Advantageous embodiments of the present invention comprise a multi-function in a spectral domain resampler not only generating a single spectral-domain resampled block of spectral values but, additionally, a further resampled sequence of blocks of spectral values corresponding to a different higher or lower sampling rate.

Furthermore, the multi-channel encoder is configured to additionally provide an output signal at the output of the spectral-time converter that has the same sampling rate as the original first and second channel signal input into the time-spectral converter on the encoder-side. Thus, the multi-channel encoder provides, in embodiments, at least one output signal at the original input sampling rate, that is advantageously used for an MDCT-based encoding. Additionally, at least one output signal is provided at an intermediate sampling rate that is specifically useful for ACELP coding and additionally provides a further output signal at a further output sampling rate that is also useful for ACELP encoding, but that is different from the other output sampling rate.

These procedures can be performed either for the Mid signal or for the Side signal or for both signals derived from the first and the second channel signal of a multi-channel signal where the first signal can also be a left signal and the second signal can be a right signal in the case of a stereo signal only having two channels (additionally two, for example, a low-frequency enhancement channel).

BRIEF DESCRIPTION OF THE DRAWINGS

Embodiments of the present invention will be detailed subsequently referring to the appended drawings, in which:

FIG. 3*d* illustrates different frequency resolutions and other frequency-related aspects for certain embodiments;

FIG. 8*a* illustrates a table showing different characteristics of window for several sampling rates;

FIG. 8*b* illustrates different proposals/embodiments for a DFT filter-bank as an implementation of the time-spectral converter and a spectrum-time converter;

DETAILED DESCRIPTION OF THE INVENTION

Figure 1:
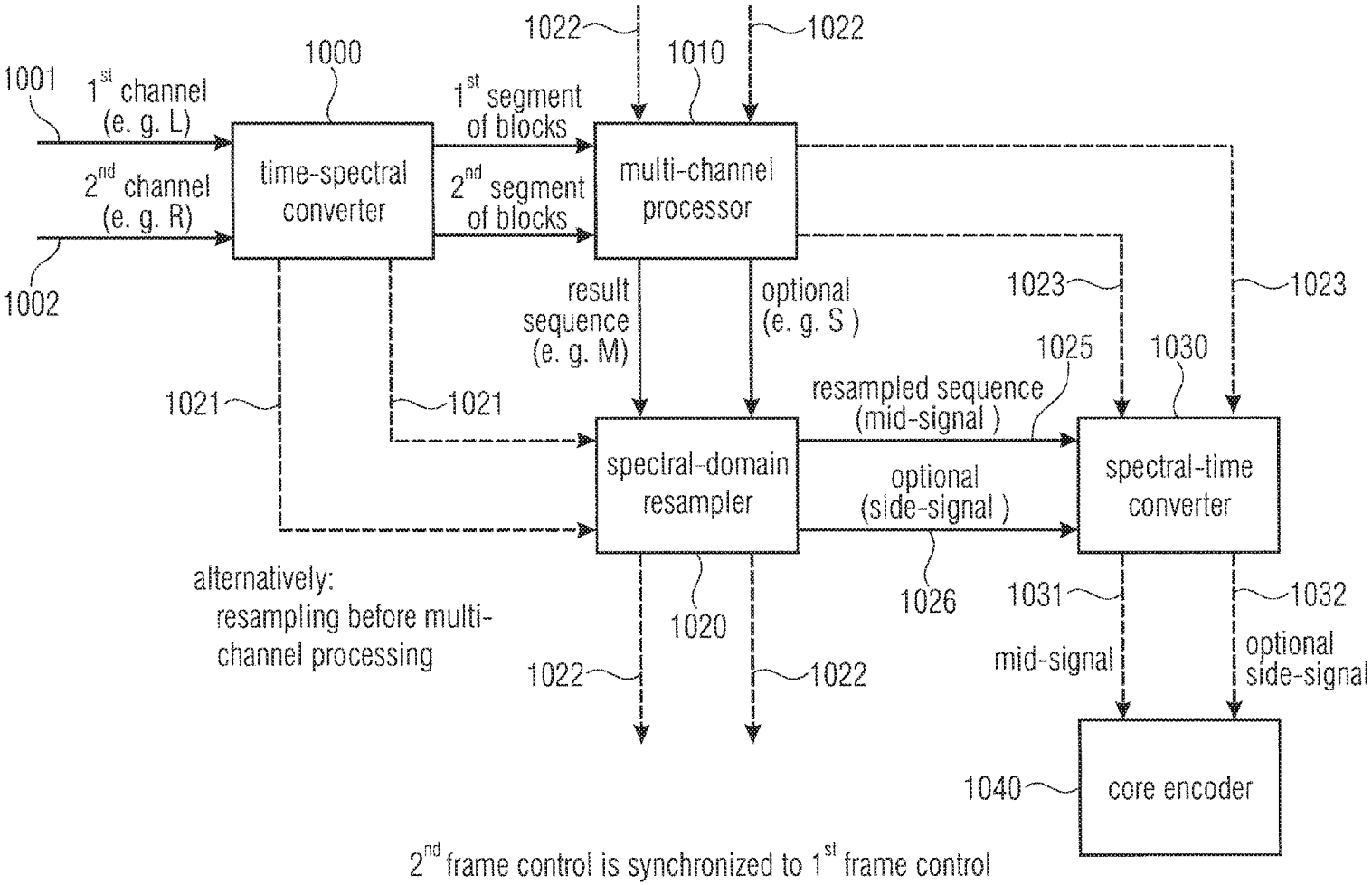
FIG. 1 is a block diagram of an embodiment of the multi-channel encoder.

FIG. 1 illustrates an apparatus for encoding a multi-channel signal comprising at least two channels 1001, 1002. The first channel 1001 in the left channel, and the second channel 1002 can be a right channel in the case of a two-channel stereo scenario. However, in the case of a multi-channel scenario, the first channel 1001 and the second channel 1002 can be any of the channels of the multi-channel signal such as, for example, the left channel on the one hand and the left surround channel on the other hand or the right channel on the one hand and the right surround channel on the other hand. These channel pairings, however, are only examples, and other channel pairings can be applied as need be.

The multi-channel encoder of FIG. 1 comprises a time-spectral converter for converting sequences of blocks of sampling values of the at least two channels into a frequency-domain representation at the output of the time-spectral converter. Each frequency domain representation has a sequence of blocks of spectral values for one of the at least two channels. Particularly, a block of sampling values of the first channel 1001 or the second channel 1002 has an associated input sampling rate, and a block of spectral values of the sequences of the output of the time-spectral converter has spectral values up to a maximum input frequency being related to the input sampling rate. The time-spectral converter is, in the embodiment illustrated in FIG. 1, connected to the multi-channel processor 1010. This multi-channel processor is configured for applying a joint multi-channel processing to the sequences of blocks of spectral values to obtain at least one result sequence of blocks of spectral values comprising information related to the at least two channels. A typical multi-channel processing operation is a downmix operation, but the advantageous multi-channel operation comprises additional procedures that will be described later on.

The core encoder 1040 is configured to operate in accordance with a first frame control to provide a sequence of frames, wherein a frame is bounded by a start frame border 1901 and an end frame border 1902. The time-spectral converter 1000 or the spectral-time converter 1030 are configured to operate in accordance with a second frame control being synchronized to the first frame control, wherein the start frame border 1901 or the end frame border 1902 of each frame of the sequence of frames is in a predetermined relation to a start instant or an end instant of an overlapping portion of a window used by the time-spectral converter 1000 for each block of the sequence of blocks of sampling values or used by the spectral-time converter 1030 for each block of the output sequence of blocks of sampling values.

As illustrated in FIG. 1, the spectral domain resampling is an optional feature. The invention can also be executed without any resampling, or with a resampling after multi-channel processing or before multichannel processing. In case of use, the spectral domain resampler 1020 performs a resampling operation in the frequency domain on data input into the spectral-time converter 1030 or on data input into the multi-channel processor 1010, wherein a block of a resampled sequence of blocks of spectral values has spectral values up to a maximum output frequency 1231, 1221 being different from the maximum input frequency 1211. Subsequently, embodiments with resampling are described, but it is to be emphasized that the resampling is an optional feature.

In a further embodiment, the multi-channel processor 1010 is connected to a spectral domain resampler 1020, and an output of the spectral-domain resampler 1020 is input into the multi-channel processor. This is illustrated by the broken connection lines 1021, 1022. In this alternative embodiment, the multi-channel processor is configured for applying the joint multi-channel processing not to the sequences of blocks of spectral values as output by the time-spectral converter, but resampled sequences of blocks as available on connection lines 1022.

The spectral-domain resampler 1020 is configured for resampling of the result sequence generated by the multi-channel processor or to resample the sequences of blocks output by the time-spectral converter 1000 to obtain a resampled sequence of blocks of spectral values that may represent a Mid-signal as illustrated at line 1025. Advantageously, the spectral domain resampler additionally performs resampling to the Side signal generated by the multi-channel processor and, therefore, also outputs a resampled sequence corresponding to the Side signal as illustrated at 1026. However, the generation and resampling of the Side signal is optional and is not required for a low bit rate implementation. Advantageously, the spectral-domain resampler 1020 is configured for truncating blocks of spectral values for the purpose of downsampling or for zero padding the blocks of spectral values for the purpose of upsampling. The multi-channel encoder additionally comprises a spectral-time converter for converting the resampled sequence of blocks of spectral values into a time-domain representation comprising an output sequence of blocks of sampling values having associated an output sampling rate being different from the input sampling rate. In alternative embodiments, where the spectral domain resampling is performed before multi-channel processing, the multi-channel processor provides the result sequence via broken line 1023 directly to the spectral-time converter 1030. In this alternative embodiment, an optional feature is that, additionally, the Side signal is generated by the multi-channel processor already in the resampled representation and the Side signal is then also processed by the spectral-time converter.

In the end, the spectral-time converter advantageously provides a time-domain Mid signal 1031 and an optional time-domain Side signal 1032, that can both be core-encoded by the core encoder 1040. Generally, the core encoder is configured for a core encoding the output sequence of blocks of sampling values to obtain the encoded multi-channel signal.

Figure 2:
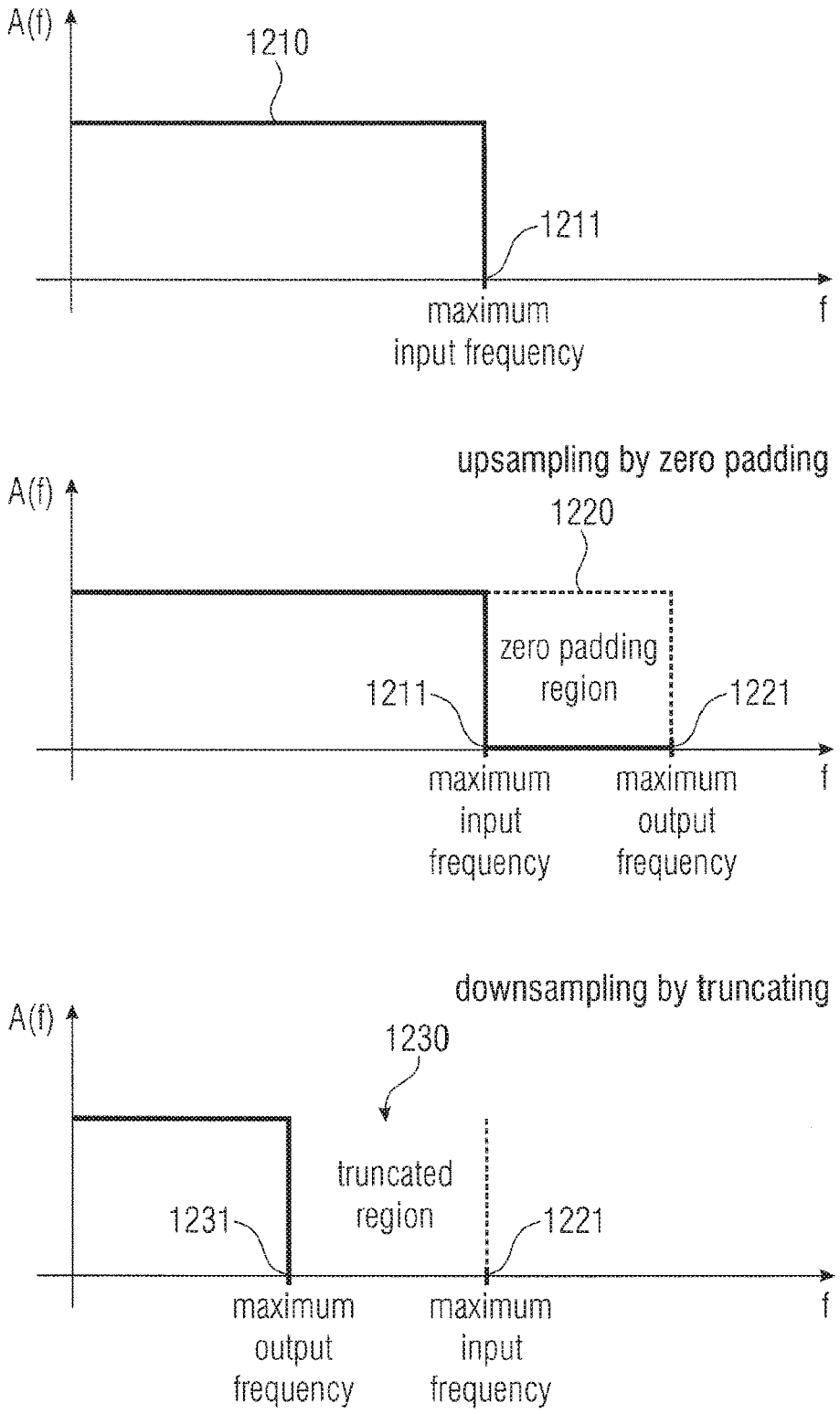
FIG. 2 illustrates embodiments of the spectral domain resampling.

FIG. 2 illustrates spectral charts that are useful for explaining the spectral domain resampling.

The upper chart in FIG. 2 illustrates a spectrum of a channel as available at the output of the time-spectral converter 1000. This spectrum 1210 has spectral values up to the maximum input frequency 1211. In the case of upsampling, a zero padding is performed within the zero padding portion or zero padding region 1220 that extends until the maximum output frequency 1221. The maximum output frequency 1221 is greater than the maximum input frequency 1211, since an upsampling is intended.

Contrary thereto, the lowest chart in FIG. 2 illustrates the procedures incurred by downsampling a sequence of blocks. To this end, a block is truncated within a truncated region 1230 so that a maximum output frequency of the truncated spectrum at 1231 is lower than the maximum input frequency 1211.

Typically, the sampling rate associated with a corresponding spectrum in FIG. 2 is at least 2× the maximum frequency of the spectrum. Thus, for the upper case in FIG. 2, the sampling rate will be at least 2 times the maximum input frequency 1211.

In the second chart of FIG. 2, the sampling rate will be at least two times the maximum output frequency 1221, i.e., the highest frequency of the zero padding region 1220. Contrary thereto, in the lowest chart in FIG. 2, the sampling rate will be at least 2× the maximum output frequency 1231, i.e., the highest spectral value remaining subsequent to a truncation within the truncated region 1230.

Figure 3A:
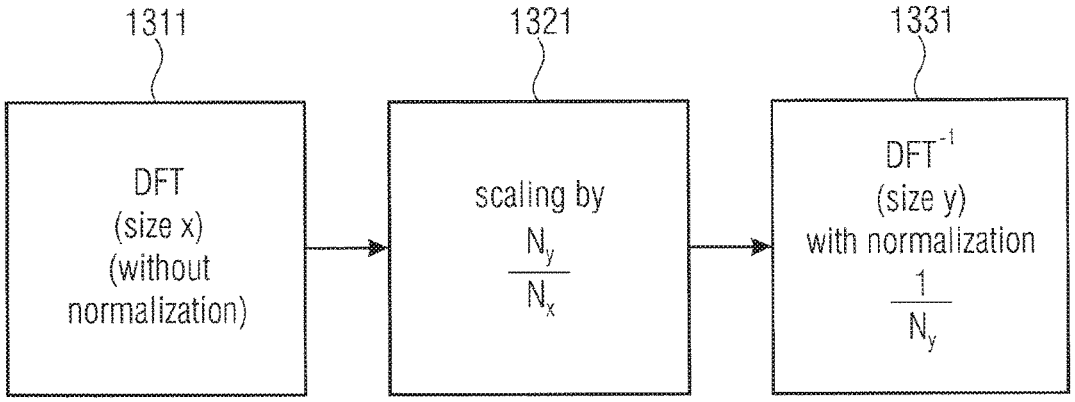
FIG. 3*a*-3*c* illustrate different alternatives for performing time/frequency or frequency/time-conversions with different normalizations and corresponding scalings in the spectral domain.
Figure 3B:
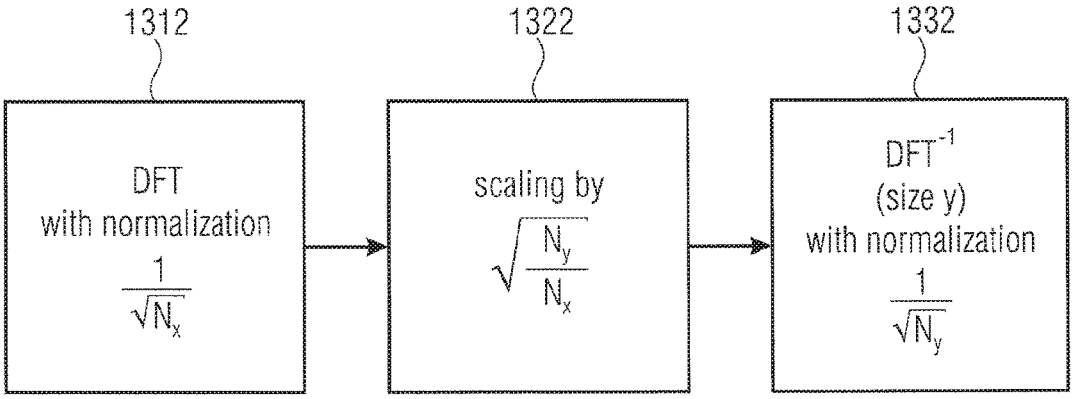
Figure 3C:
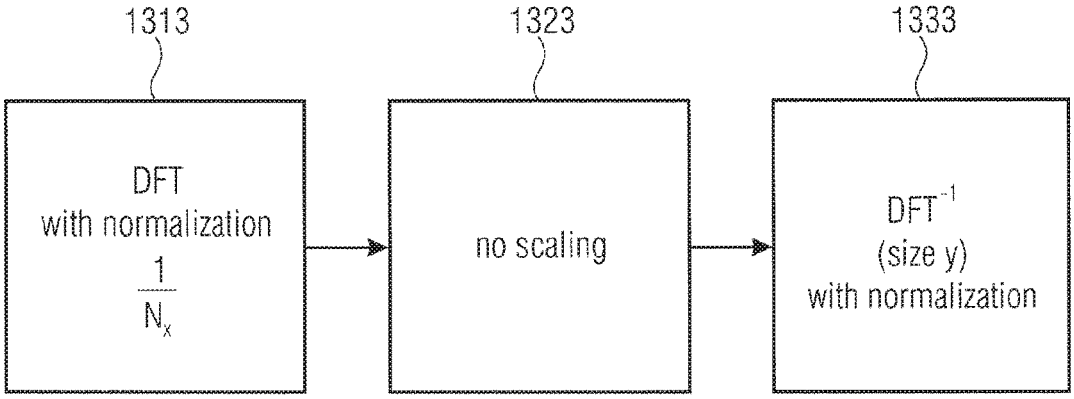

FIGS. 3*a* to 3*c* illustrate several alternatives that can be used in the context of certain DFT forward or backward transform algorithms. In FIG. 3*a*, a situation is considered, where a DFT with a size x is performed, and where there does not occur any normalization in the forward transform algorithm 1311. At block 1331, a backward transform with a different size y is illustrated, where a normalization with $1/N_y$ is performed. $N_y$ is the number of spectral values of the backward transform with size y. Then, it is advantageous to perform a scaling by $N_y/N_x$ as illustrated by block 1321.

Contrary thereto, FIG. 3*b* illustrates an implementation, where the normalization is distributed to the forward transform 1312 and the backward transform 1332. Then a scaling may be used as illustrated in block 1322, where a square root of the relation between the number of spectral values of the backward transform to the number of spectral values of the forward transform is useful.

FIG. 3*c* illustrates a further implementation, where the whole normalization is performed on the forward transform where the forward transform with the size x is performed. Then, the backward transform as illustrated in block 1333 operates without any normalization so that any scaling is not required as illustrated by the schematic block 1323 in FIG. 3*c*. Thus, depending on certain algorithms, certain scaling operations or even no scaling operations may be used. It is, however, advantageous to operate in accordance with FIG. 3*a*.

In order to keep the overall delay low, the present invention provides a method at the encoder-side for avoiding the need of a time-domain resampler and by replacing it by resampling the signals in the DFT domain. For example, in EVS it allows saving 0.9375 ms of delay coming from the time-domain resampler. The resampling in frequency domain is achieved by zero padding or truncating the spectrum and scaling it correctly.

Consider an input windowed signal x sampled at rate fx with a spectrum X of size $N_x$ and a version y of the same signal re-sampled at rate fy with a spectrum of size $N_y$. The sampling factor is then equal to:

$$fy/fx=N_y/N_x$$

in case of downsampling $N_x>N_y$. The downsampling can be simply performed in frequency domain by directly scaling and truncating the original spectrum X:

$$Y[k]=X[k]\cdot N_y/N_x \text{ for } k=0 \ldots N_y$$

in case of upsampling $N_x<N_y$. The up-sampling can be simply performed in frequency domain by directly scaling and zero padding the original spectrum X:

$$Y[k]=X[k]\cdot N_y/N_x \text{ for } k=0 \ldots N_x$$

$$Y[k]=0 \text{ for } k=N_x \ldots N_y$$

Both re-sampling operations can be summarized by:

$$Y[k]=X[k]\cdot N_y/N_x \text{ for all } k=0 \ldots \min(N_y,N_x)$$

$$Y[k]=0 \text{ for all } k=\min(N_y,N_x) \ldots N_y \text{ for if } N_y>N_x$$

Once the new spectrum Y is obtained, the time-domain signal y can be obtained by applying the associated inverse transform iDFT of size $N_y$:

$$y=iDFT(Y)$$

For constructing the continuous time signal over different frames, the output frame y is then windowed and overlap-added to the previously obtained frame.

The window shape is for all sampling rates the same, but the window has different sizes in samples and is differently sampled depending of the sampling rate. The number of samples of the windows and their values can be easily derived since the shape is purely defined analytically. The different parts and sizes of the window can be found in FIG. 8*a* as a function of the targeted sampling rate. In this case a sine function in the overlapping part (LA) is used for the analysis and synthesis windows. For these regions, the ascending ovlp_size coefficients are given by:

$$\text{win_ovlp}(k)=\sin(\text{pi}*(k+0.5)/(2*\text{ovlp_size})) \ldots \text{for } k=0 \ldots \text{ovlp_size-1}$$

while the descending ovlp_size coefficients are given by:

$$\text{win_ovlp}(k)=\sin(\text{pi}*(\text{ovlp_size-1}-k+0.5)/(2*\text{ovlp_size})) \ldots \text{for } k=0 \ldots \text{ovlp_size-1}$$

where ovlp_size is function of the sampling rate and given in FIG. 8*a*.

Figure 4A:
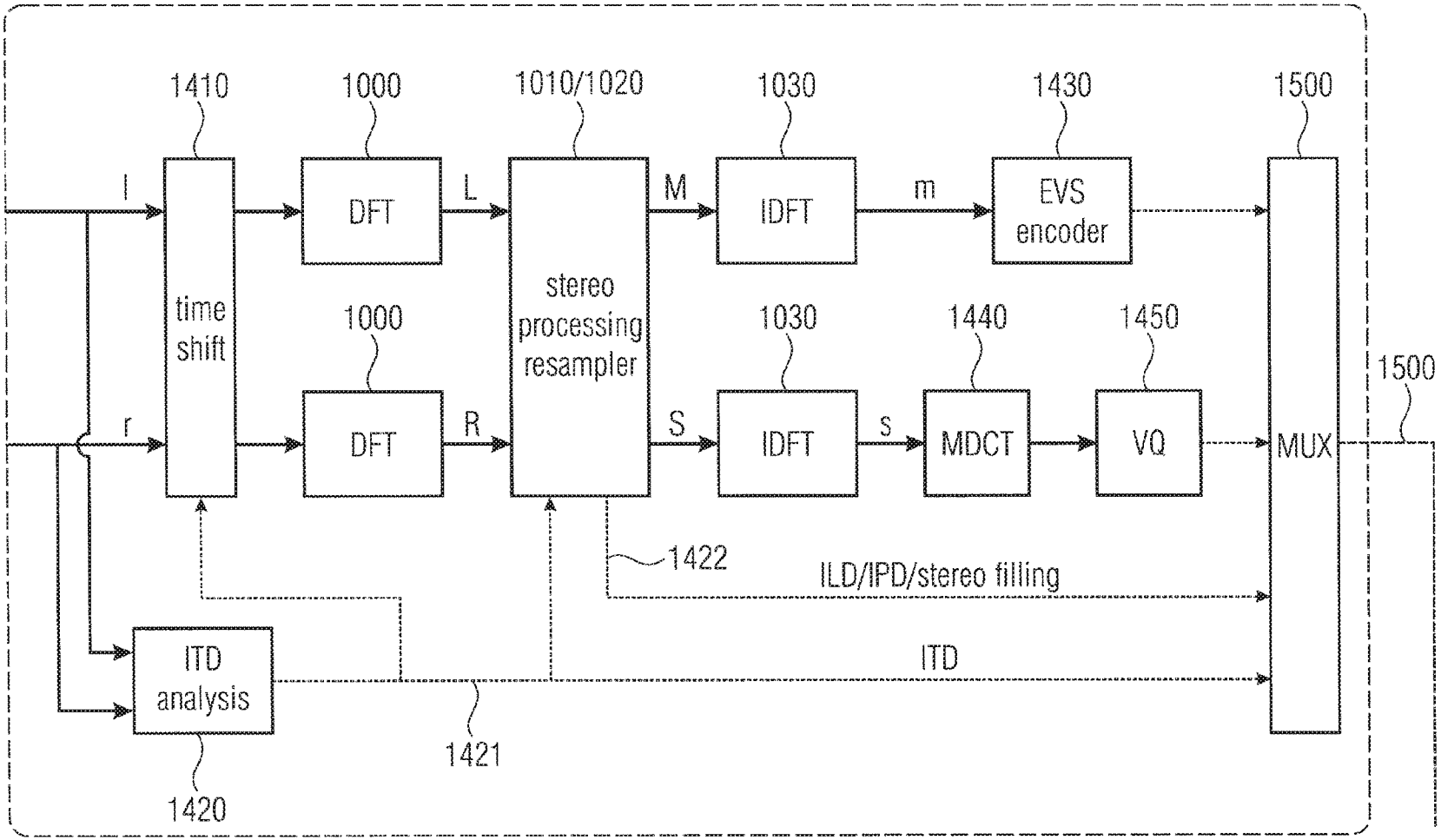
FIG. 4*a* illustrates a block diagram of an embodiment of an encoder.
Figure 4B:
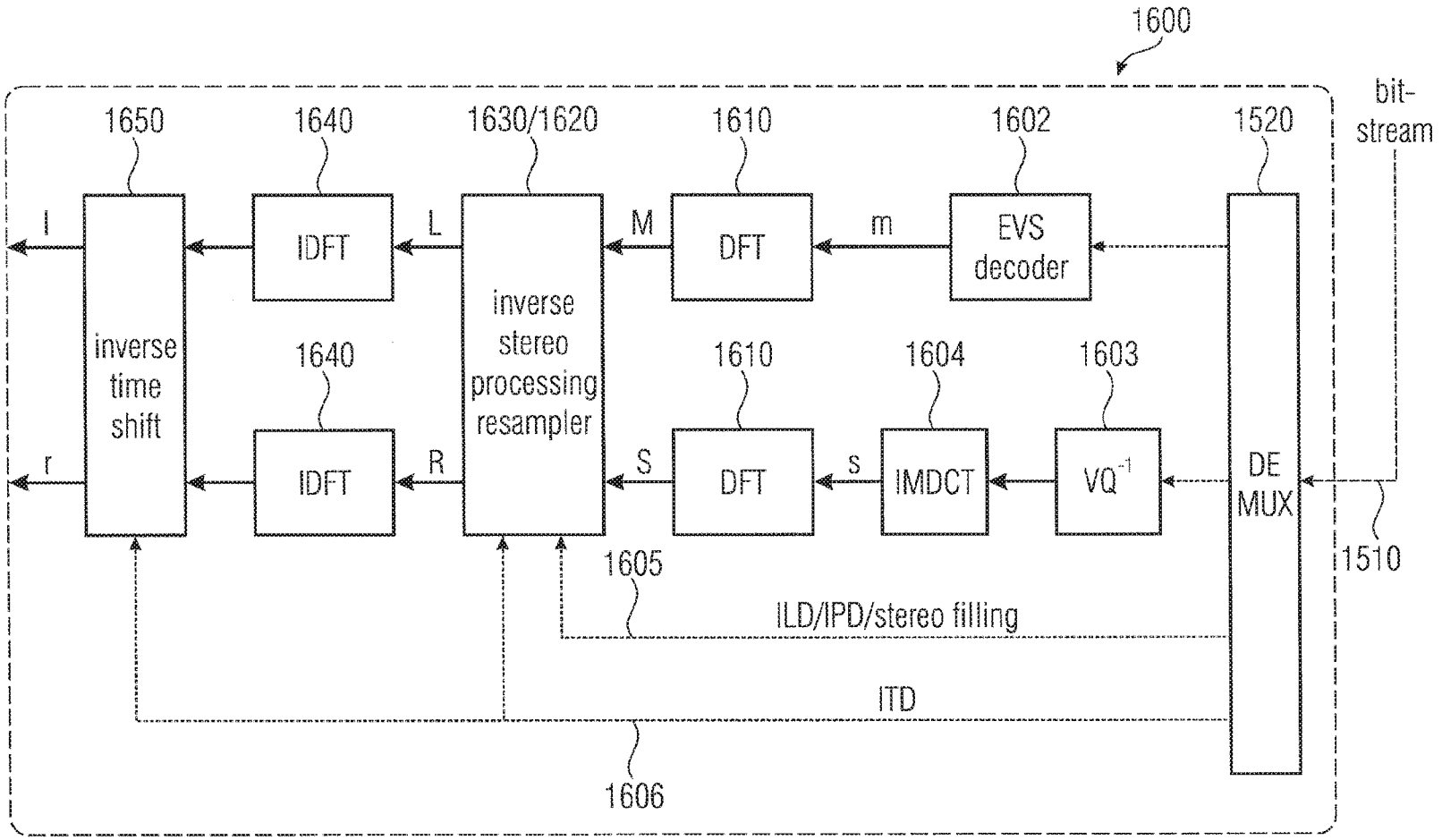
FIG. 4*b* illustrates a block diagram of a corresponding embodiment of a decoder.

The new low-delay stereo coding is a joint Mid/Side (M/S) stereo coding exploiting some spatial cues, where the Mid-channel is coded by a primary mono core coder the mono core coder, and the Side-channel is coded in a secondary core coder. The encoder and decoder principles are depicted in FIGS. 4*a* and 4*b*.

The stereo processing is performed mainly in Frequency Domain (FD). Optionally some stereo processing can be performed in Time Domain (TD) before the frequency analysis. It is the case for the ITD computation, which can be computed and applied before the frequency analysis for aligning the channels in time before pursuing the stereo analysis and processing.

Alternatively, ITD processing can be done directly in frequency domain. Since usual speech coders like ACELP do not contain any internal time-frequency decomposition, the stereo coding adds an extra complex modulated filter-bank by means of an analysis and synthesis filter-bank before the core encoder and another stage of analysis-synthesis filter-bank after the core decoder. In the advantageous embodiment, an oversampled DFT with a low overlapping region is employed. However, in other embodiments, any complex valued time-frequency decomposition with similar temporal resolution can be used. In the following to the stereo filter-band either a filter-bank like QMF or a block transform like DFT is referred to.

The stereo processing consists of computing the spatial cues and/or stereo parameters like inter-channel Time Difference (ITD), the inter-channel Phase Differences (IPDs), inter-channel Level Differences (ILDs) and prediction gains for predicting Side signal (S) with the Mid signal (M). It is important to note that the stereo filter-bank at both encoder and decoder introduces an extra delay in the coding system.

FIG. 4*a* illustrates an apparatus for encoding a multi-channel signal where, in this implementation, a certain joint stereo processing is performed in the time-domain using an inter-channel time difference (ITD) analysis and where the result of this ITD analysis 1420 is applied within the time domain using a time-shift block 1410 placed before the time-spectral converters 1000.

Then, within the spectral domain, a further stereo processing 1010 is performed which incurs, at least, a downmix of left and right to the Mid signal M and, optionally, the calculation of a Side signal S and, although not explicitly illustrated in FIG. 4*a*, a resampling operation performed by the spectral-domain resampler 1020 illustrated in FIG. 1 that can apply one of the two different alternatives, i.e., performing the resampling subsequent to the multi-channel processing or before the multi-channel processing.

Furthermore, FIG. 4*a* illustrates further details of an advantageous core encoder 1040. Particularly, for the purpose of coding the time-domain Mid signal m at the output of the spectral-time converter 1030, an EVS encoder is used. Additionally, an MDCT coding 1440 and the subsequently connected vector quantization 1450 is performed for the purpose of Side signal encoding.

The encoded or core-encoded Mid signal, and the core-encoded Side signal are forwarded to a multiplexer 1500 that multiplexes these encoded signals together with side information. One kind of side information is the ID parameter output at 1421 to the multiplexer (and optionally to the stereo processing element 1010), and further parameters are in the channel level differences/prediction parameters, inter-channel phase differences (IPD parameters) or stereo filling parameters as illustrated at line 1422. Correspondingly, the FIG. 4B apparatus for decoding a multi-channel signal represented by a bitstream 1510 comprises a demultiplexer 1520, a core decoder consisting in this embodiment, of an EVS decoder 1602 for the encoded Mid signal m and a vector dequantizer 1603 and a subsequently connected inverse MDCT block 1604. Block 1604 provides the core decoded Side signal s. The decoded signals m, s are converted into the spectral domain using time-spectral converters 1610, and, then, within the spectral domain, the inverse stereo processing and resampling is performed. Again, FIG. 4*b* illustrates a situation where the upmixing from the M signal to left L and right R is performed and, additionally, a narrowband de-alignment using IPD parameters and, additionally, further procedures for calculating an as good as possible left and right channel using the inter-channel level difference parameters ILD and the stereo filling parameters on line 1605. Furthermore, the demultiplexer 1520 not only extracts the parameters on line 1605 from the bitstream 1510, but also extracts the inter-channel time difference on line 1606 and forwards this information to block inverse stereo processing/resampler and, additionally, to an inverse time shift processing in block 1650 that is performed in the time-domain i.e., subsequent to the procedure performed by the spectral-time converters that provide the decoded left and right signals at the output rate, which is different from the rate at the output of the EVS decoder 1602 or different from the rate at the output of IMDCT block 1604, for example.

The stereo DFT can then provide different sampled versions of the signal which is further convey to the switched core encoder. The signal to code can be the Mid channel, the Side channel, or the left and right channels, or any signal resulting from a rotation or channel mapping of the two input channels. Since the different core encoders of switched system accept different sampling rates, it is an important feature that the stereo synthesis filter-bank can provides a multi-rated signal. The principle is given in FIG. 5.

Figure 5:
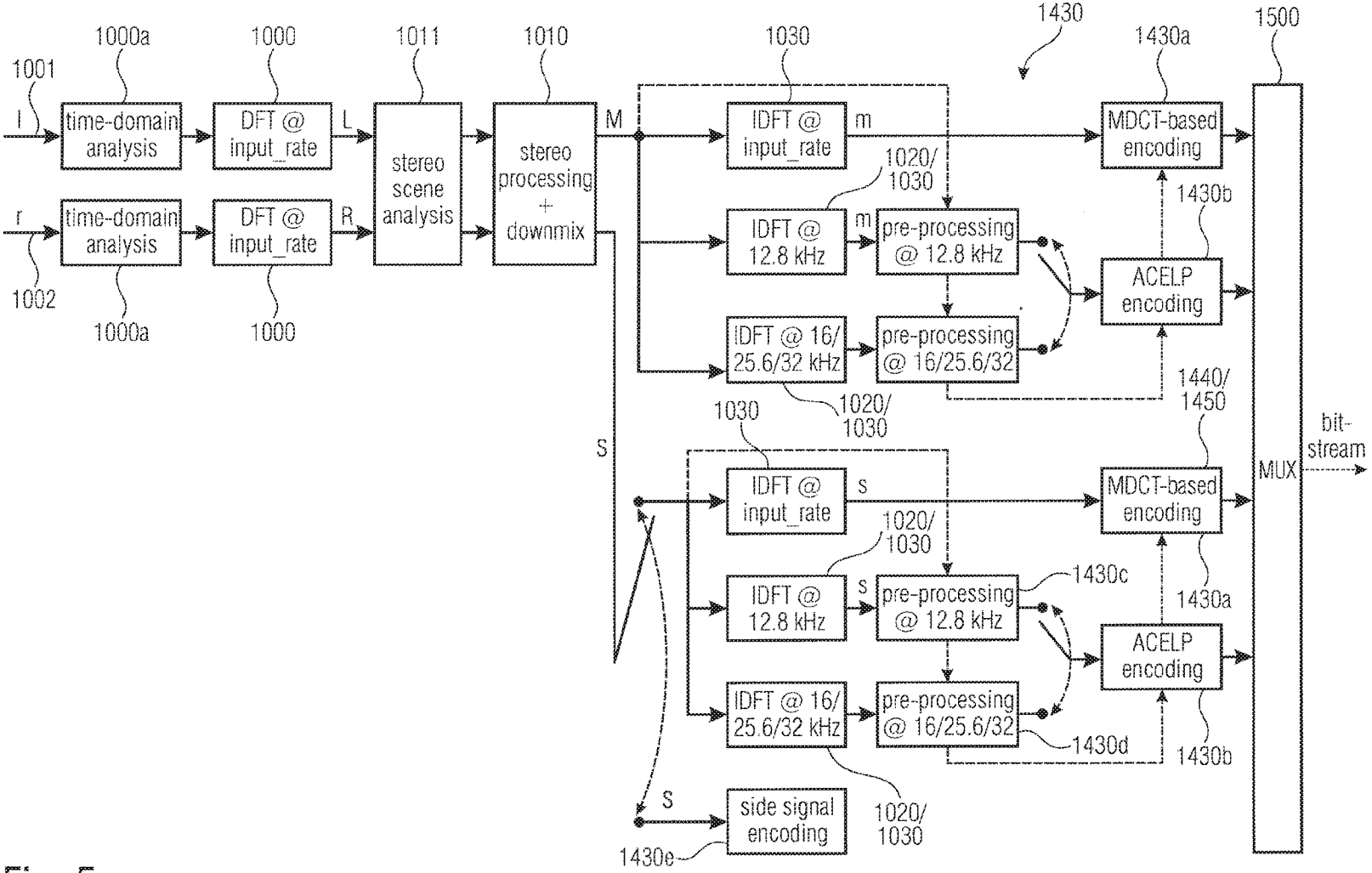
FIG. 5 illustrates an advantageous embodiment of a multi-channel encoder.

In FIG. 5, the stereo module takes as input the two input channel, l and r, and transform them in frequency domain to signals M and S. In the stereo processing the input channels can be eventually mapped or modified to generate two new signals M and S. M is coded further by the 3GPP standard EVS mono or a modified version of it. Such an encoder is a switched coder, switching between MDCT cores (TCX and HQ-Core in case of EVS) and a speech coder (ACELP in EVS). It also have a pre-processing functions running all the time at 12.8 kHz and other pre-processing functions running at sampling rate varying according to the operating modes (12.8, 16, 25.6 or 32 kHz). Moreover ACELP runs either at 12.8 or 16 kHz, while the MDCT cores run at the input sampling rate. The signal S can either by coded by a standard EVS mono encoder (or a modified version of it), or by a specific side signal encoder specially designed for its characteristics. It can be also possible to skip the coding of the Side signal S.

FIG. 5 illustrates advantageous stereo encoder details with a multi-rate synthesis filter-bank of the stereo-processed signals M and S. FIG. 5 shows the time-spectral converter 1000 that performs a time frequency transform at the input rate, i.e., the rate that the signals 1001 and 1002 have. Explicitly, FIG. 5 additionally illustrates a time-domain analysis block 1000*a*, 1000*e*, for each channel. Particularly, although FIG. 5 illustrates an explicit time-domain analysis block, i.e., a windower for applying an analysis window to the corresponding channel, it is to be noted that at other places in this specification, the windower for applying the time-domain analysis block is thought to be included in a block indicated as "time-spectral converter" or "DFT" at some sampling rate. Furthermore, and correspondingly, the mentioning of a spectral-time converter typically includes, at the output of the actual DFT algorithm, a windower for applying a corresponding synthesis window where, in order to finally obtain output samples, an overlap-add of blocks of sampling values windowed with a corresponding synthesis window is performed. Therefore, even though, for example, block 1030 only mentions an "IDFT" this block typically also denotes a subsequent windowing of a block of time-domain samples with an analysis window and again, a subsequent overlap-add operation in order to finally obtain the time-domain m signal.

Furthermore, FIG. 5 illustrates a specific stereo scene analysis block 1011 that performs the parameters used in block 1010 to perform the stereo processing and downmix, and these parameters can, for example, be the parameters on lines 1422 or 1421 of FIG. 4*a*. Thus, block 1011 may correspond to block 1420 in FIG. 4*a* in the implementation, in which even the parameter analysis, i.e., the stereo scene analysis takes place in the spectral domain and, particularly, with the sequence of blocks of spectral values that are not resampled, but are at the maximum frequency corresponding to the input sampling rate.

Furthermore, the core decoder 1040 comprises an MDCT-based encoder branch 1430*a* and an ACELP encoding branch 1430*b*. Particularly, the mid coder for the Mid signals M and, the corresponding side coder for the Side signal s performs a switch coding between an MDCT-based encoding and an ACELP encoding where, typically, the core encoder additionally has a coding mode decider that typically operates on a certain look-ahead portion in order to determine whether a certain block or frame is to be encoded using MDCT-based procedures or ACELP-based procedures. Furthermore, or alternatively, the core encoder is configured to use the look-ahead portion in order to determine other characteristics such as LPC parameters, etc.

Furthermore, the core encoder additionally comprises preprocessing stages at different sampling rates such as a first preprocessing stage 1430*c* operating at 12.8 kHz and a further preprocessing stage 1430*d* operating at sampling rates of the group of sampling rates consisting of 16 kHz, 25.6 kHz or 32 kHz.

Therefore, generally, the embodiment illustrated in FIG. 5 is configured to have a spectral domain resampler for resampling, from the input rate, which can be 8 kHz, 16 kHz or 32 kHz into anyone of the output rates being different from 8, 16 or 32.

Furthermore, the embodiment in FIG. 5 is additionally configured to have an additional branch that is not resampled, i.e., the branch illustrated by "IDFT at input rate" for the Mid signal and, optionally, for the Side signal.

Furthermore, the encoder in FIG. 5 advantageously comprises a resampler that not only resamples to a first output sampling rate, but also to a second output sampling rate in order to have data for both, the preprocessors 1430*c* and 1430*d* that can, for example, be operative to perform some kind of filtering, some kind of LPC calculation or some kind of other signal processing that is advantageously disclosed in the 3GPP standard for the EVS encoder already mentioned in the context of FIG. 4*a*.

Figure 6:
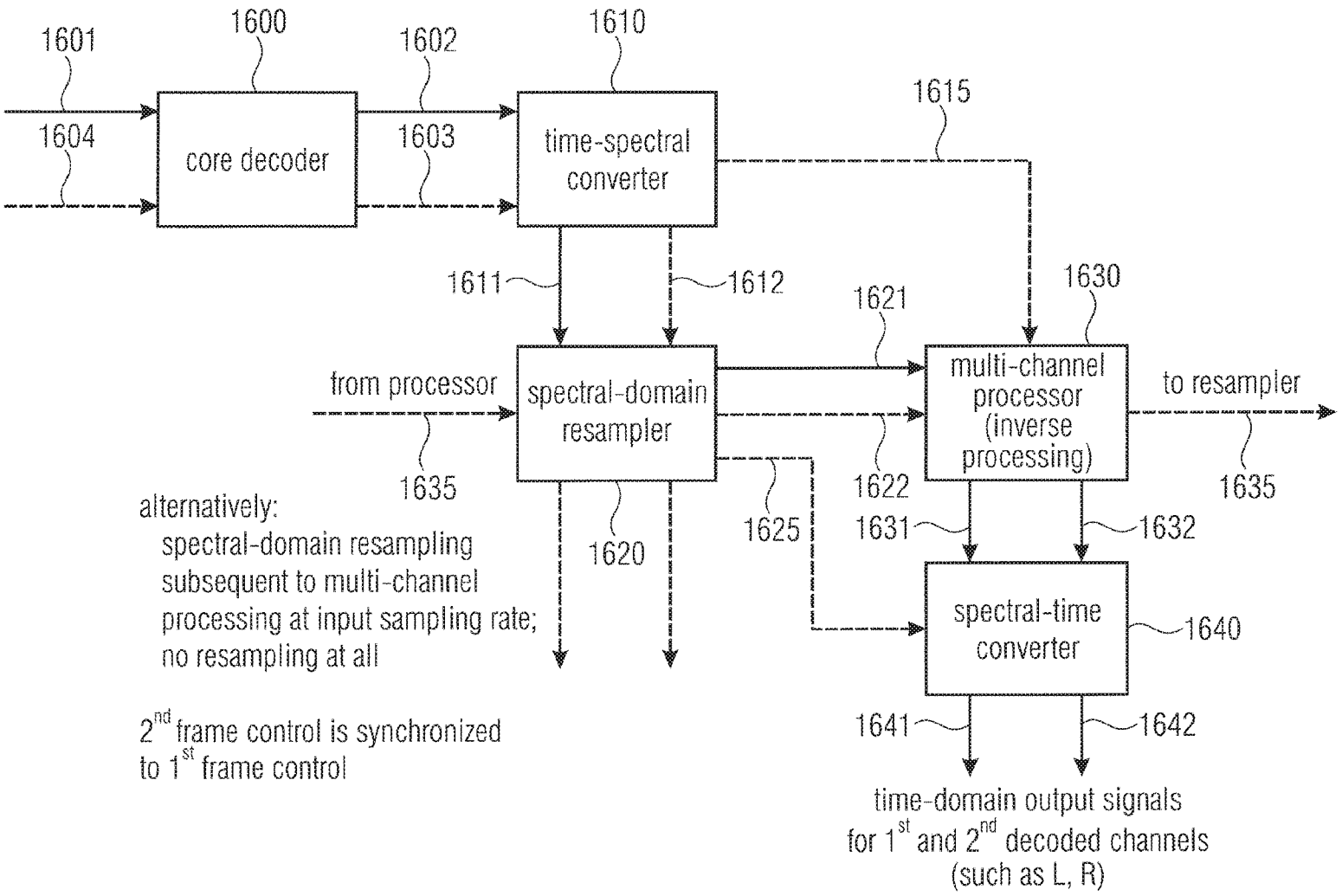
FIG. 6 illustrates a block diagram of an embodiment of a multi-channel decoder.

FIG. 6 illustrates an embodiment for an apparatus for decoding an encoded multi-channel signal 1601. The apparatus for decoding comprises a core decoder 1600, a time-spectral converter 1610, an optional spectral domain resampler 1620, a multi-channel processor 1630 and a spectral-time converter 1640.

The core decoder 1600 is configured to operate in accordance with a first frame control to provide a sequence of frames, wherein a frame is bounded by a start frame border 1901 and an end frame border 1902. The time-spectral converter 1610 or the spectral-time converter 1640 is configured to operate in accordance with a second frame control being synchronized to the first frame control. The time-spectral converter 1610 or the spectral-time converter 1640 are configured to operate in accordance with a second frame control being synchronized to the first frame control, wherein the start frame border 1901 or the end frame border 1902 of each frame of the sequence of frames is in a predetermined relation to a start instant or an end instant of an overlapping portion of a window used by the time-spectral converter 1610 for each block of the sequence of blocks of sampling values or used by the spectral-time converter 1640 for each block of the at least two output sequences of blocks of sampling values.

Again, the invention with respect to the apparatus for decoding the encoded multi-channel signal 1601 can be implemented in several alternatives. One alternative is that the spectral domain resampler is not used at all. Another alternative is that a resampler is used and is configured to resample the core-decoded signal in the spectral domain before performing the multi-channel processing. This alternative is illustrated by the solid lines in FIG. 6. However, the further alternative is that the spectral domain resampling is performed subsequent to the multi-channel processing, i.e., the multi-channel processing takes place at the input sampling rate. This embodiment is illustrated in FIG. 6 by the broken lines. If used, the spectral domain resampler 1620 performs the resampling operation in the frequency domain on data input into the spectral-time converter 1640 or on data input into the multi-channel processor 1630, wherein a block of a resampled sequence has spectral values up to a maximum output frequency being different from the maximum input frequency.

Particularly, in the first embodiment, i.e., where the spectral domain resampling is performed in the spectral domain before the multi-channel processing, the core decoded signal representing a sequence of blocks of sampling values is converted into a frequency domain representation having a sequence of blocks of spectral values for the core-decoded signal at line 1611.

Additionally, the core-decoded signal not only comprises the M signal at line 1602, but also a Side signal at line 1603, where a Side signal is illustrated at 1604 in a core-encoded representation.

Then, the time-spectral converter 1610 additionally generates a sequence of blocks of spectral values for the Side signal on line 1612.

Then, a spectral domain resampling is performed by block 1620, and the resampled sequence of blocks of spectral values with respect to the Mid signal or downmix channel or first channel is forwarded to the multi-channel processor at line 1621 and, optionally, also a resampled sequence of blocks of spectral values for the Side signal is also forwarded from the spectral domain resampler 1620 to the multi-channel processor 1630 via line 1622.

Then, the multi-channel processor 1630 performs an inverse multi-channel processing to a sequence comprising a sequence from the downmix signal and, optionally, from the Side signal illustrated at lines 1621 and 1622 in order to output at least two result sequences of blocks of spectral values illustrated at 1631 and 1632. These at least two sequences are then converted into the time-domain using the spectral-time converter in order to output time-domain channel signals 1641 and 1642. In the other alternative, illustrated at line 1615, the time-spectral converter is configured to feed the core-decoded signal such as the Mid signal to the multi-channel processor. Additionally, the time-spectral converter can also feed a decoded Side signal 1603 in its spectral-domain representation to the multi-channel processor 1630, although this option is not illustrated in FIG. 6. Then, the multi-channel processor performs the inverse processing and the output at least two channels are forwarded via connection line 1635 to the spectral-domain resampler that then forwards the resampled at these two channels via line 1625 to the spectral-time converter 1640.

Thus, a little bit in analogy as to what has been discussed in the context of FIG. 1, the apparatus for decoding an encoded multi-channel signal also comprises two alternatives, i.e., where the spectral domain resampling is performed before inverse multi-channel processing or, alternatively, where the spectral domain resampling is performed subsequent to the multi-channel processing at the input sampling rate. Advantageously, however, the first alternative is performed since it allows an advantageous alignment of the different signal contributions illustrated in FIG. 7*a* and FIG. 7*b*.

Figure 7A:
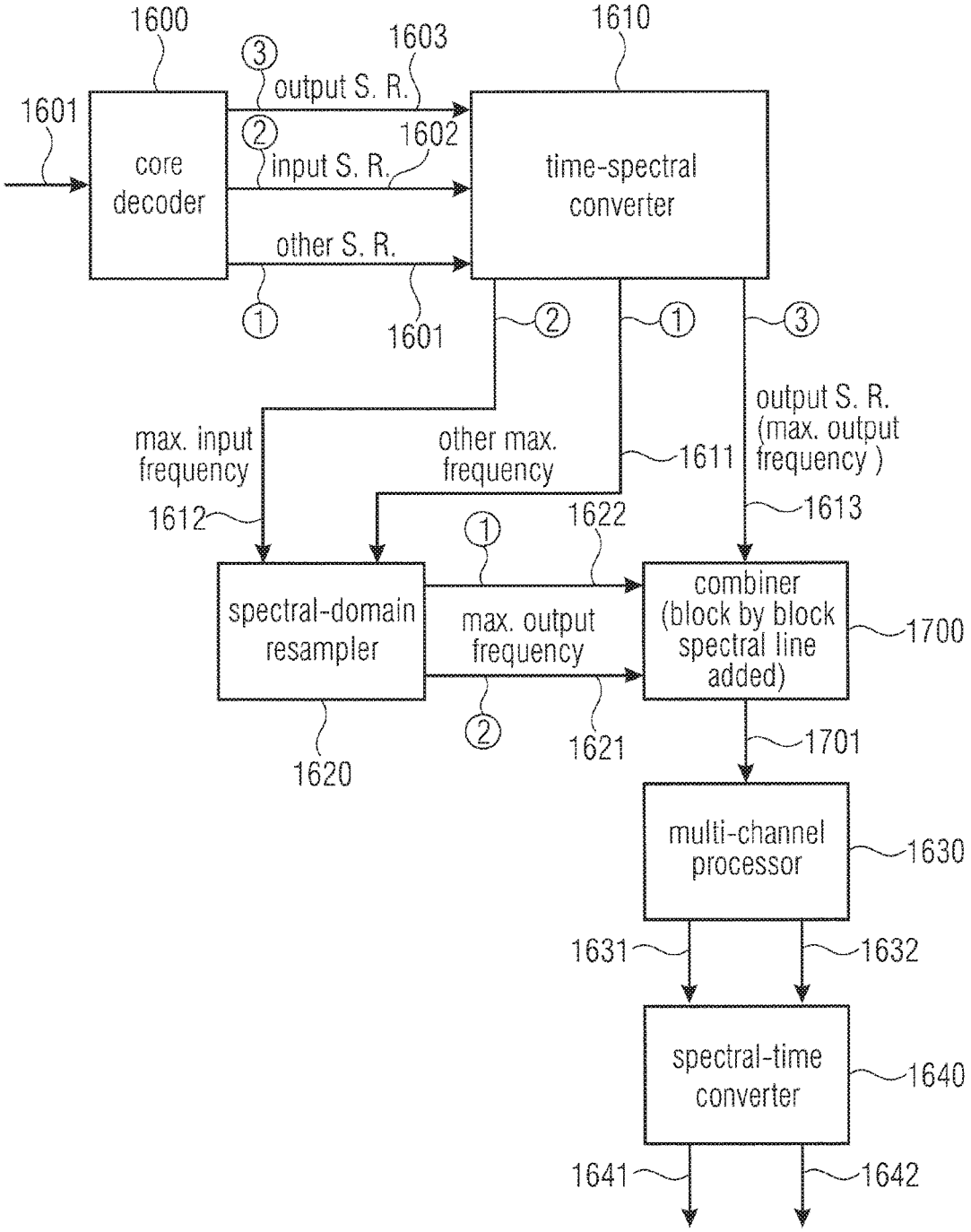
FIG. 7*a* illustrates a further embodiment of a multi-channel decoder comprising a combiner.

Again, FIG. 7*a* illustrates the core decoder 1600 that, however, outputs three different output signals, i.e., first output signal 1601 at a different sampling rate with respect to the output sampling rate, a second core decoded signal 1602 at the input sampling rate, i.e., the sampling rate underlying the core encoded signal 1601 and the core decoder additionally generates a third output signal 1603 operable and available at the output sampling rate, i.e., the sampling rate finally intended at the output of the spectral-time converter 1640 in FIG. 7*a*.

All three core decoded signals are input into the time-spectral converter 1610 that generates three different sequences of blocks of spectral values 1613, 1611 and 1612.

The sequence of blocks of spectral values 1613 has frequency or spectral values up to the maximum output frequency and, therefore, is associated with the output sampling rate.

The sequence of blocks of spectral values 1611 has spectral values up to a different maximum frequency and, therefore, this signal does not correspond to the output sampling rate.

Furthermore, the signal 1612 spectral values up to the maximum input frequency that is also different from the maximum output frequency.

Thus, the sequences 1612 and 1611 are forwarded to the spectral domain resampler 1620 while the signal 1613 is not forwarded to the spectral domain resampler 1620, since this signal is already associated with the correct output sampling rate.

The spectral domain resampler 1620 forwards the resampled sequences of spectral values to a combiner 1700 that is configured to perform a block by block combination with spectral lines by spectral lines for signals that correspond in overlapping situations. Thus, there will typically be a cross-over region between a switch from an MDCT-based signal to an ACELP signal, and in this overlapping range, signal values exist and are combined with each other. When, however, this overlapping range is over, and a signal exists only in signal 1603 for example while signal 1602, for example, does not exist, then the combiner will not perform a block by block spectral line addition in this portion. When, however, a switch-over comes up later on, then a block by block, spectral line by spectral line addition will take place during this cross-over region.

Figure 7B:
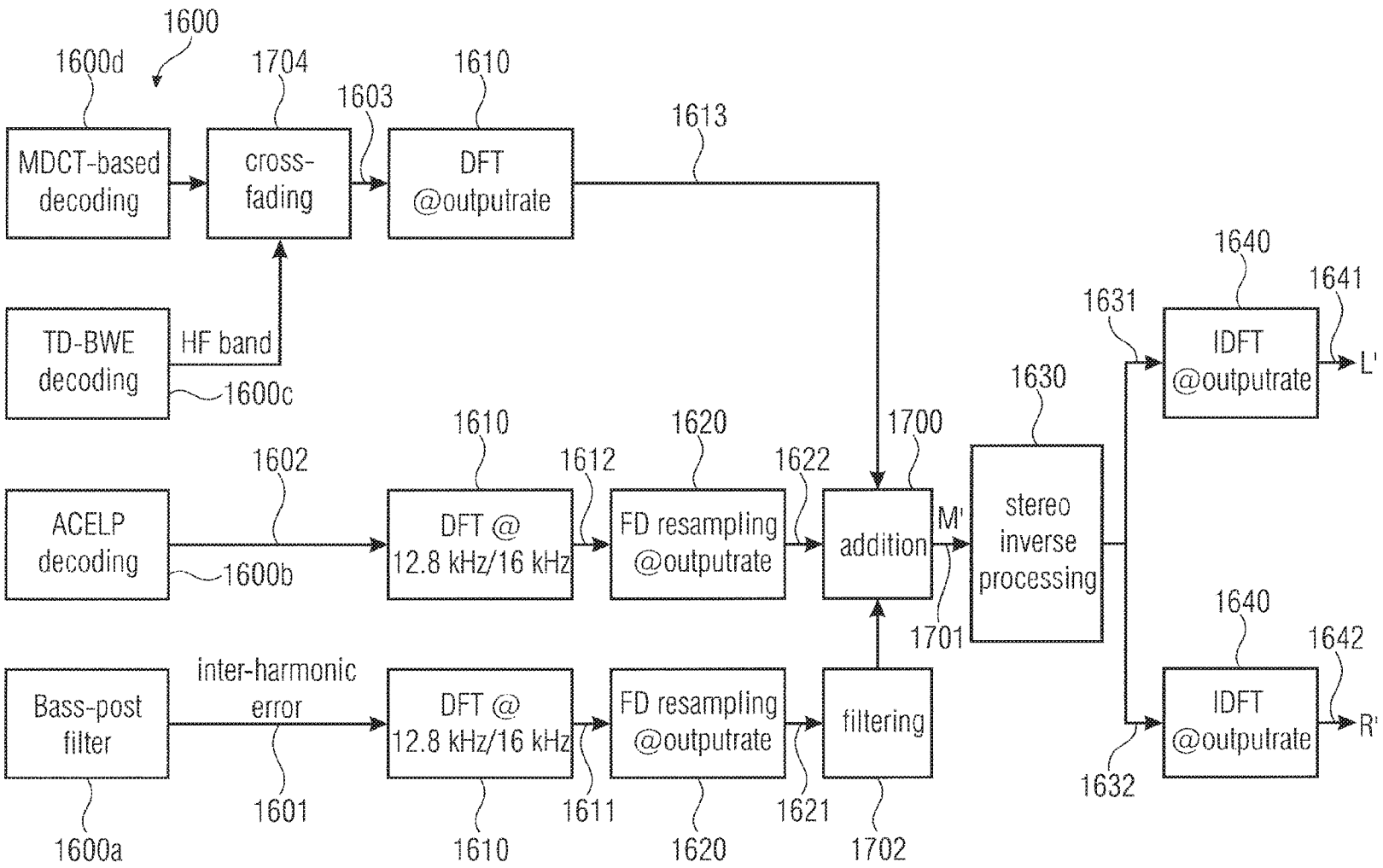
FIG. 7*b* illustrates a further embodiment of a multi-channel decoder additionally comprising the combiner (addition)

Furthermore, a continuous addition can also be possible as is illustrated in FIG. 7*b*, where a bass-post filter output signal illustrated at block 1600*a* is performed, that generates an inter-harmonic error signal that could, for example, be signal 1601 from FIG. 7*a*. Then, subsequent to a time-spectral conversion in block 1610, and the subsequent spectral domain resampling 1620 an additional filtering operation 1702 is advantageously performed before performing the addition in block 1700 in FIG. 7*b*.

Similarly, the MDCT-based decoding stage 1600*d* and the time-domain bandwidth extension decoding stage 1600*c* can be coupled via a cross-fading block 1704 in order to obtain the core decoded signal 1603 that is then converted into the spectral domain representation at the output sampling rate so that, for this signal 1613, and spectral domain resampling is not necessary, but the signal can be forwarded directly to the combiner 1700. The stereo inverse processing or multi-channel processing 1603 then takes place subsequent to the combiner 1700.

Thus, in contrast to the embodiment illustrated in FIG. 6, the multi-channel processor 1630 does not operate on the resampled sequence of spectral values, but operates on a sequence comprising the at least one resampled sequence of spectral values such as 1622 and 1621 where the sequence, on which the multi-channel processor 1630, operates, additionally comprises the sequence 1613 that was not necessary to be resampled.

As is illustrated in FIG. 7, the different decoded signals coming from different DFTs working at different sampling rates are already time aligned since the analysis windows at different sampling rates share the same shape. However the spectra show different sizes and scaling. For harmonizing them and making them compatible all spectra are resampled in frequency domain at the desired output sampling rate before being adding to each other.

Thus, FIG. 7 illustrates the combination of different contributions of a synthesized signal in the DFT domain, where the spectral domain resampling is performed in such a way that, in the end, all signals to be added by the combiner 1700 are already available with spectral values extending up to the maximum output frequency that corresponds to the output sampling rate, i.e., is lower than or equal to the half the output sampling rate which is then obtained at the output of the spectral time converter 1640.

The choice of the stereo filter-bank is crucial for a low-delay system and the achievable trade-off is summarized in FIG. 8*b*. It can employ either a DFT (block transform) or a pseudo low delay QMF called CLDFB (filter-bank). Each proposal shows different delay, time and frequency resolutions. For the system the best compromise between those characteristics has to be chosen. It is important to have a good frequency and time resolutions. That is the reason why using pseudo-QMF filter-bank as in proposal 3 can be problematic. The frequency resolution is low. It can be enhanced by hybrid approaches as in MPS 212 of MPEG-USAC, but it has the drawback to increase significantly both the complexity and the delay. Another important point is the delay available at the decoder side between the core decoder and the inverse stereo processing. Bigger is this delay, better it is. The proposal 2 for example can't provide such a delay, and is for this reason not a valuable solution. For these above mentioned reasons, we will focus in the rest of the description to proposals 1, 4 and 5.

The analysis and synthesis window of the filter-bank is another important aspect. In the advantageous embodiment the same window is used for the analysis and synthesis of the DFT. It is also the same at encoder and decoder sides. It was paid special attention for fulfilling the following constraints:

- Overlapping region has to be equal or smaller than overlapping region of MDCT core and ACELP look-ahead. In the advantageous embodiment all sizes are equal to 8.75 ms
- Zero padding should be at least of about 2.5 ms for allowing applying a linear shift of the channels in the DFT domain.
- Window size, overlapping region size and zero padding size may be expressing in integer number of samples for different sampling rate: 12.8, 16, 25.6, 32 and 48 kHz
- DFT complexity should be as low as possible, i.e. the maximum radix of the DFT in a split-radix FFT implementation should be as low as possible.
- Time resolution is fixed to 10 ms.

Figure 8C:
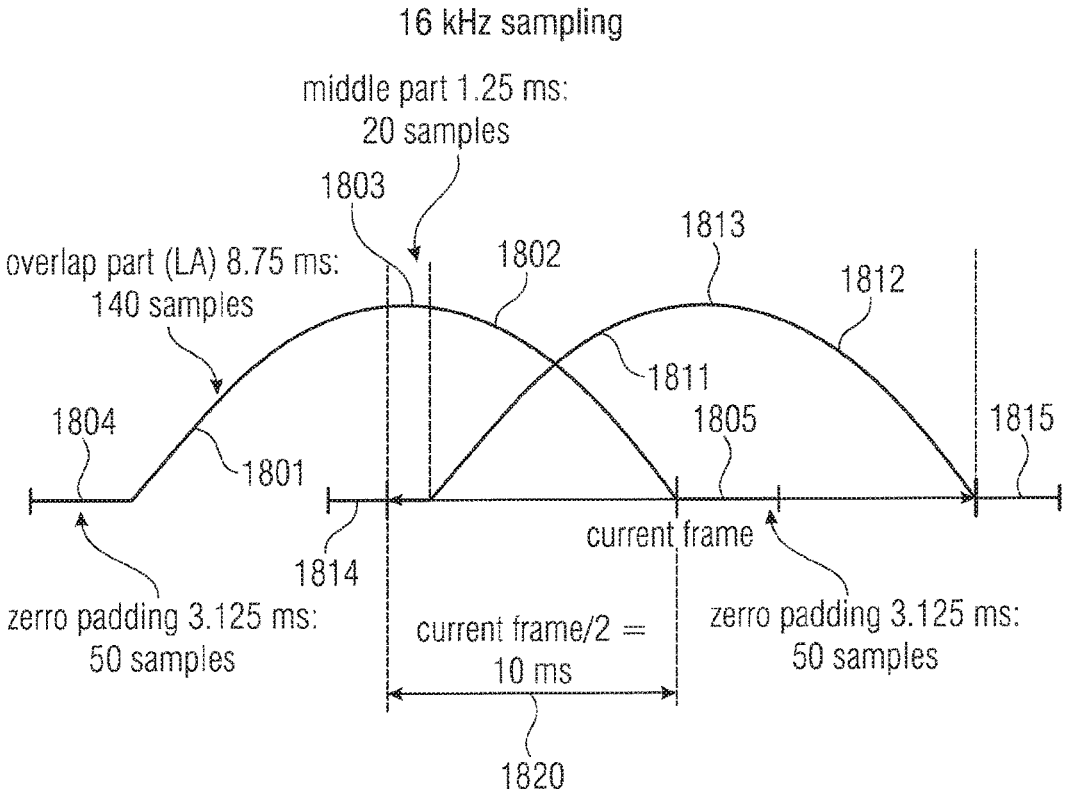
FIG. 8*c* illustrates a sequence of two analysis windows of a DFT with a time resolution of 10 ms.

Knowing these constraints the windows for the proposal 1 and 4 are described in FIG. 8*c* and in FIG. 8*a*.

FIG. 8*c* illustrates a first window consisting of an initial overlapping portion 1801, a subsequent middle portion 1803 and terminal overlapping portion or a second overlapping portion 1802. Furthermore, the first overlapping portion

1801 and the second overlapping portion 1802 additionally have zero padding portion of 1804 at the beginning and 1805 at the end thereof.

Furthermore, FIG. 8*c* illustrates the procedure performed with respect to the framing of the time-spectral converter 1000 of FIG. 1 or alternatively, 1610 of FIG. 7*a*. The further analysis window consisting of elements 1811, i.e., a first overlapping portion, a middle non-overlapping part 1813 and a second overlapping portion 1812 is overlapped with the first window by 50%. The second window additionally has zero padding portions 1814 and 1815 at the beginning and end thereof. These zero overlapping portions may be used in order to be in the position to perform the broadband time alignment in the frequency domain.

Furthermore, the first overlapping portion 1811 of the second window starts at the end of the middle part 1803, i.e., the non-overlapping part of the first window, and the overlapping part of the second window, i.e., the non-overlapping part 1813 starts at the end of the second overlapping portion 1802 of the first window as illustrated.

When FIG. 8*c* is considered to represent an overlap-add operation on a spectral-time converter such as the spectral-time converter 1030 of FIG. 1 for the encoder or the spectral-time converter 1640 for the decoder, then the first window consisting of block 1801, 1802, 1803, 1805, 1804 corresponds to a synthesis window and the second window consisting of parts 1811, 1812, 1813, 1814, 1815 corresponds to the synthesis window for the next block. Then, the overlap between the window illustrates the overlapping portion, and the overlapping portion is illustrated at 1820, and the length of the overlapping portion is equal to the current frame divided by two and is, in the advantageous embodiment, equal to 10 ms. Furthermore, at the bottom of FIG. 8*c*, the analytic equation for calculating the ascending window coefficients within the overlap range 1801 or 1811 is illustrated as a sine function, and, correspondingly, the descending overlap size coefficients of the overlapping portion 1802 and 1812 are also illustrated as a sine function.

In advantageous embodiments, the same analysis and synthesis windows are used only for the decoder illustrated in FIG. 6, FIG. 7*a*, FIG. 7*b*. Thus, the time-spectral converter 1616 and the spectral-time converter 1640 use exactly the same windows as illustrated in FIG. 8*c*.

However, in certain embodiments particularly with respect to the subsequent proposal/embodiment 1, an analysis window being generally in line with FIG. 1*c* is used, but the window coefficients for the ascending or descending overlap portions is calculated using a square root of sine function, with the same argument in the sine function as in FIG. 8*c*. Correspondingly, the synthesis window is calculated using a sine to the power of 1.5 function, but again with the same argument of the sine function.

Furthermore, it is to be noted that due to the overlap-add operation, the multiplication of sine to the power 0.5 multiplied by sine to the power of 1.5 once again results in a sine to the power of 2 result that may be used in order to have an energy conservation situation.

The proposal 1 has as main characteristics that the overlapping region of the DFT has the same size and is aligned with the ACELP look-ahead and the MDCT core overlapping region. The encoder delay is then the same as for the ACELP/MDCT cores and the stereo doesn't introduce any additional delay et the encoder. In case of EVS and in case the multi-rate synthesis filter-bank approach as described in FIG. 5 is used, the stereo encoder delay is as low as 8.75 ms.

Figure 9A:
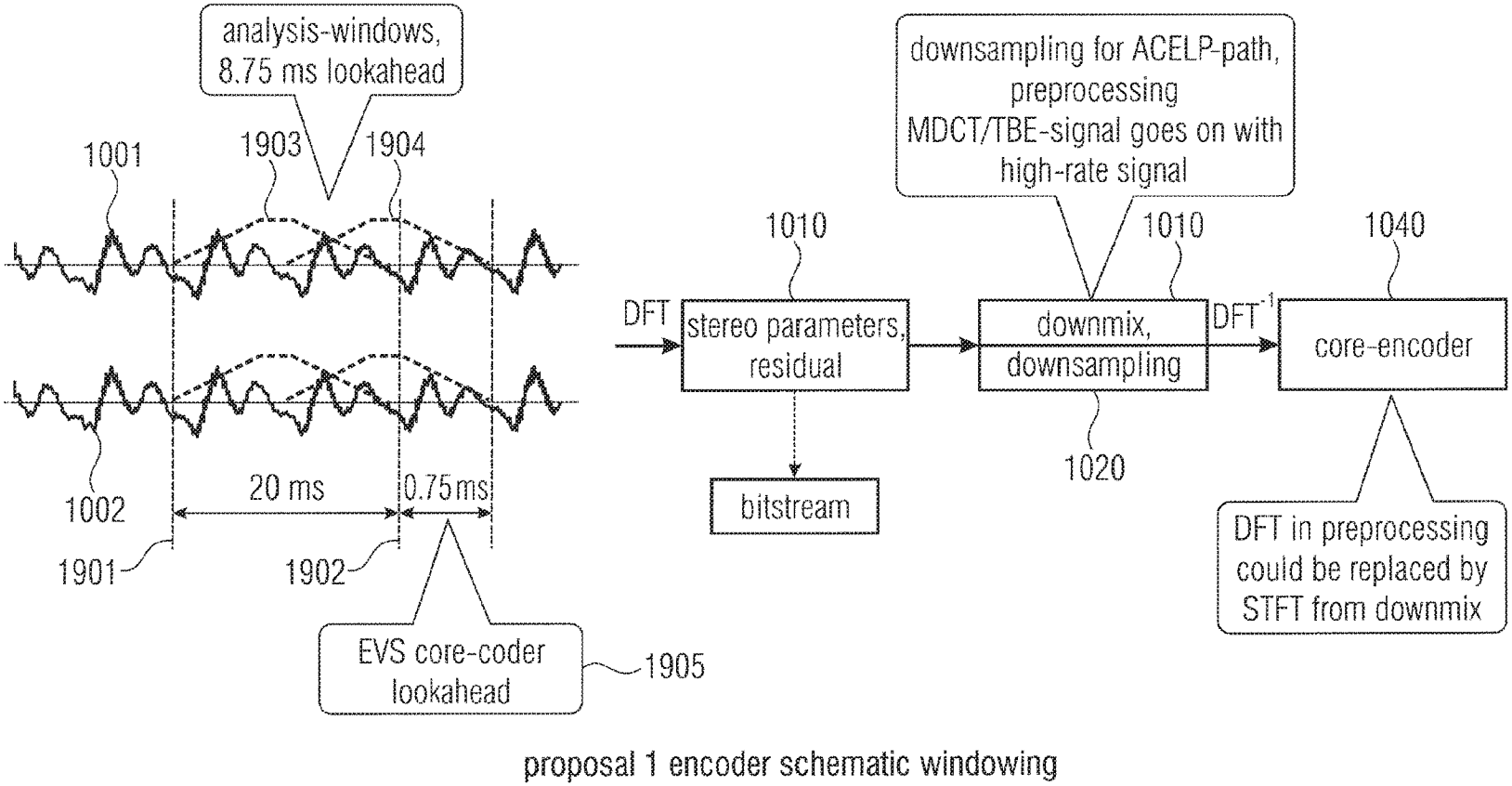
FIG. 9*a* illustrates an encoder schematic windowing in accordance with a first proposal/embodiment.
Figure 9B:
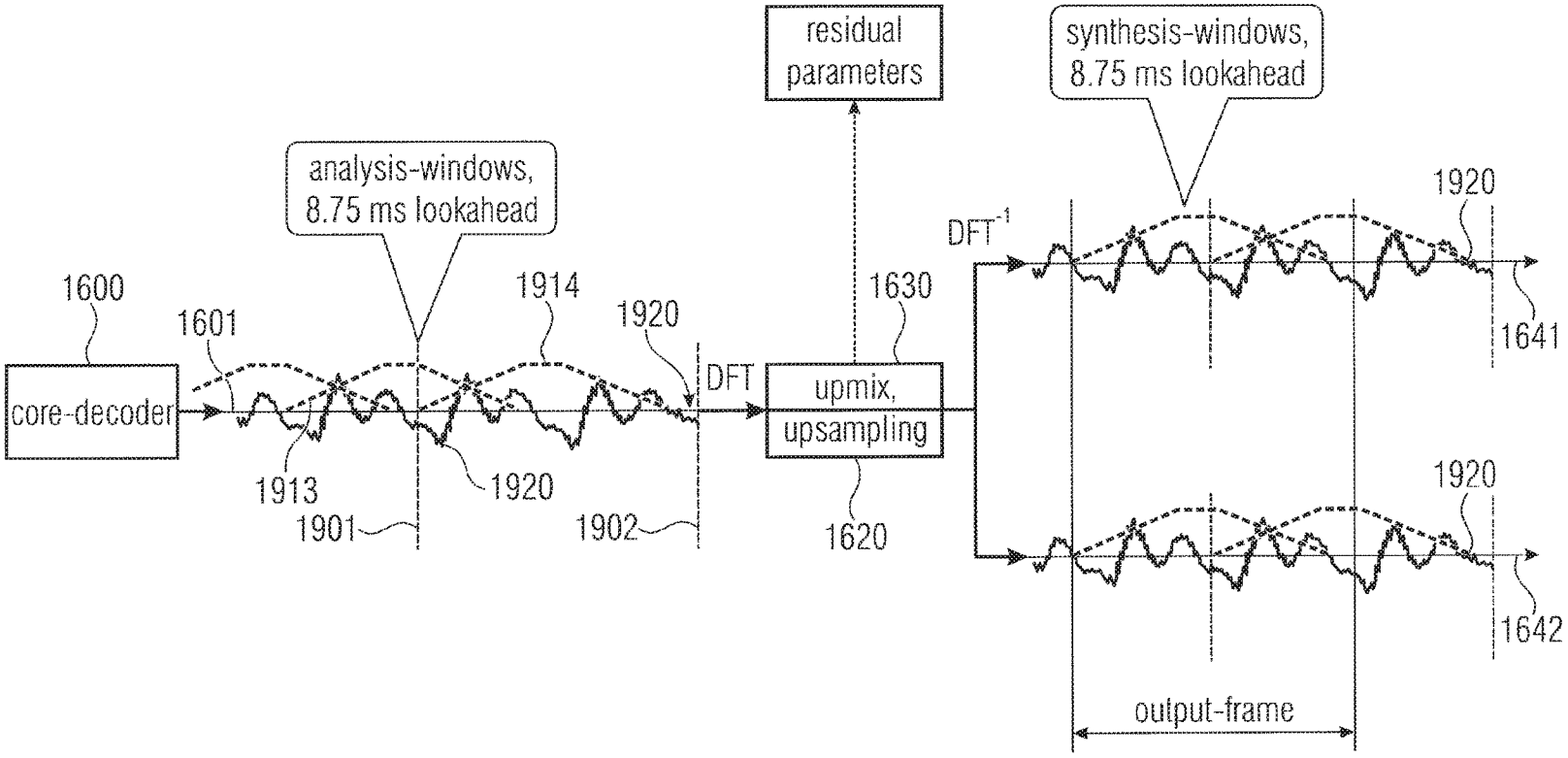
FIG. 9*b* illustrates a decoder schematic windowing in accordance with the first proposal/embodiment.
Figure 9C:
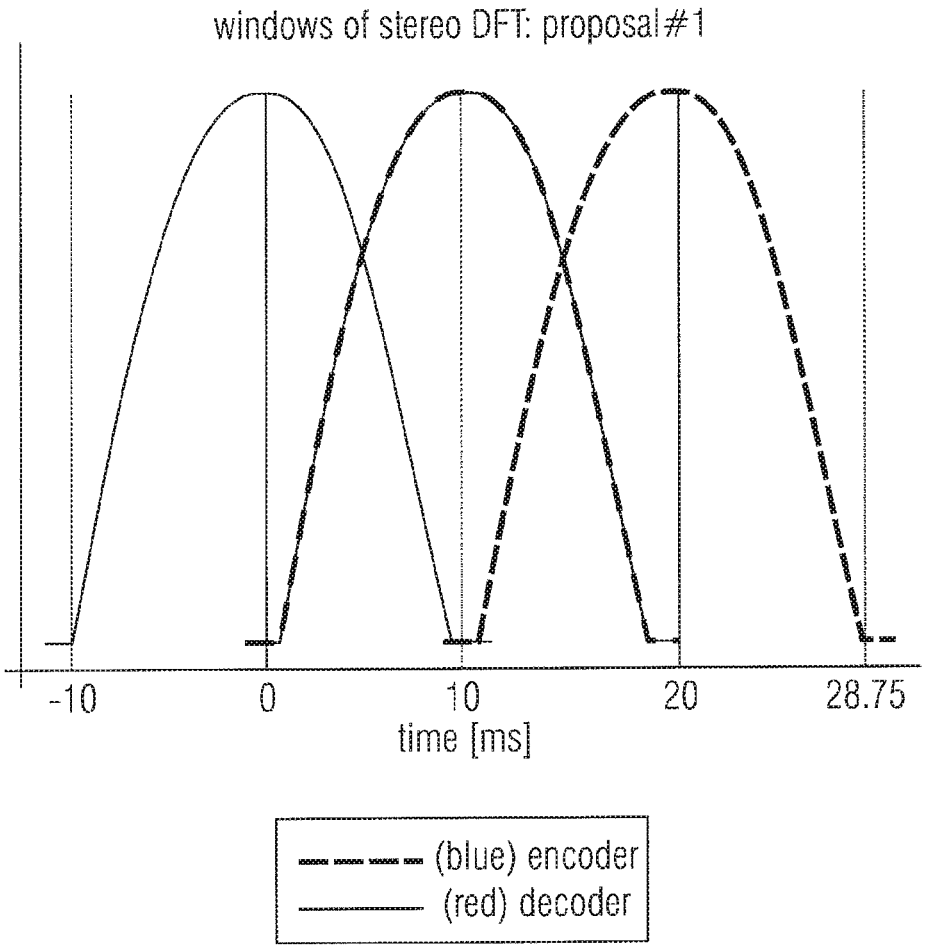
FIG. 9*c* illustrates the windows at the encoder and the decoder in accordance with the first proposal/embodiment.
Figure 9D:
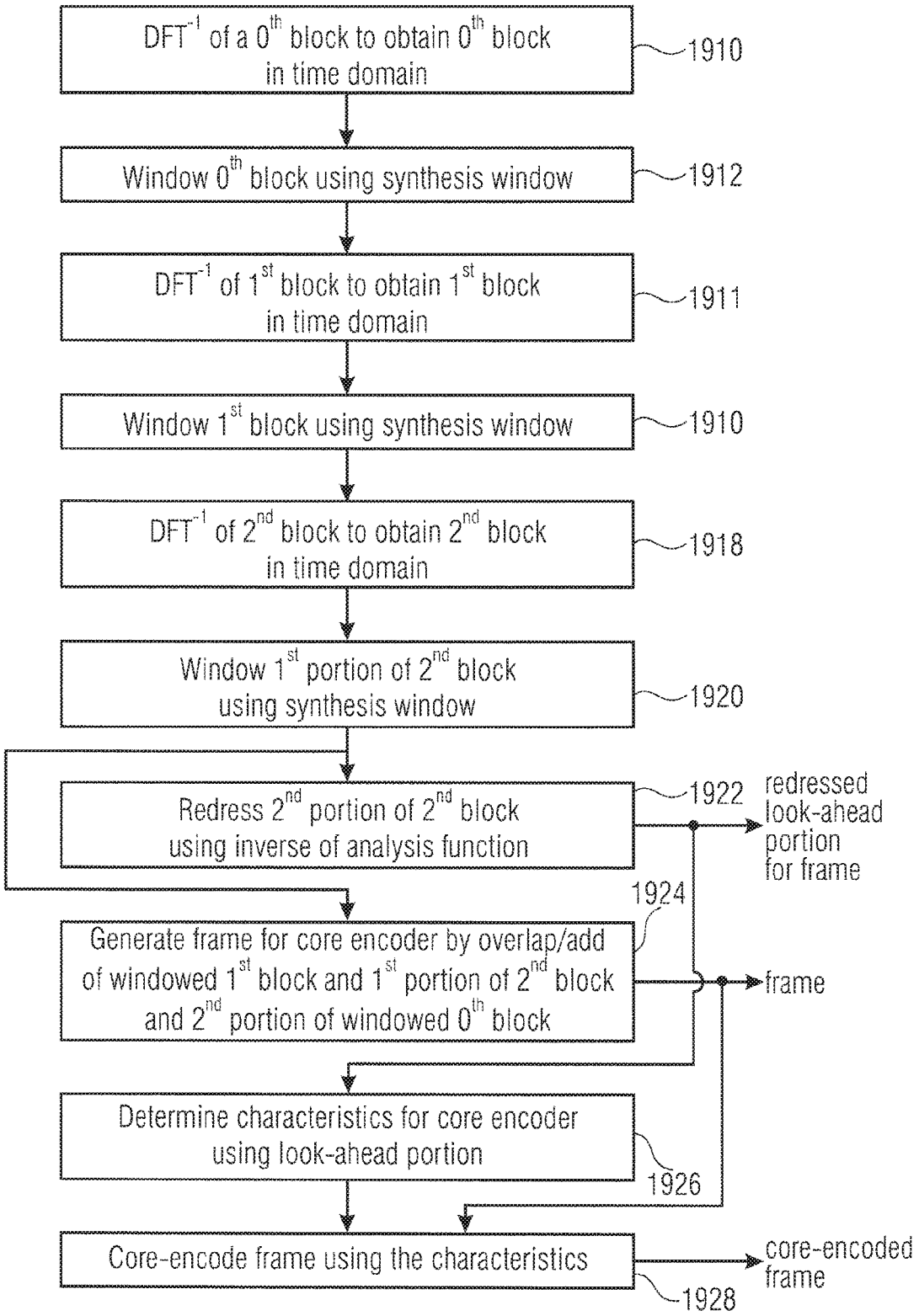
FIG. 9*d* illustrates an advantageous flowchart illustrating the redressing embodiment.
Figure 9E:
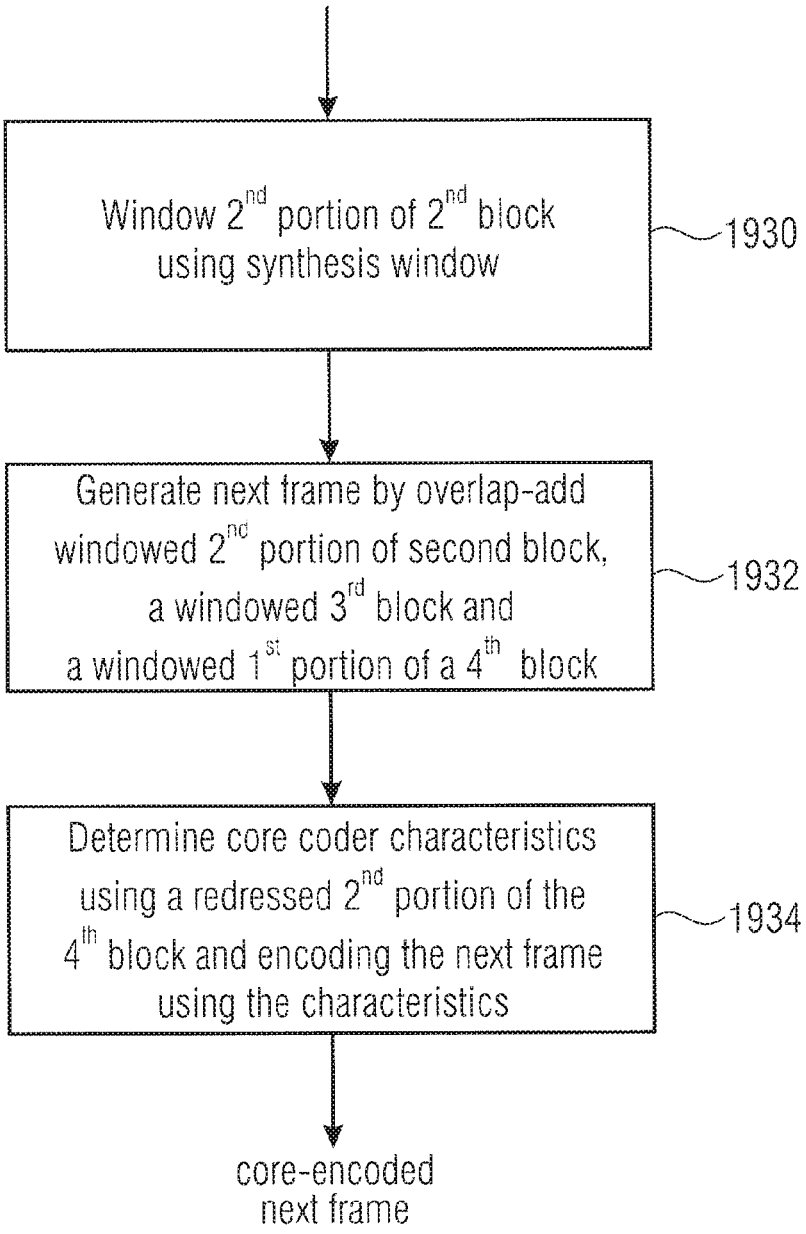
FIG. 9*e* illustrates a flowchart further illustrating the redress embodiment.

The encoder schematic framing is illustrated in FIG. 9*a* while the decoder is depicted in FIG. 9*e*. The windows are drawn in FIG. 9*c* in dashed blue for the encoder and in solid red for the decoder.

One major issue for proposal 1 is that the look-ahead at the encoder is windowed. It can be redressed for the subsequent processing, or it can be left windowed if the subsequent processing is adapted for taking into account a windowed look-ahead. It might be that if the stereo processing performed in the DFT modified the input channel, and especially when using non-linear operations, that the redressed or windowed signal doesn't allow to achieve a perfect reconstruction in case the core coding is bypassed.

It is worth noting that between the core decoder synthesis and the stereo decoder analysis windows there is a time gap of 1.25 ms which can be exploited by the core decoder post-processing, by the bandwidth extension (BWE), like Time Domain BWE used over ACELP, or by the some smoothing in case of transition between ACELP and MDCT cores.

Since this time gap of only 1.25 ms is lower than the 2.3125 ms that may be used by the standard EVS for such operations, the present invention provides a way to combine, resample and smooth the different synthesis parts of the switched decoder within the DFT domain of the stereo module.

As illustrated in FIG. 9*a*, the core encoder 1040 is configured to operate in accordance with a framing control to provide a sequence of frames, wherein a frame is bounded by a start frame border 1901 and an end frame border 1902. Furthermore, the time-spectral converter 1000 and/or the spectral-time converter 1030 are also configured to operate in accordance with second framing control being synchronized to the first framing control. The framing control is illustrated by two overlapping windows 1903 and 1904 for the time-spectral converter 1000 in the encoder, and, particularly, for the first channel 1001 and the second channel 1002 that are processed concurrently and fully synchronized. Furthermore, the framing control is also visible on the decoder-side, specifically, with two overlapping windows for the time-spectral converter 1610 of FIG. 6 that are illustrated at 1913 and 1914. These windows. 1913 and 1914 are applied to the core decoder signal that is advantageously, a single mono or downmix signal 1610 of FIG. 6, for example. Furthermore, as becomes clear from FIG. 9*a*, the synchronization between the framing control of the core encoder 1040 and the time-spectral converter 1000 or the spectral-time converter 1030 is so that the start frame border 1901 or the end frame border 1902 of each frame of the sequence of frames is in a predetermined relation to a start instance or and end instance of an overlapping portion of a window used by the time-spectral converter 1000 or the spectral-time converter 1030 for each block of the sequence of blocks of sampling values or for each block of the resampled sequence of blocks of spectral values. In the embodiment illustrated in FIG. 9*a*, the predetermined relation is such that the start of the first overlapping portion coincides with the start time border with respect to window 1903, and the start of the overlapping portion of the further window 1904 coincides with the end of the middle part such as part 1803 of FIG. 8*c*, for example. Thus, the end frame border 1902 coincides with the end of the middle part 1813 of FIG. 8*c*, when the second window in FIG. 8*c* corresponds to window 1904 in FIG. 9*a*.

Thus, it becomes clear that second overlapping portion such as 1812 of FIG. 8*c* of the second window 1904 in FIG.

9*a* extends over the end or stop frame border 1902, and, therefore, extends into core-coder look-ahead portion illustrated at 1905.

Thus, the core encoder 1040 is configured to use a look-ahead portion such as the look-ahead portion 1905 when core encoding the output block of the output sequence of blocks of sampling values, wherein the output look-ahead portion is located in time subsequent to the output block. The output block is corresponding to the frame bounded by the frame borders 1901, 1904 and the output look-ahead portion 1905 comes after this output block for the core encoder 1040.

Furthermore, as illustrated, the time-spectral converter is configured to use an analysis window, i.e., window 1904 having the overlap portion with a length in time being lower than or equal to the length in time of the look-ahead portion 1905, wherein this overlapping portion corresponding to overlapping 1812 of FIG. 8*c* that is located in the overlap range, is used for generating the windowed look-ahead portion.

Furthermore, the spectral-time converter 1030 is configured to process the output look-ahead portion corresponding to the windowed look-ahead portion advantageously using a redress function, wherein the redress function is configured so that an influence of the overlap portion of the analysis window is reduced or eliminated.

Thus, the spectral-time converter operating in between the core encoder 1040 and the downmix 1010/downsampling 1020 block in FIG. 9*a* is configured to apply a redress in function in order to undo the windowing applied by the window 1904 in FIG. 9*a*.

Thus, it is made sure that the core encoder 1040, when applying its look-ahead functionality to the look-ahead portion 1095, performs the look-ahead function not portion but to a portion that is close to the original portion as far as possible.

However, due to low-delay constraints, and due to the synchronization between the framing of the stereo preprocessor and the core encoder, an original time domain signal for the look-ahead portion does not exist. However, the application of the redressing function makes sure that any artifacts incurred by this procedure are reduced as much as possible.

A sequence of procedures with respect to this technology is illustrated in FIG. 9*d*, FIG. 9*e* in more detail.

In step 1910, a $DFT^{-1}$ of a zero$^{th}$ block is performed to obtain a zero$^{th}$ block in the time domain. The zero$^{th}$ block would have been obtained a window used to the left of window 1903 in FIG. 9*a*. This zero$^{th}$ block, however, is not explicitly illustrated in FIG. 9*a*.

Then, in step 1912, the zero$^{th}$ block is windowed using a synthesis window, i.e., is windowed in the spectral-time converter 1030 illustrated in FIG. 1.

Then, as illustrated in block 1911, a $DFT^{-1}$ of the first block obtained by window 1903 is performed to obtain a first block in the time domain, and this first block is once again windowed using the synthesis window in block 1910.

Then, as indicated at 1918 in FIG. 9*d*, an inverse DFT of the second block, i.e., the block obtained by window 1904 of FIG. 9*a*, is performed to obtain a second block in the time domain, and, then the first portion of the second block is windowed using the synthesis window as illustrated by 1920 of FIG. 9*d*. Importantly, however, the second portion of the second block obtained by item 1918 in FIG. 9*d* is not windowed using the synthesis window, but is redressed as illustrated in block 1922 of FIG. 9*d*, and, for the redressing function, the inverse of the analysis window function and, the corresponding overlapping portion of the analysis window function is used.

Thus, if the window used for generating the second block was a sine window illustrated in FIG. 8*c*, then 1/sin( ) for the descending overlap size coefficients of the equations to the bottom of FIG. 8*c* are used as the redressing function.

However, it is advantageous to use a square root of sine window for the analysis window and, therefore, the redressing function is a window function of $1/\sqrt{\sin()}$. This ensures that the redressed look-ahead portion obtained by block 1922 is as close as possible to the original signal within the look-ahead portion, but, of course, not the original left signal or the original right signal but the original signal that would have been obtained by adding left and right to obtain the Mid signal.

Then, in step 1924 in FIG. 9*d*, a frame indicated by the frame borders 1901,1902 is generated by performing an overlap-add operation in block 1030 so that the encoder has a time-domain signal, and this frame is performed by an overlap-add operation between the block corresponding to window 1903, and the preceding samples of the preceding block and using the first portion of the second block obtained by block 1920. Then, this frame output by block 1924 is forwarded to the core encoder 1040 and, additionally, the core coder additionally receives the redressed look-ahead portion for the frame and, as illustrated in step 1926, the core coder then can determine the characteristic for the core coder using the redressed look-ahead portion obtained by step 1922. Then, as illustrated in step 1928, the core encoder core-encodes the frame using the characteristic determined in block 1926 to finally obtain the core-encoded frame corresponding to the frame border 1901, 1902 that has, in the advantageous embodiment, a length of 20 ms.

Advantageously, the overlapping portion of the window 1904 extending into the look-ahead portion 1905 has the same length as the look-ahead portion, but it can also be shorter than the look-ahead portion but it is advantageous that it is not longer than the look-ahead portion so that the stereo preprocessor does not introduce any additional delay due to overlapping windows.

Then, the procedure goes on with the windowing of the second portion of the second block using the synthesis window as illustrated in block 1930. Thus, the second portion of the second block is, on the one hand, redressed by block 1922 and is, on the other hand, windowed by the synthesis window as illustrated in block 1930, since this portion may then be used for generating the next frame for the core encoder by overlap-add the windowed second portion of the second block, a windowed third block and a windowed first portion of the fourth block as illustrated in block 1932. Naturally, the fourth block and, particularly the second portion of the fourth block would once again be subjected to the redressing operation as discussed with respect to the second block in item 1922 of FIG. 9*d* and, then, the procedure would be once again repeated as discussed before. Furthermore, in step 1934, the core coder would determine the core coder characteristics using a redress the second portion of the fourth block and, then, the next frame would be encoded using the determined coding characteristics in order to finally obtain the core encoded next frame in block 1934. Thus, the alignment of the second overlapping portion of the analysis (in corresponding synthesis) window with the core coder look-ahead portion 1905 make sure that a very low-delay implementation can be obtained and that this advantage is due to the fact that the look-ahead portion as windowed is addressed by, on the one hand, performing the redressing operation and on the other hand by applying an analysis window not being equal to the synthesis window but applying a smaller influence, so that it can be made sure that the redressing function is more stable compared to the usage of the same analysis/synthesis window. However, in case the core encoder is modified to operate its look-ahead function that is typically used for determining core encoding characteristics on a windowed portion, it is not necessary to perform the redressing function. However, it has been found that the usage of the redressing function is advantageous over modifying the core encoder.

Furthermore, as discussed before, it is to be noted that there is a time gap between the end of a window, i.e., the analysis window 1914 and the end frame border 1902 of the frame defined by the start frame border 1901 and the end frame border 1902 of FIG. 9*b*.

Particularly, the time gap is illustrated at 1920 with respect to the analysis windows applied by the time-spectrum converter 1610 of FIG. 6, and this time gap is also visible 120 with respect to the first output channel 1641 and the second output channel 1642.

Figure 9F:
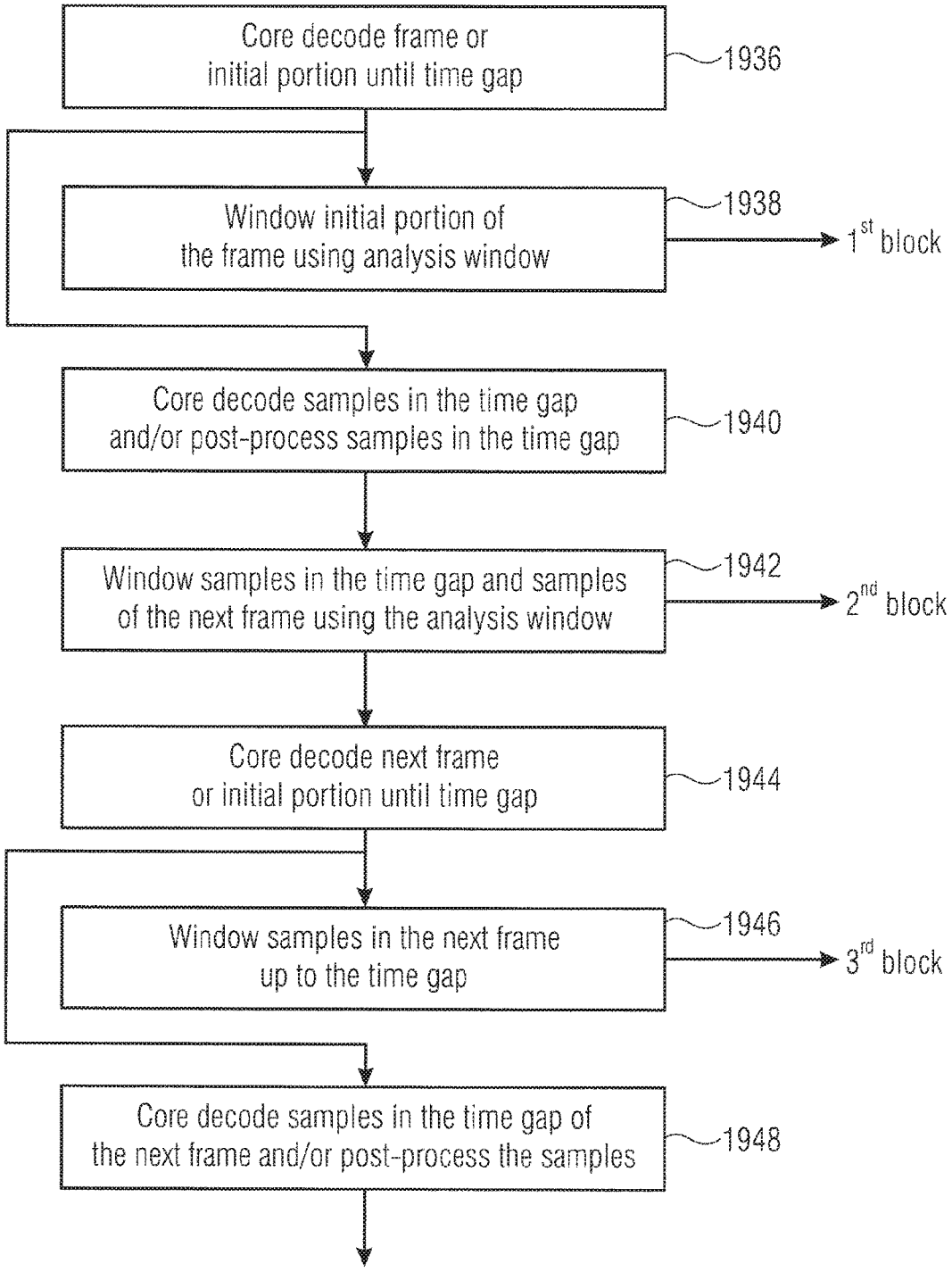
FIG. 9*f* illustrates a flowchart for explaining the time gap decoder-side embodiment.

FIG. 9*f* is showing a procedure of steps performed in the context of the time gap, the core decoder 1600 core-decodes the frame or at least the initial portion of the frame until the time gap 1920. Then, the time-spectrum converter 1610 of FIG. 6 is configured to apply an analysis window to the initial portion of the frame using the analysis window 1914 that does not extend until the end of the frame, i.e., until time instant 1902, but only extends until the start of the time gap 1920.

Thus, the core decoder has additional time in order to core decode the samples in the time gap and/or to post-process the samples in the time gap as illustrated at block 1940. Thus, the time-spectrum converter 1610 already outputs a first block as the result of step 1938 there the core decoder can provide the remaining samples in the time gap or can post-process the samples in the time gap at step 1940.

Then, in step 1942, the time-spectrum converter 1610 is configured to window the samples in the time gap together with samples of the next frame using a next analysis window that would occur subsequent to window 1914 in FIG. 9*b*. Then, as illustrated in step 1944, the core decoder 1600 is configured to decode the next frame or at least the initial portion of the next frame until the time gap 1920 occurring in the next frame. Then, in step 1946, the time-spectrum converter 1610 is configured to window the samples in the next frame up to the time gap 1920 of the next frame and, in step 1948, the core decoder could then core-decode the remaining samples in the time gap of the next frame and/or post-process these samples.

Thus, this time gap of, for example, 1.25 ms when the FIG. 9*b* embodiment is considered can be exploited by the core decoder post-processing, by the bandwidth extension, by, for example, a time-domain bandwidth extension used in the context of ACELP, or by some smoothing in case of a transmission transition between ACELP and MDCT core signals.

Thus, once again, the core decoder 1600 is configured to operate in accordance with a first framing control to provide a sequence of frames, wherein the time-spectrum converter 1610 or the spectrum-time converter 1640 are configured to operate in accordance with a second framing control being synchronized with the first framing control, so that the start frame border or the end frame border of each frame of the sequence of frames is in a predetermined relation to a start instant or an end instant of an overlapping portion of a window used by the time-spectrum converter or the spectrum-time converter for each block of the sequence of blocks of sampling values or for each block of the resampled sequence of blocks of spectral values.

Furthermore, the time-spectrum converter 1610 is configured to use an analysis window for windowing the frame of the sequence of frames having an overlapping range ending before the end frame border 1902 leaving a time gap 1920 between the end of the overlap portion and the end frame border. The core decoder 1600 is, therefore, configured to perform the processing to the samples in the time gap 1920 in parallel to the windowing of the frame using the analysis window or wherein a further post-processing the time gap is performed in parallel to the windowing of the frame using the analysis window by the time-spectral converter.

Furthermore, and advantageously, the analysis window for a following block of the core decoded signal is located so that a middle non-overlapping portion of the window is located within the time gap as illustrated at 1920 of FIG. 9*b*.

In proposal 4 the overall system delay is enlarged compared to proposal 1. At the encoder an extra delay is coming from the stereo module. The issue of perfect reconstruction is no more pertinent in proposal 4 unlike proposal 1.

At decoder, the available delay between core decoder and first DFT analysis is of 2.5 ms which allows performing conventional resampling, combination and smoothing between the different core syntheses and the extended bandwidth signals as it is done for in the standard EVS.

Figure 10A:
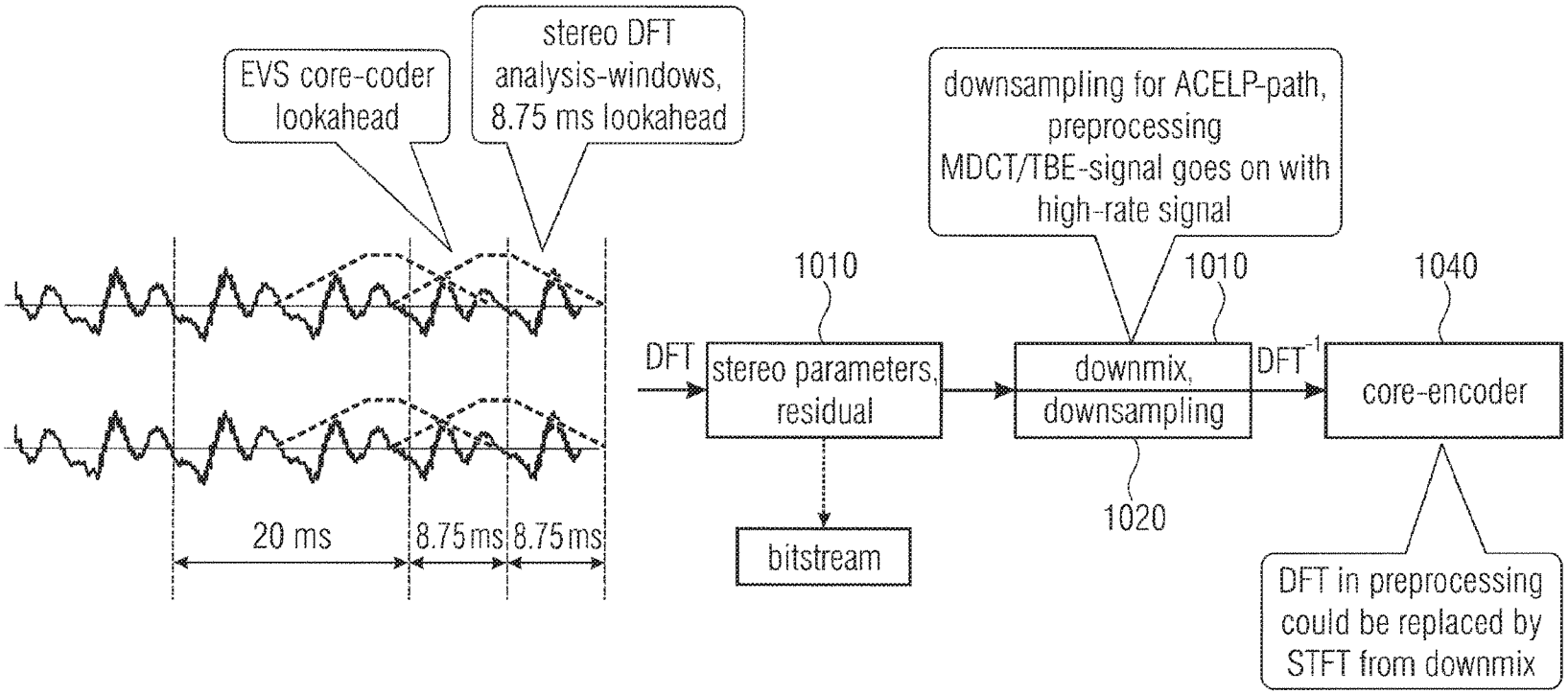
FIG. 10*a* illustrates an encoder schematic windowing in accordance with the fourth proposal/embodiment.
Figure 10B:
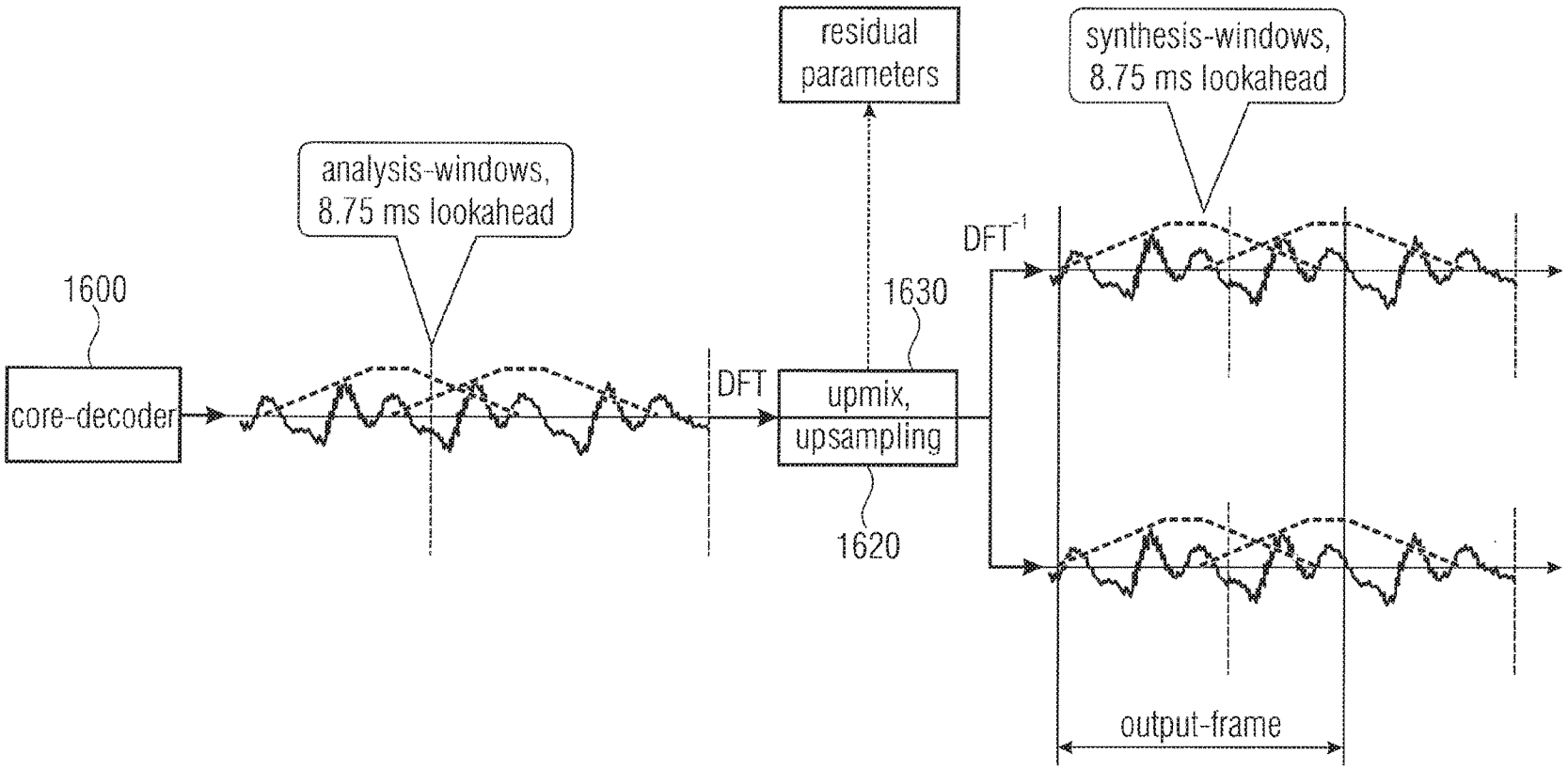
FIG. 10*b* illustrates a decoder schematic window in accordance with the fourth proposal/embodiment.
Figure 10C:
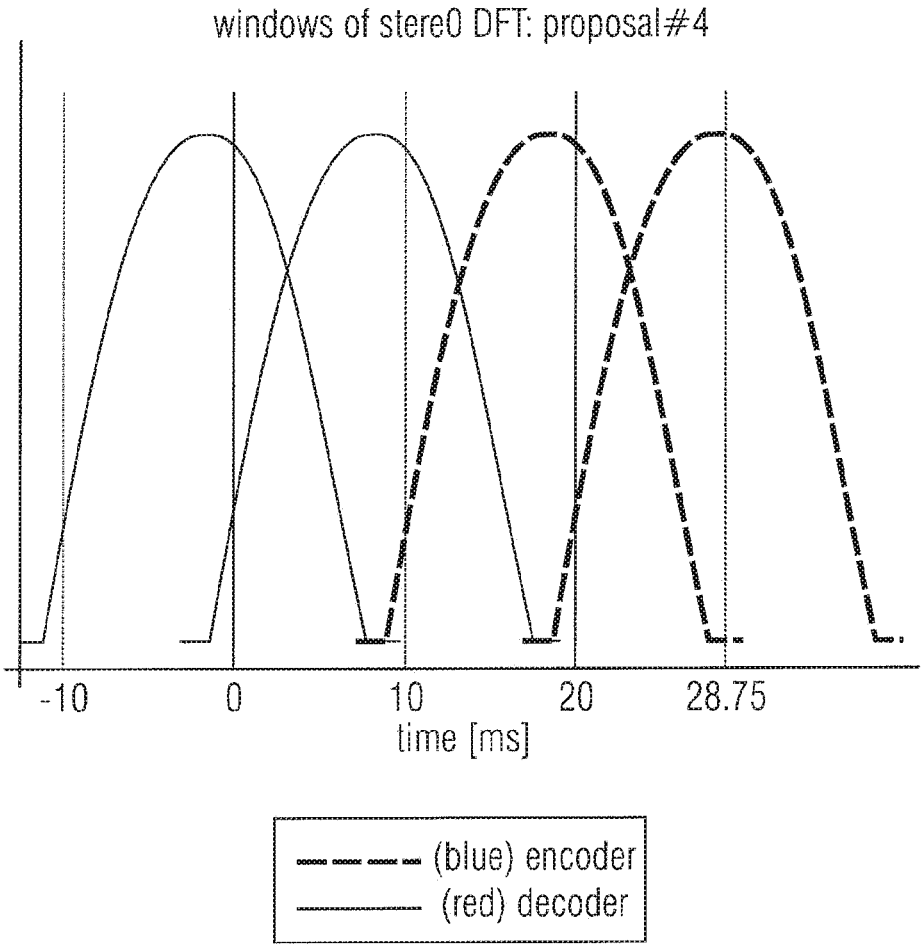
FIG. 10*c* illustrates windows at the encoder and the decoder in accordance with the fourth proposal/embodiment.

The encoder schematic framing is illustrated in FIG. 10*a* while the decoder is depicted in FIG. 10*b*. The windows are given in FIG. 10*c*.

In proposal 5, the time resolution of the DFT is decreased to 5 ms. The lookahead and overlapping region of core coder is not windowed, which is a shared advantage with proposal 4. On the other hand, the available delay between the coder decoding and the stereo analysis is small and a solution as proposed in Proposal 1 is needed (FIG. 7). The main disadvantages of this proposal is the low frequency resolution of the time-frequency decomposition and the small overlapping region reduced to 5 ms, which prevents a large time shift in frequency domain.

Figure 11A:
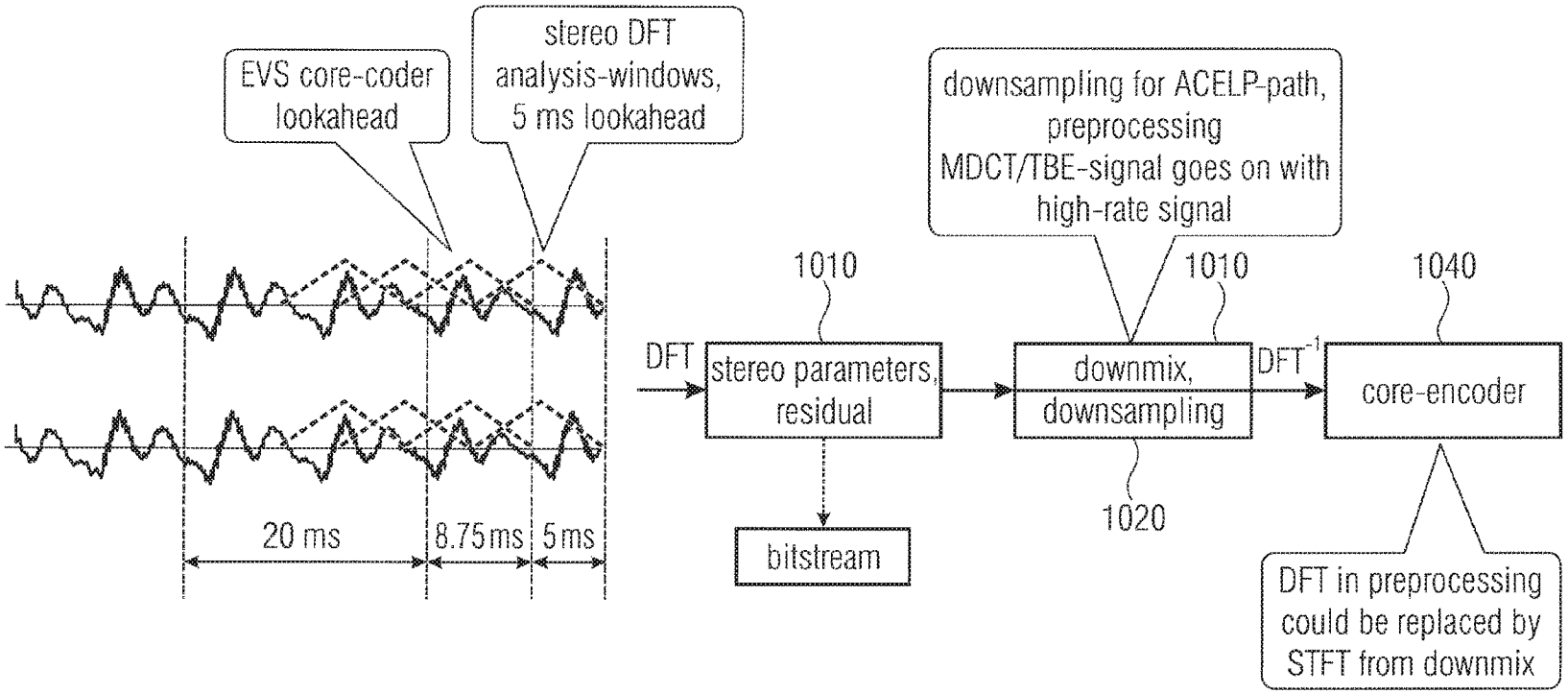
FIG. 11*a* illustrates an encoder schematic windowing in accordance with the fifth proposal/embodiment.
Figure 11B:
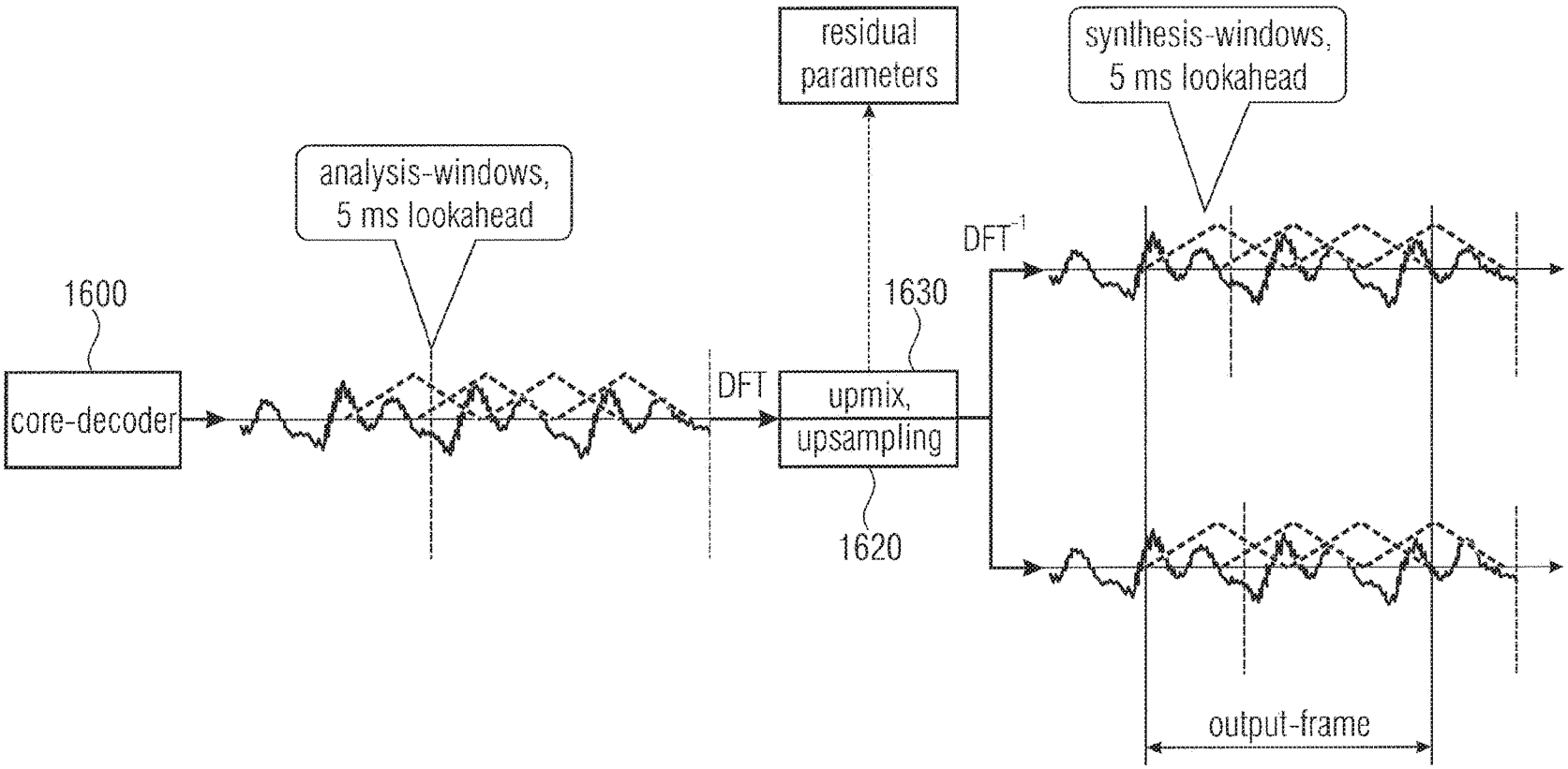
FIG. 11*b* illustrates a decoder schematic windowing in accordance with the fifth proposal/embodiment.
Figure 11C:
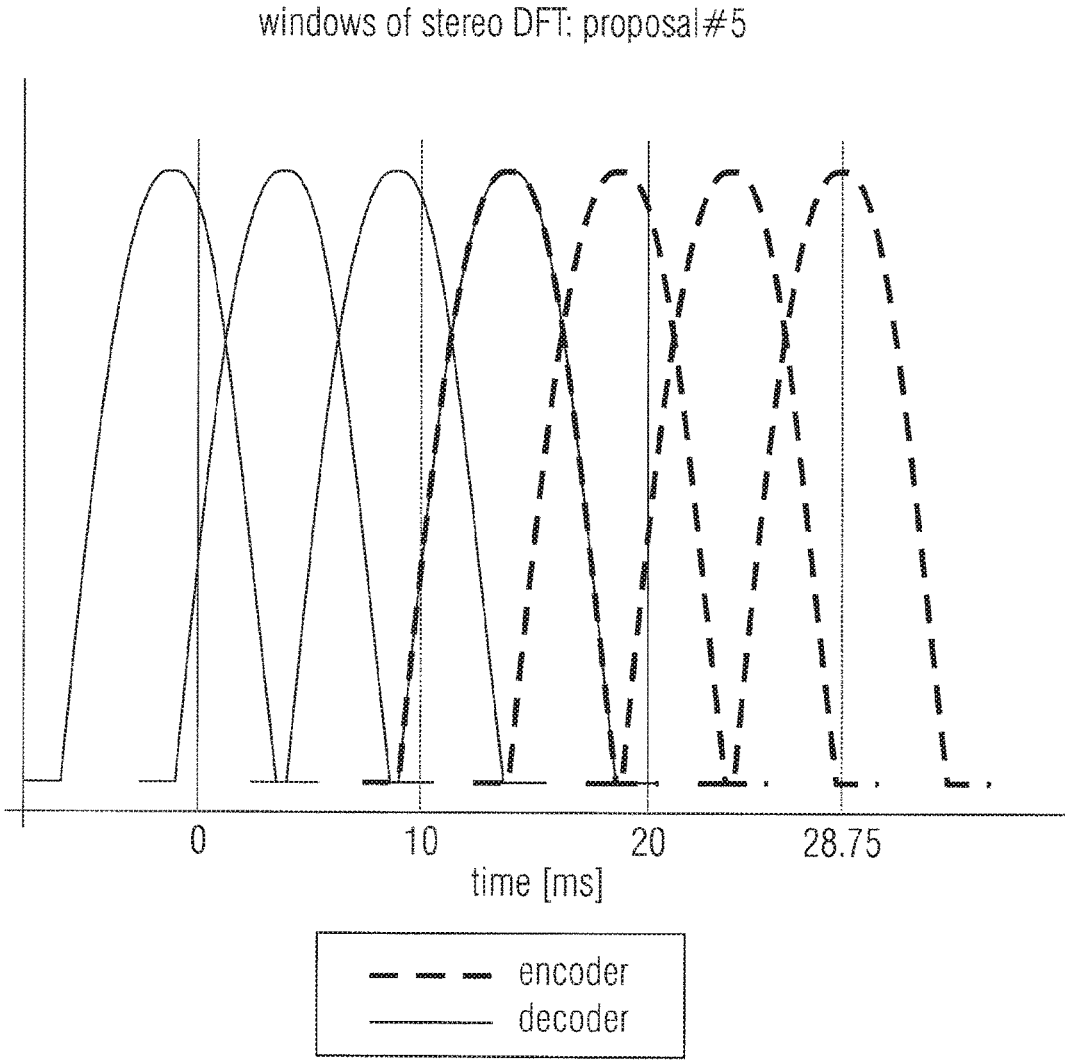
FIG. 11*c* illustrates windows at the encoder and the decoder in accordance with the fifth proposal/embodiment.

The encoder schematic framing is illustrated in FIG. 11*a* while the decoder is depicted in FIG. 11*b*. The windows are given in FIG. 11*c*.

In view of the above, advantageous embodiments relate, with respect to the encoder-side, to a multi-rate time-frequency synthesis which provides at least one stereo processed signal at different sampling rates to the subsequent processing modules. The module includes, for example, a speech encoder like ACELP, pre-processing tools, an MDCT-based audio encoder such as TCX or a bandwidth extension encoder such as a time-domain bandwidth extension encoder.

With respect to the decoder, the combination in resampling in the stereo frequency-domain with respect to different contributions of the decoder synthesis are performed. These synthesis signals can come from a speech decoder like an ACELP decoder, an MDCT-based decoder, a bandwidth extension module or an inter-harmonic error signal from a post-processing like a bass-post-filter.

Furthermore, regarding both the encoder and the decoder, it is useful to apply a window for the DFT or a complex value transformed with a zero padding, a low overlapping region and a hopsize which corresponds to an integer number of samples at different sampling rates such as 12.9 kHz, 16 kHz, 25.6 kHz, 32 kHz or 48 kHz.

Embodiments are able to achieve low bit-are coding of stereo audio at low delay. It was specifically designed to combine efficiently a low-delay switched audio coding scheme, like EVS, with the filter-banks of a stereo coding module.

Embodiments may find use in the distribution or broadcasting all types of stereo or multi-channel audio content (speech and music alike with constant perceptual quality at a given low bitrate) such as, for example with digital radio, Internet streaming and audio communication applications.

Figure 12:
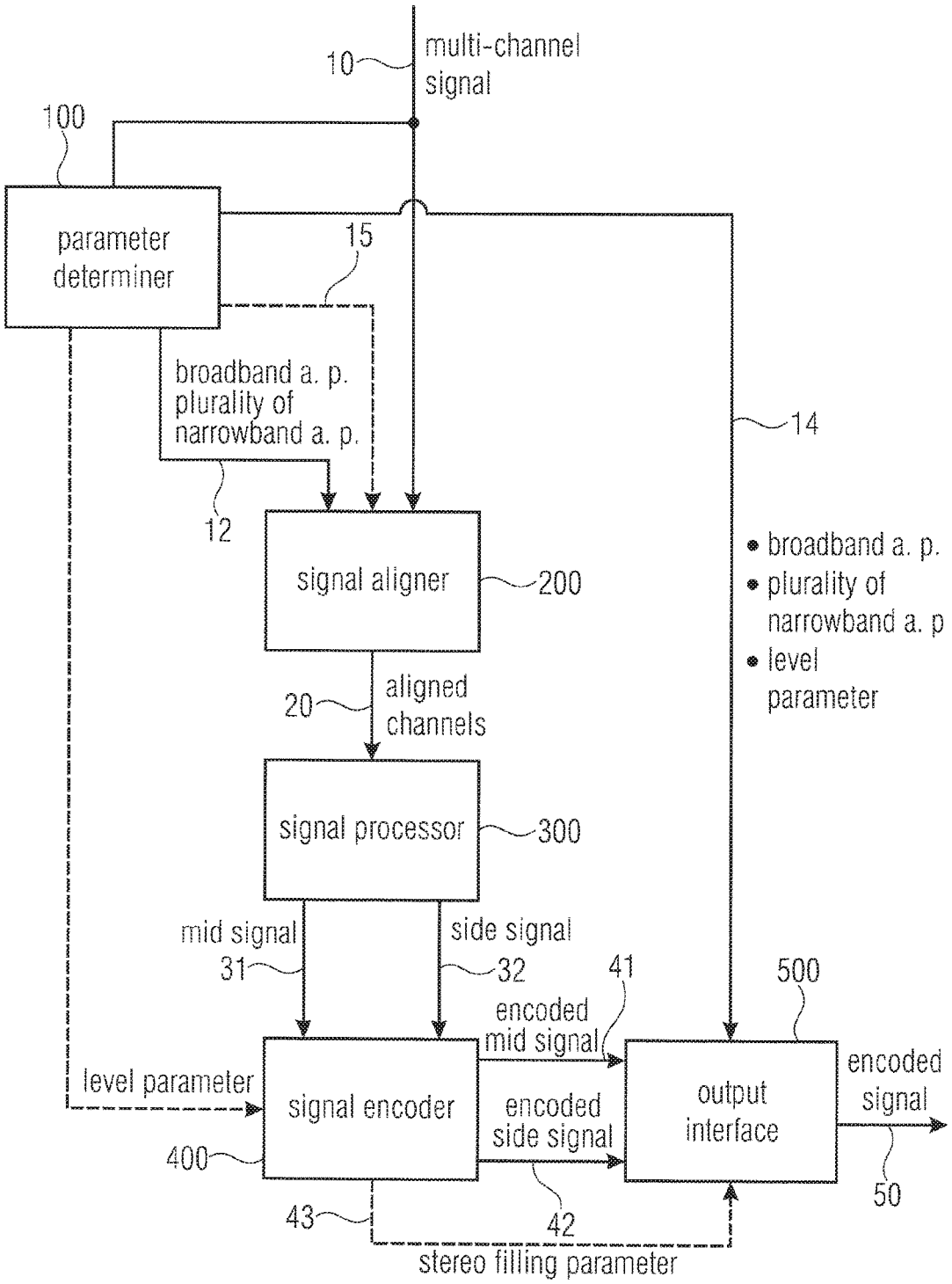
FIG. 12 is a block diagram of an advantageous implementation of the multi-channel processing using a downmix in the signal processor.

FIG. 12 illustrates an apparatus for encoding a multi-channel signal having at least two channels. The multi-channel signal 10 is input into a parameter determiner 100 on the one hand and a signal aligner 200 on the other hand. The parameter determiner 100 determines, on the one hand, a broadband alignment parameter and, on the other hand, a plurality of narrowband alignment parameters from the multi-channel signal. These parameters are output via a parameter line 12. Furthermore, these parameters are also output via a further parameter line 14 to an output interface 500 as illustrated. On the parameter line 14, additional parameters such as the level parameters are forwarded from the parameter determiner 100 to the output interface 500. The signal aligner 200 is configured for aligning the at least two channels of the multi-channel signal 10 using the broadband alignment parameter and the plurality of narrowband alignment parameters received via parameter line 10 to obtain aligned channels 20 at the output of the signal aligner 200. These aligned channels 20 are forwarded to a signal processor 300 which is configured for calculating a mid-signal 31 and a side signal 32 from the aligned channels received via line 20. The apparatus for encoding further comprises a signal encoder 400 for encoding the mid-signal from line 31 and the side signal from line 32 to obtain an encoded mid-signal on line 41 and an encoded side signal on line 42. Both these signals are forwarded to the output interface 500 for generating an encoded multi-channel signal at output line 50. The encoded signal at output line 50 comprises the encoded mid-signal from line 41, the encoded side signal from line 42, the narrowband alignment parameters and the broadband alignment parameters from line 14 and, optionally, a level parameter from line 14 and, additionally optionally, a stereo filling parameter generated by the signal encoder 400 and forwarded to the output interface 500 via parameter line 43.

Advantageously, the signal aligner is configured to align the channels from the multi-channel signal using the broadband alignment parameter, before the parameter determiner 100 actually calculates the narrowband parameters. Therefore, in this embodiment, the signal aligner 200 sends the broadband aligned channels back to the parameter determiner 100 via a connection line 15. Then, the parameter determiner 100 determines the plurality of narrowband alignment parameters from an already with respect to the broadband characteristic aligned multi-channel signal. In other embodiments, however, the parameters are determined without this specific sequence of procedures.

Figure 14A:
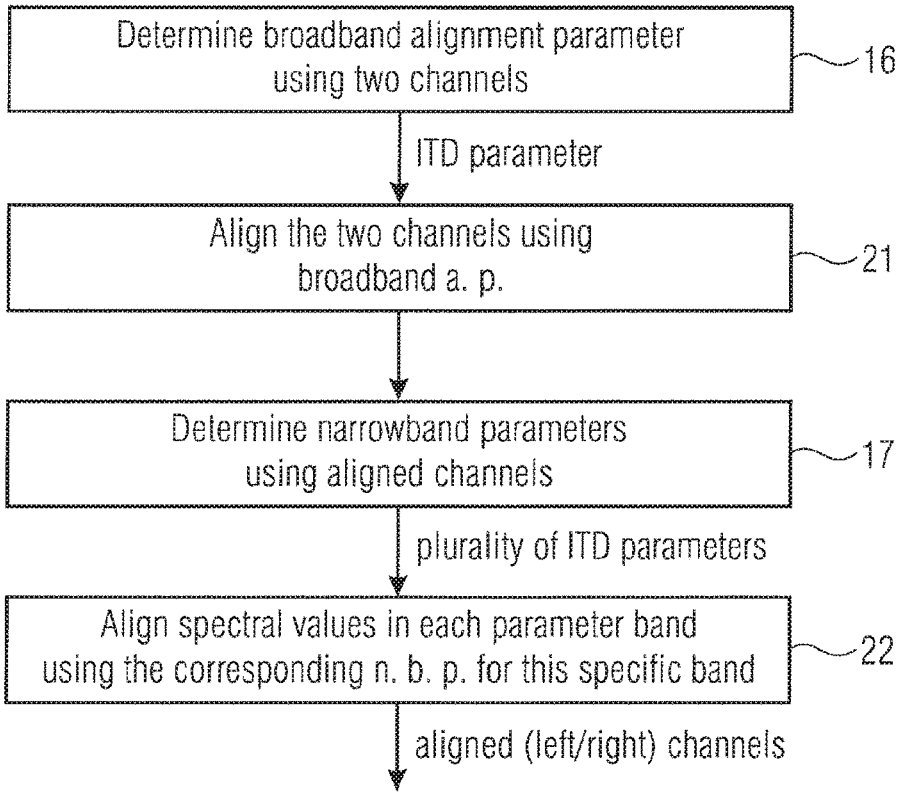
FIG. 14*a* illustrates a flowchart of procedures performed in the apparatus for encoding for the purpose of aligning the channels.

FIG. 14*a* illustrates an advantageous implementation, where the specific sequence of steps that incurs connection line 15 is performed. In the step 16, the broadband alignment parameter is determined using the two channels and the broadband alignment parameter such as an inter-channel time difference or ITD parameter is obtained. Then, in step 21, the two channels are aligned by the signal aligner 200 of FIG. 12 using the broadband alignment parameter. Then, in step 17, the narrowband parameters are determined using the aligned channels within the parameter determiner 100 to determine a plurality of narrowband alignment parameters such as a plurality of inter-channel phase difference parameters for different bands of the multi-channel signal. Then, in step 22, the spectral values in each parameter band are aligned using the corresponding narrowband alignment parameter for this specific band. When this procedure in step 22 is performed for each band, for which a narrowband alignment parameter is available, then aligned first and second or left/right channels are available for further signal processing by the signal processor 300 of FIG. 12.

Figure 14B:
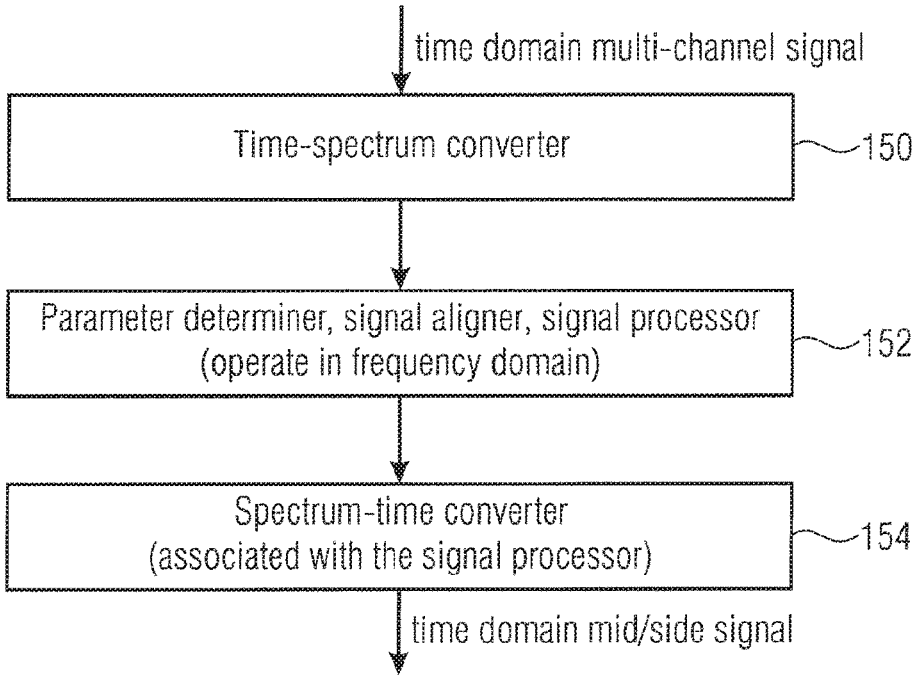
FIG. 14*b* illustrates an advantageous embodiment of procedures performed in the frequency-domain.

FIG. 14*b* illustrates a further implementation of the multi-channel encoder of FIG. 12 where several procedures are performed in the frequency domain.

Specifically, the multi-channel encoder further comprises a time-spectrum converter 150 for converting a time domain multi-channel signal into a spectral representation of the at least two channels within the frequency domain.

Furthermore, as illustrated at 152, the parameter determiner, the signal aligner and the signal processor illustrated at 100, 200 and 300 in FIG. 12 all operate in the frequency domain.

Furthermore, the multi-channel encoder and, specifically, the signal processor further comprises a spectrum-time converter 154 for generating a time domain representation of the mid-signal at least.

Advantageously, the spectrum time converter additionally converts a spectral representation of the side signal also determined by the procedures represented by block 152 into a time domain representation, and the signal encoder 400 of FIG. 12 is then configured to further encode the mid-signal and/or the side signal as time domain signals depending on the specific implementation of the signal encoder 400 of FIG. 12.

Advantageously, the time-spectrum converter 150 of FIG. 14*b* is configured to implement steps 155, 156 and 157 of FIG. 4*c*. Specifically, step 155 comprises providing an analysis window with at least one zero padding portion at one end thereof and, specifically, a zero padding portion at the initial window portion and a zero padding portion at the terminating window portion as illustrated, for example, in FIG. 7 later on. Furthermore, the analysis window additionally has overlap ranges or overlap portions at a first half of the window and at a second half of the window and, additionally, advantageously a middle part being a non-overlap range as the case may be.

Figure 14C:
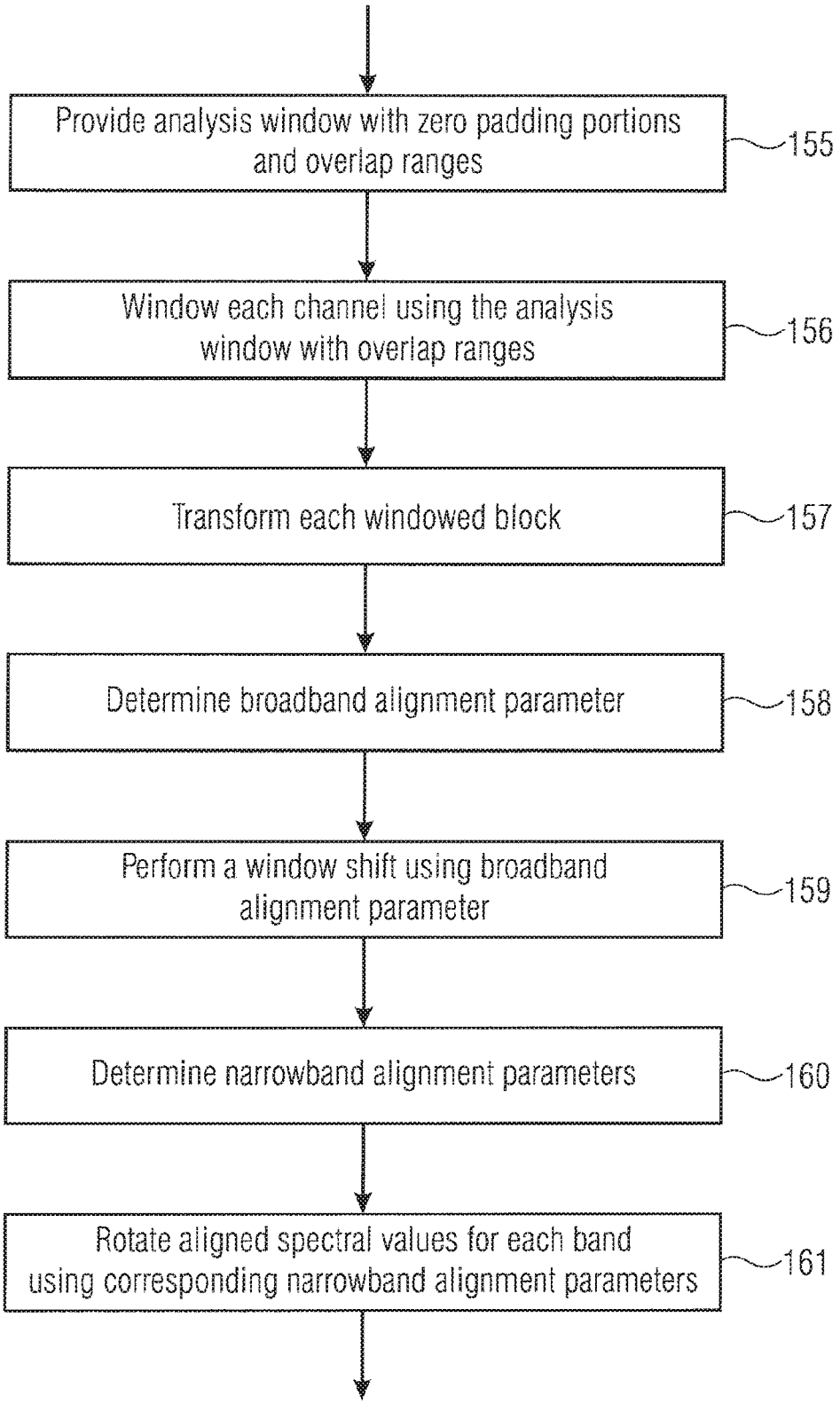
FIG. 14*c* illustrates an advantageous embodiment of procedures performed in the apparatus for encoding using an analysis window with zero padding portions and overlap ranges.

In step 156, each channel is windowed using the analysis window with overlap ranges. Specifically, each channel is widowed using the analysis window in such a way that a first block of the channel is obtained. Subsequently, a second block of the same channel is obtained that has a certain overlap range with the first block and so on, such that subsequent to, for example, five windowing operations, five blocks of windowed samples of each channel are available that are then individually transformed into a spectral representation as illustrated at 157 in FIG. 14*c*. The same procedure is performed for the other channel as well so that, at the end of step 157, a sequence of blocks of spectral values and, specifically, complex spectral values such as DFT spectral values or complex subband samples is available.

In step 158, which is performed by the parameter determiner 100 of FIG. 12, a broadband alignment parameter is determined and in step 159, which is performed by the signal alignment 200 of FIG. 12, a circular shift is performed using the broadband alignment parameter. In step 160, again performed by the parameter determiner 100 of FIG. 12, narrowband alignment parameters are determined for individual bands/subbands and in step 161, aligned spectral values are rotated for each band using corresponding narrowband alignment parameters determined for the specific bands.

Figure 14D:
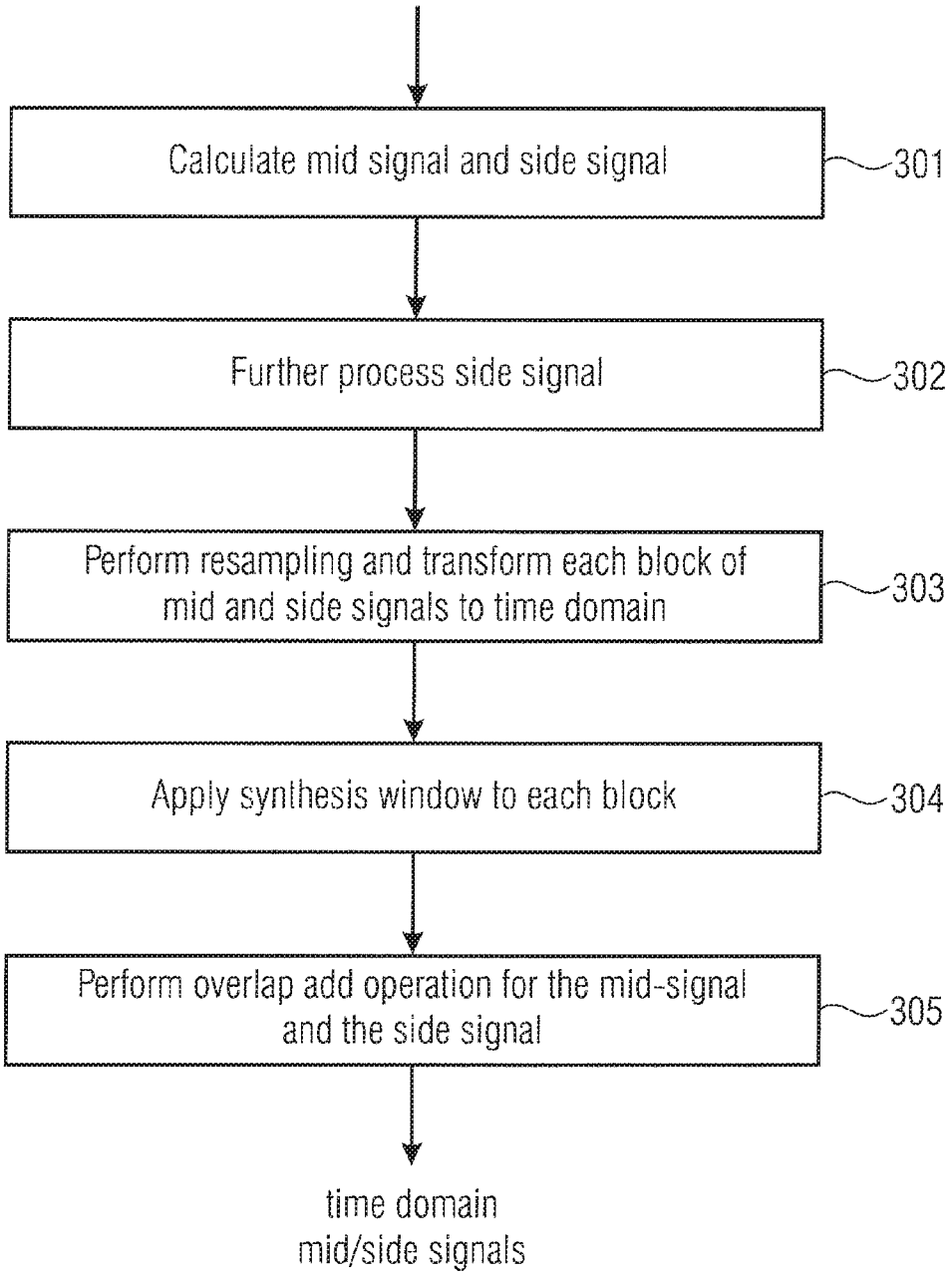
FIG. 14*d* illustrates a flowchart for further procedures performed within an embodiment of the apparatus for encoding.

FIG. 14*d* illustrates further procedures performed by the signal processor 300. Specifically, the signal processor 300 is configured to calculate a mid-signal and a side signal as illustrated at step 301. In step 302, some kind of further processing of the side signal can be performed and then, in step 303, each block of the mid-signal and the side signal is transformed back into the time domain and, in step 304, a synthesis window is applied to each block obtained by step 303 and, in step 305, an overlap add operation for the mid-signal on the one hand and an overlap add operation for the side signal on the other hand is performed to finally obtain the time domain mid/side signals.

Specifically, the operations of the steps 304 and 305 result in a kind of cross fading from one block of the mid-signal or the side signal in the next block of the mid signal and the side signal is performed so that, even when any parameter changes occur such as the inter-channel time difference parameter or the inter-channel phase difference parameter occur, this will nevertheless be not audible in the time domain mid/side signals obtained by step 305 in FIG. 14*d*.

Figure 13:
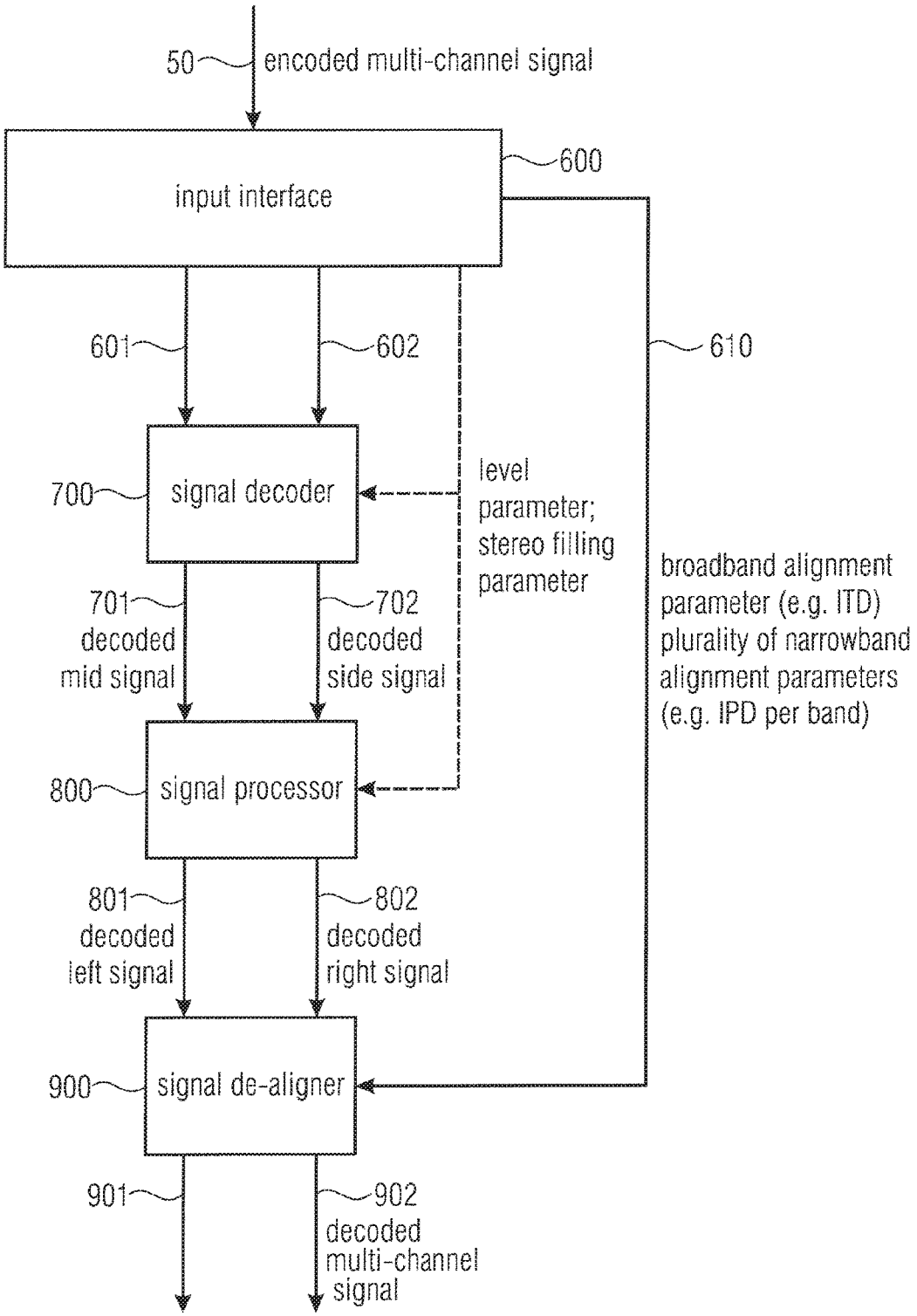
FIG. 13 is an advantageous embodiment of the inverse multi-channel processing with an upmix operation within the signal processor.

FIG. 13 illustrates a block diagram of an embodiment of an apparatus for decoding an encoded multi-channel signal received at input line 50.

In particular, the signal is received by an input interface 600. Connected to the input interface 600 are a signal decoder 700, and a signal de-aligner 900. Furthermore, a signal processor 800 is connected to a signal decoder 700 on the one hand and is connected to the signal de-aligner on the other hand.

In particular, the encoded multi-channel signal comprises an encoded mid-signal, an encoded side signal, information on the broadband alignment parameter and information on the plurality of narrowband parameters. Thus, the encoded multi-channel signal on line 50 can be exactly the same signal as output by the output interface of 500 of FIG. 12.

However, importantly, it is to be noted here that, in contrast to what is illustrated in FIG. 12, the broadband alignment parameter and the plurality of narrowband alignment parameters included in the encoded signal in a certain form can be exactly the alignment parameters as used by the signal aligner 200 in FIG. 12 but can, alternatively, also be the inverse values thereof, i.e., parameters that can be used by exactly the same operations performed by the signal aligner 200 but with inverse values so that the de-alignment is obtained.

Thus, the information on the alignment parameters can be the alignment parameters as used by the signal aligner 200 in FIG. 12 or can be inverse values, i.e., actual "de-alignment parameters". Additionally, these parameters will typically be quantized in a certain form as will be discussed later on with respect to FIG. 8.

The input interface 600 of FIG. 13 separates the information on the broadband alignment parameter and the plurality of narrowband alignment parameters from the encoded mid/side signals and forwards this information via parameter line 610 to the signal de-aligner 900. On the other hand, the encoded mid-signal is forwarded to the signal decoder 700 via line 601 and the encoded side signal is forwarded to the signal decoder 700 via signal line 602.

The signal decoder is configured for decoding the encoded mid-signal and for decoding the encoded side signal to obtain a decoded mid-signal on line 701 and a decoded side signal on line 702. These signals are used by the signal processor 800 for calculating a decoded first channel signal or decoded left signal and for calculating a decoded second channel or a decoded right channel signal from the decoded mid signal and the decoded side signal, and the decoded first channel and the decoded second channel are output on lines 801, 802, respectively. The signal de-aligner 900 is configured for de-aligning the decoded first channel on line 801 and the decoded right channel 802 using the information on the broadband alignment parameter and additionally using the information on the plurality of narrowband alignment parameters to obtain a decoded multi-channel signal, i.e., a decoded signal having at least two decoded and de-aligned channels on lines 901 and 902.

FIG. 9*a* illustrates an advantageous sequence of steps performed by the signal de-aligner 900 from FIG. 13. Specifically, step 910 receives aligned left and right channels as available on lines 801, 802 from FIG. 13. In step 910, the signal de-aligner 900 de-aligns individual subbands using the information on the narrowband alignment parameters in order to obtain phase-de-aligned decoded first and second or left and right channels at 911*a* and 911*b*. In step 912, the channels are de-aligned using the broadband alignment parameter so that, at 913*a* and 913*b*, phase and time-de-aligned channels are obtained.

In step 914, any further processing is performed that comprises using a windowing or any overlap-add operation or, generally, any cross-fade operation in order to obtain, at 915*a* or 915*b*, an artifact-reduced or artifact-free decoded signal, i.e., to decoded channels that do not have any artifacts although there have been, typically, time-varying de-alignment parameters for the broadband on the one hand and for the plurality of narrow bands on the other hand.

Figure 15A:
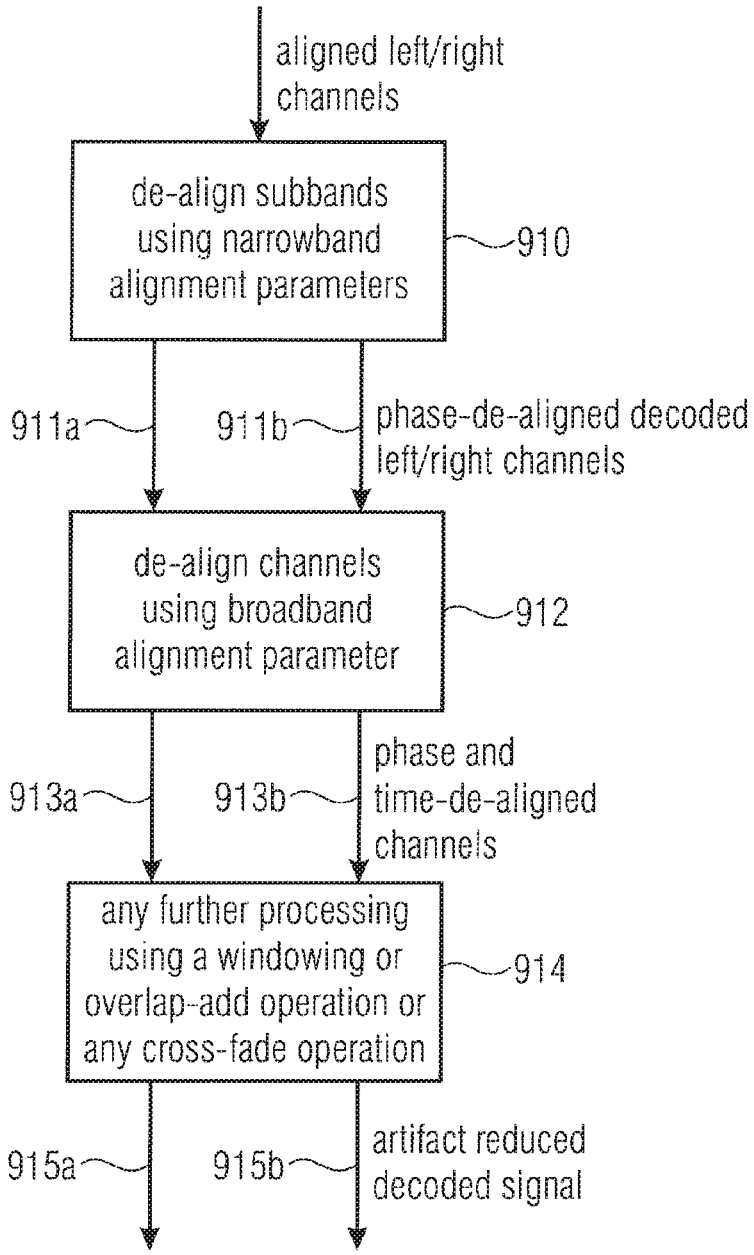
FIG. 15*a* illustrates procedures performed by an embodiment of the apparatus for decoding and encoding multi-channel signals.
Figure 15B:
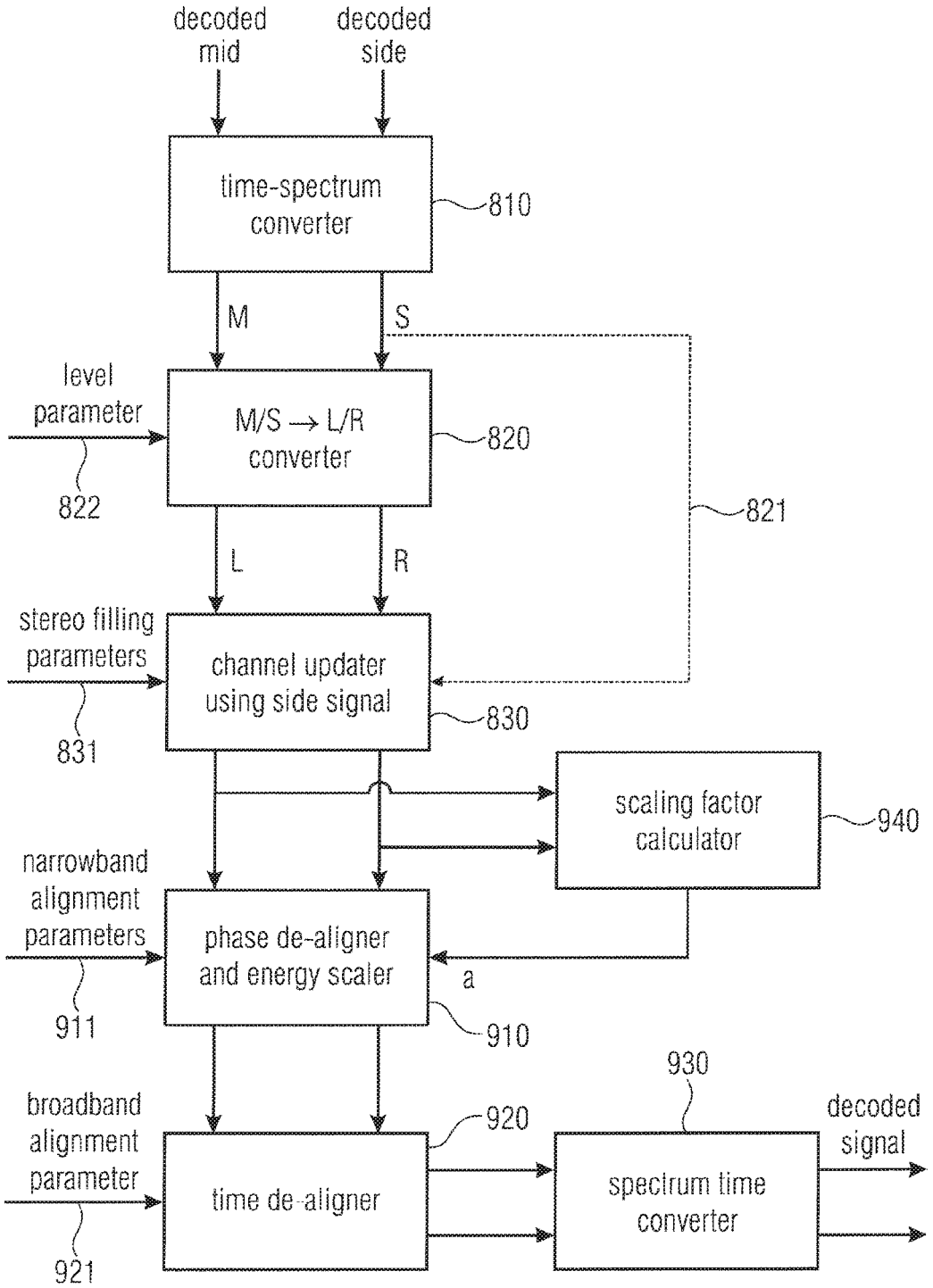
FIG. 15*b* illustrates an advantageous implementation of the apparatus for decoding with respect to some aspects.

FIG. 15*b* illustrates an advantageous implementation of the multi-channel decoder illustrated in FIG. 13.

In particular, the signal processor 800 from FIG. 13 comprises a time-spectrum converter 810.

The signal processor furthermore comprises a mid/side to left/right converter 820 in order to calculate from a mid-signal M and a side signal S a left signal L and a right signal R.

However, importantly, in order to calculate L and R by the mid/side-left/right conversion in block 820, the side signal S is not necessarily to be used. Instead, as discussed later on, the left/right signals are initially calculated only using a gain parameter derived from an inter-channel level difference parameter ILD. Therefore, in this implementation, the side signal S is only used in the channel updater 830 that operates in order to provide a better left/right signal using the transmitted side signal S as illustrated by bypass line 821.

Therefore, the converter 820 operates using a level parameter obtained via a level parameter input 822 and without actually using the side signal S but the channel updater 830 then operates using the side 821 and, depending on the specific implementation, using a stereo filling parameter received via line 831. The signal aligner 900 then comprises a phased-de-aligner and energy scaler 910. The energy scaling is controlled by a scaling factor derived by a scaling factor calculator 940. The scaling factor calculator 940 is fed by the output of the channel updater 830. Based on the narrowband alignment parameters received via input 911, the phase de-alignment is performed and, in block 920, based on the broadband alignment parameter received via line 921, the time-de-alignment is performed. Finally, a spectrum-time conversion 930 is performed in order to finally obtain the decoded signal.

Figure 15C:
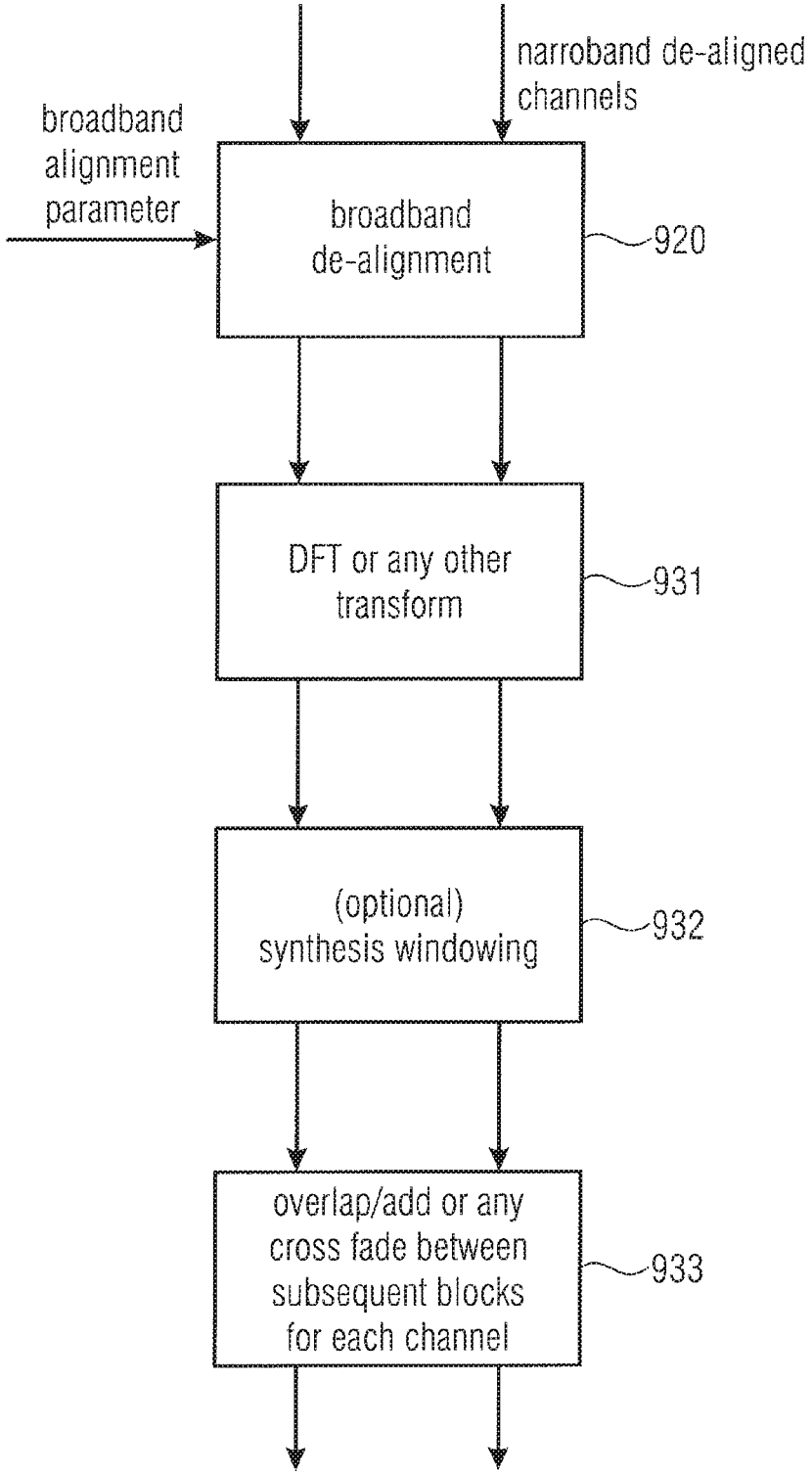
FIG. 15*c* illustrates a procedure performed in the context of broadband de-alignment in the framework of the decoding of an encoded multi-channel signal.

FIG. 15*c* illustrates a further sequence of steps typically performed within blocks 920 and 930 of FIG. 15*b* in an advantageous embodiment.

Specifically, the narrowband de-aligned channels are input into the broadband de-alignment functionality corresponding to block 920 of FIG. 15*b*. A DFT or any other transform is performed in block 931. Subsequent to the actual calculation of the time domain samples, an optional synthesis windowing using a synthesis window is performed. The synthesis window is advantageously exactly the same as the analysis window or is derived from the analysis window, for example interpolation or decimation but depends in a certain way from the analysis window. This dependence advantageously is such that multiplication factors defined by two overlapping windows add up to one for each point in the overlap range. Thus, subsequent to the synthesis window in block 932, an overlap operation and a subsequent add operation is performed. Alternatively, instead of synthesis windowing and overlap/add operation, any cross fade between subsequent blocks for each channel is performed in order to obtain, as already discussed in the context of FIG. 15*a*, an artifact reduced decoded signal.

When FIG. 6*b* is considered, it becomes clear that the actual decoding operations for the mid-signal, i.e., the "EVS decoder" on the one hand and, for the side signal, the inverse vector quantization $VQ^{-1}$ and the inverse MDCT operation (IMDCT) correspond to the signal decoder 700 of FIG. 13.

Furthermore, the DFT operations in blocks 810 correspond to element 810 in FIG. 15*b* and functionalities of the inverse stereo processing and the inverse time shift correspond to blocks 800, 900 of FIG. 13 and the inverse DFT operations 930 in FIG. 6*b* correspond to the corresponding operation in block 930 in FIG. 15*b*.

Subsequently, FIG. 3*d* is discussed in more detail. In particular, FIG. 3*d* illustrates a DFT spectrum having individual spectral lines. Advantageously, the DFT spectrum or any other spectrum illustrated in FIG. 3*d* is a complex spectrum and each line is a complex spectral line having magnitude and phase or having a real part and an imaginary part.

Additionally, the spectrum is also divided into different parameter bands. Each parameter band has at least one and advantageously more than one spectral lines. Additionally, the parameter bands increase from lower to higher frequencies. Typically, the broadband alignment parameter is a single broadband alignment parameter for the whole spectrum, i.e., for a spectrum comprising all the bands 1 to 6 in the exemplary embodiment in FIG. 3*d*.

Furthermore, the plurality of narrowband alignment parameters are provided so that there is a single alignment parameter for each parameter band. This means that the alignment parameter for a band applies to all the spectral values within the corresponding band.

Furthermore, in addition to the narrowband alignment parameters, level parameters are also provided for each parameter band.

In contrast to the level parameters that are provided for each and every parameter band from band 1 to band 6, it is advantageous to provide the plurality of narrowband alignment parameters only for a limited number of lower bands such as bands 1, 2, 3 and 4.

Additionally, stereo filling parameters are provided for a certain number of bands excluding the lower bands such as, in the exemplary embodiment, for bands 4, 5 and 6, while there are side signal spectral values for the lower parameter bands 1, 2 and 3 and, consequently, no stereo filling parameters exist for these lower bands where wave form matching is obtained using either the side signal itself or a prediction residual signal representing the side signal.

As already stated, there exist more spectral lines in higher bands such as, in the embodiment in FIG. 3*d*, seven spectral lines in parameter band 6 versus only three spectral lines in parameter band 2. Naturally, however, the number of parameter bands, the number of spectral lines and the number of spectral lines within a parameter band and also the different limits for certain parameters will be different.

Nevertheless, FIG. 8 illustrates a distribution of the parameters and the number of bands for which parameters are provided in a certain embodiment where there are, in contrast to FIG. 3*d*, actually 12 bands.

As illustrated, the level parameter ILD is provided for each of 12 bands and is quantized to a quantization accuracy represented by five bits per band.

Furthermore, the narrowband alignment parameters IPD are only provided for the lower bands up to a border frequency of 2.5 kHz. Additionally, the inter-channel time difference or broadband alignment parameter is only provided as a single parameter for the whole spectrum but with a very high quantization accuracy represented by eight bits for the whole band.

Furthermore, quite roughly quantized stereo filling parameters are provided represented by three bits per band and not for the lower bands below 1 kHz since, for the lower bands, actually encoded side signal or side signal residual spectral values are included.

Subsequently, an advantageous processing on the encoder side is summarized In a first step, a DFT analysis of the left and the right channel is performed. This procedure corresponds to steps 155 to 157 of FIG. 14*c*. The broadband alignment parameter is calculated and, particularly, the advantageous broadband alignment parameter inter-channel time difference (ITD). A time shift of L and R in the frequency domain is performed. Alternatively, this time shift can also be performed in the time domain. An inverse DFT is then performed, the time shift is performed in the time domain and an additional forward DFT is performed in order to once again have spectral representations subsequent to the alignment using the broadband alignment parameter.

ILD parameters, i.e., level parameters and phase parameters (IPD parameters), are calculated for each parameter band on the shifted L and R representations. This step corresponds to step 160 of FIG. 14*c*, for example. Time shifted L and R representations are rotated as a function of the inter-channel phase difference parameters as illustrated in step 161 of FIG. 14*c*. Subsequently, the mid and side signals are computed as illustrated in step 301 and, advantageously, additionally with an energy conversation operation as discussed later on. Furthermore, a prediction of S with M as a function of ILD and optionally with a past M signal, i.e., a mid-signal of an earlier frame is performed. Subsequently, inverse DFT of the mid-signal and the side signal is performed that corresponds to steps 303, 304, 305 of FIG. 14*d* in the advantageous embodiment.

In the final step, the time domain mid-signal m and, optionally, the residual signal are coded. This procedure corresponds to what is performed by the signal encoder 400 in FIG. 12.

At the decoder in the inverse stereo processing, the Side signal is generated in the DFT domain and is first predicted from the Mid signal as:

$$\widetilde{Side} = g \cdot \text{Mid}$$

where g is a gain computed for each parameter band and is function of the transmitted Inter-channel Level Difference (ILDs).

The residual of the prediction Side−g·Mid can be then refined in two different ways:

By a secondary coding of the residual signal:

$$\widetilde{Side} = g \cdot \text{Mid} + g_{cod} \cdot (\text{Side} - \widetilde{g} \cdot \cdot \text{Mid})$$

where $g_{cod}$ is a global gain transmitted for the whole spectrum

By a residual prediction, known as stereo filling, predicting the residual side spectrum with the previous decoded Mid signal spectrum from the previous DFT frame:

$$\widetilde{Side} = g \cdot \text{Mid} + g_{pred} \text{Mid} \cdot z^{-1}$$

where $g_{pred}$ is a predictive gain transmitted per parameter band.

The two types of coding refinement can be mixed within the same DFT spectrum. In the advantageous embodiment, the residual coding is applied on the lower parameter bands, while residual prediction is applied on the remaining bands. The residual coding is in the advantageous embodiment as depict in FIG. 12 performs in MDCT domain after synthesizing the residual Side signal in Time Domain and transforming it by a MDCT. Unlike DFT, MDCT is critical sampled and is more suitable for audio coding. The MDCT coefficients are directly vector quantized by a Lattice Vector Quantization but can be alternatively coded by a Scalar Quantizer followed by an entropy coder. Alternatively, the residual side signal can be also coded in Time Domain by a speech coding technique or directly in DFT domain.

overlapping region is limited for reducing the engendered delay and that zero padding is also added to counter balance the circular shift when applying ITD in frequency domain as it will be explained hereafter.

2. Stereo Parameters

Stereo parameters can be transmitted at maximum at the time resolution of the stereo DFT. At minimum it can be reduced to the framing resolution of the core coder, i.e. 20 ms. By default, when no transients is detected, parameters are computed every 20 ms over 2 DFT windows. The parameter bands constitute a non-uniform and non-overlapping decomposition of the spectrum following roughly 2 times or 4 times the Equivalent Rectangular Bandwidths (ERB). By default, a 4 times ERB scale is used for a total of 12 bands for a frequency bandwidth of 16 kHz (32 kbps sampling-rate, Super Wideband stereo). FIG. 8 summarized an example of configuration, for which the stereo side information is transmitted with about 5 kbps.

3. Computation of ITD and Channel Time Alignment

The ITD are computed by estimating the Time Delay of Arrival (TDOA) using the Generalized Cross Correlation with Phase Transform (GCC-PHAT):

$$ITD = \operatorname{argmax}\left(IDFT\left(\frac{L_i(f)R_i^*(k)}{|L_i(f)R_i^*(k)|}\right)\right)$$

where L and R are the frequency spectra of the of the left and right channels respectively. The frequency analysis can be performed independently of the DFT used for the subsequent stereo processing or can be shared. The pseudo-code for computing the ITD is the following:

```
L =fft(window(l));
R =fft(window(r));
tmp = L .* conj( R );
sfm_L = prod(abs(L).^(1/length(L)))/(mean(abs(L))+eps);
sfm_R = prod(abs(R).^(1/length(R)))/(mean(abs(R))+eps);
sfm = max(sfm_L,sfm_R);
h.cross_corr_smooth = (1-sfm)*h.cross_corr_smooth+sfm*tmp;
tmp = h.cross_corr_smooth ./ abs( h.cross_corr_smooth+eps);
tmp = ifft( tmp );
tmp = tmp([length(tmp)/2+1:length(tmp) 1:length(tmp)/2+1]);
tmp_sort = sort( abs(tmp) );
thresh = 3 * tmp_sort( round(0.95*length(tmp_sort)) );
xcorr_time=abs(tmp(- ( h.stereo_itd_q_max - (length(tmp)-1)/2 - 1 ):- ( h.stereo_itd_q_min
- (length(tmp)-1)/2 - 1 )));
%smooth output for better detection
xcorr_time=[xcorr_time 0];
xcorr_time2=filter([0.25 0.5 0.25], 1,xcorr_time);
[m,i] = max(xcorr_time2(2:end));
if m > thresh
   itd = h.stereo_itd_q_max - i + 1;
else
   itd = 0;
end
```

Subsequently a further embodiment of a joint stereo/multichannel encoder processing or an inverse stereo/multichannel processing is described.

1. Time-Frequency Analysis: DFT

It is important that the extra time-frequency decomposition from the stereo processing done by DFTs allows a good auditory scene analysis while not increasing significantly the overall delay of the coding system. By default, a time resolution of 10 ms (twice the 20 ms framing of the core coder) is used. The analysis and synthesis windows are the same and are symmetric. The window is represented at 16 kHz of sampling rate in FIG. 7. It can be observed that the The ITD computation can also be summarized as follows. The cross-correlation is computed in frequency domain before being smoothed depending of the Spectral Flatness Measurement. SFM is bounded between 0 and 1. In case of noise-like signals, the SFM will be high (i.e. around 1) and the smoothing will be weak. In case of tone-like signal, SFM will be low and the smoothing will become stronger. The smoothed cross-correlation is then normalized by its amplitude before being transformed back to time domain. The normalization corresponds to the Phase-transform of the cross-correlation, and is known to show better performance than the normal cross-correlation in low noise and relatively high reverberation environments. The so-obtained time domain function is first filtered for achieving a more robust peak peaking. The index corresponding to the maximum amplitude corresponds to an estimate of the time difference between the Left and Right Channel (ITD). If the amplitude of the maximum is lower than a given threshold, then the estimated of ITD is not considered as reliable and is set to zero.

If the time alignment is applied in Time Domain, the ITD is computed in a separate DFT analysis. The shift is done as follows:

$$\begin{cases} r(n) = r(n + ITD) \text{ if } ITD > 0 \\ l(n) = l(n - ITD) \text{ if } ITD < 0 \end{cases}$$

It may use an extra delay at encoder, which is equal at maximum to the maximum absolute ITD which can be handled. The variation of ITD over time is smoothed by the analysis windowing of DFT.

Alternatively the time alignment can be performed in frequency domain. In this case, the ITD computation and the circular shift are in the same DFT domain, domain shared with this other stereo processing. The circular shift is given by:

$$\begin{cases} L(f) = L(f)e^{-j2\pi f\frac{ITD}{2}} \\ R(f) = R(f)e^{+j2\pi f\frac{ITD}{2}} \end{cases}$$

Zero padding of the DFT windows is needed for simulating a time shift with a circular shift. The size of the zero padding corresponds to the maximum absolute ITD which can be handled. In the advantageous embodiment, the zero padding is split uniformly on the both sides of the analysis windows, by adding 3.125 ms of zeros on both ends. The maximum absolute possible ITD is then 6.25 ms. In A-B microphones setup, it corresponds for the worst case to a maximum distance of about 2.15 meters between the two microphones. The variation in ITD over time is smoothed by synthesis windowing and overlap-add of the DFT.

It is important that the time shift is followed by a windowing of the shifted signal. It is a main distinction with the Binaural Cue Coding (BCC) of conventional technology, where the time shift is applied on a windowed signal but is not windowed further at the synthesis stage. As a consequence, any change in ITD over time produces an artificial transient/click in the decoded signal.

4. Computation of IPDs and Channel Rotation

The IPDs are computed after time aligning the two channels and this for each parameter band or at least up to a given ipd_max_band, dependent of the stereo configuration.

$$IPD[b] = \text{angle}\left(\sum_{k=band_{limits}[b]}^{band_{limits}[b+1]} L[k]R^*[k]\right)$$

IPDs is then applied to the two channels for aligning their phases:

$$\begin{cases} L'(k) = L(k)e^{-j\beta} \\ R'(k) = R(k)e^{j(IPD[b]-\beta)} \end{cases}$$

Where $\beta$=a tan 2(sin($IPD_i$[b]), cos($IPD_i$[b])+c), c=$10^{ILD_i[b]/20}$ and b is the parameter band index to which belongs the frequency index k. The parameter $\beta$ is responsible of distributing the amount of phase rotation between the two channels while making their phase aligned. $\beta$ is dependent of IPD but also the relative amplitude level of the channels, ILD. If a channel has higher amplitude, it will be considered as leading channel and will be less affected by the phase rotation than the channel with lower amplitude.

5. Sum-Difference and Side Signal Coding

The sum difference transformation is performed on the time and phase aligned spectra of the two channels in a way that the energy is conserved in the Mid signal.

$$\begin{cases} M(f) = (L'(f) + R'(f)) \cdot a \cdot \sqrt{\frac{1}{2}} \\ S(f) = (L'(f) - R'(f)) \cdot a \cdot \sqrt{\frac{1}{2}} \end{cases}$$

$$\text{where } a = \sqrt{\frac{L'^2 + R'^2}{(L' + R')^2}}$$

is bounded between 1/1.2 and 1.2, i.e. −1.58 and +1.58 dB. The limitation avoids aretefact when adjusting the energy of M and S. It is worth noting that this energy conservation is less important when time and phase were beforehand aligned. Alternatively the bounds can be increased or decreased.

The side signal S is further predicted with M:

$$S'(f)=S(f)-g(ILD)M(f)$$

where $$g(ILD) = \frac{c-1}{c+1},$$

where c=$10^{ILD_i[b]/20}$. Alternatively the optimal prediction gain g can be found by minimizing the Mean Square Error (MSE) of the residual and ILDs deduced by the previous equation.

The residual signal S'(f) can be modeled by two means: either by predicting it with the delayed spectrum of M or by coding it directly in the MDCT domain in the MDCT domain.

6. Stereo Decoding

The Mid signal X and Side signal S are first converted to the left and right channels L and R as follows:

$$L_i[k]=M_i[k]+gM_i[k], \text{ for band_limits}[b]\leq k<\text{band_limits}[b+1],$$

$$R_i[k]=M_i[k]-gM_i[k], \text{ for band_limits}[b]\leq k<\text{band_limits}[b+1],$$

where the gain g per parameter band is derived from the ILD parameter:

$$g = \frac{c-1}{c+1},$$

where c=$10^{ILD_i[b]/20}$.

For parameter bands below cod_max_band, the two channels are updated with the decoded Side signal:

$$L_i[k]=L_i[k]+cod_\text{gain}_i \cdot S_i[k], \text{ for } 0\leq k<\text{band_limits}[cod_\text{max_band}],$$

$$R_i[k]=R_i[k]-cod_\text{gain}_i \cdot S_i[k], \text{ for } 0\leq k<\text{band_limits}[cod_\text{max_band}],$$

For higher parameter bands, the side signal is predicted and the channels updated as:

$$L_i[k]=L_i[k]+cod_\mathrm{pred}_i[b]\cdot M_{i-1}[k],\ \text{for band_limits}[b]\leq k<\text{band_limits}[b+1],$$

$$R_i[k]=R_i[k]-cod_\mathrm{pred}_i[b]\cdot M_{i-1}[k],\ \text{for band_limits}[b]\leq k<\text{band_limits}[b+1],$$

Finally, the channels are multiplied by a complex value aiming to restore the original energy and the inter-channel phase of the stereo signal:

$$L_i[k]=a\cdot e^{j2\pi\beta}\cdot L_i[k]$$

$$R_i[k]=a\cdot e^{j2\pi\beta-IPD_i[b]}\cdot R_i[k]$$

where $$a=\sqrt{2\cdot\frac{\sum_{k=band_limits[b]}^{band_limits[b+1]}M_i^2[k]}{\sum_{k=band_limits[b]}^{band_limits[b+1]-1}L_i^2[k]+\sum_{k=band_limits[b]}^{band_limits[b+1]-1}R_i^2[k]}}$$

where a is defined and bounded as defined previously, and where $\beta$=a tan 2(sin(IPD$_i$[b]), cos(IPD$_i$[b])+c), and where a tan 2(x,y) is the four-quadrant inverse tangent of x over y.

Finally, the channels are time shifted either in time or in frequency domain depending of the transmitted ITDs. The time domain channels are synthesized by inverse DFTs and overlap-adding.

An inventively encoded audio signal can be stored on a digital storage medium or a non-transitory storage medium or can be transmitted on a transmission medium such as a wireless transmission medium or a wired transmission medium such as the Internet.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. Apparatus for encoding a multi-channel signal comprising at least two channels, comprising:

a time-spectral converter for converting sequences of blocks of sampling values of the at least two channels into a frequency domain representation comprising sequences of blocks of spectral values for the at least two channels;

a multi-channel processor for applying a joint multi-channel processing to the sequences of blocks of spectral values to acquire at least one result sequence of blocks of spectral values comprising information related to the at least two channels;

a spectral-time converter for converting the result sequence of blocks of spectral values into a time domain representation comprising an output sequence of blocks of sampling values; and a core encoder for encoding the output sequence of blocks of sampling values to acquire an encoded multi-channel signal, wherein the core encoder is configured to operate in accordance with a first frame control to provide a sequence of frames, wherein a frame is bounded by a start frame border and an end frame border, and wherein the time-spectral converter or the spectral-time converter are configured to operate in accordance with a second frame control being synchronized to the first frame control, wherein the start frame border or the end frame border of each frame of the sequence of frames is in a predetermined relation to a start instant or an end instant of an overlapping portion of a window used by the time-spectral converter for each block of the sequence of blocks of sampling values or used by the spectral-time converter for each block of the output sequence of blocks of sampling values, wherein the spectral-time converter is configured to process an output look-ahead portion corresponding to the windowed look-ahead portion using a redress function, wherein the redress function is configured so that an influence of the overlapping portion of the analysis window is reduced or eliminated, wherein the overlapping portion is proportional to a square root of a sine function, wherein the redress function is proportional to the inverse square root of the sine function, and wherein the spectral-time converter is configured to use an overlapping portion being proportional to the sine function raised to a power of 1.5, or wherein the spectral-time converter is configured to generate a first output block using a synthesis window and a second output block using the synthesis window, wherein a second portion of the second output block is an output look-ahead portion, wherein the spectral-time converter is configured to generate sampling values of a frame using an overlap-add operation between the first output block and another portion of the second output block, the another portion excluding the output look-ahead portion, wherein the core encoder is configured to apply a look-ahead operation to the output look-ahead portion in order to determine coding information for core encoding the frame, and wherein the core encoder is configured to core encode the frame using a result of the look-ahead operation, or wherein a block of sampling values comprises an associated input sampling rate, and a block of spectral values of the sequences of blocks of spectral values comprises spectral values up to a maximum input frequency being related to the input sampling rate, wherein the apparatus further comprises a spectral domain resampler for performing a resampling operation in the frequency domain on data input into the spectral-time converter or on data input into the multichannel processor, wherein a block of a resampled sequence of blocks of spectral values comprises spectral values up to a maximum output frequency being different from the maximum input frequency, and wherein the output sequence of blocks of sampling values comprises an associated output sampling rate being different from the input sampling rate.

2. Apparatus of claim 1, wherein an analysis window used by the time-spectral converter or a synthesis window used by the spectral-time converter each comprises an increasing overlapping portion and a decreasing overlapping portion, wherein the core encoder comprises a time-domain encoder with a look-ahead portion or a frequency domain encoder with an overlapping portion of a core window, and wherein the overlapping portion of the analysis window or the synthesis window is smaller than or equal to the look-ahead portion of the core encoder or the overlapping portion of the core window.

3. Apparatus of claim 1, wherein the core encoder is configured to use a look-ahead portion when core encoding a frame derived from the output sequence of blocks of sampling values having associated the output sampling rate, the look-ahead portion being located in time subsequent to the frame, wherein the time-spectral converter is configured to use an analysis window comprising an overlapping portion with a length in time being lower than or equal to a length in time of the look-ahead portion, wherein the overlapping portion of the analysis window is used for generating a windowed look-ahead portion.

4. Apparatus of claim 3, wherein the spectral-time converter is configured to process an output look-ahead portion corresponding to the windowed look-ahead portion using a redress function, wherein the redress function is configured so that an influence of the overlapping portion of the analysis window is reduced or eliminated.

5. Apparatus of claim 4, wherein the redress function is inverse to a function defining the overlapping portion of the analysis window.

6. Apparatus of claim 1, wherein the spectral-time converter is configured to generate a third output block subsequent to the second output block using the synthesis window, wherein the spectral-time converter is configured to overlap a first overlap portion of the third output block with the second portion of the second output block windowed using the synthesis window to acquire samples of a further frame following the frame in time.

7. Apparatus of claim 1, wherein the spectral-time converter is configured, when generating the second output block for the frame, to not window the output look-ahead portion or to redress the output look-ahead portion for at least partly undoing an influence of an analysis window used by the time-spectral converter, and wherein the spectral-time converter is configured to perform an overlap-add operation between the second output block and the third output block for the further frame and to window the output look-ahead portion with the synthesis window.

8. Apparatus of claim 1, wherein the spectral-time converter is configured, to use a synthesis window to generate a first block of output samples, the first block of output samples having a first portion of output samples of the first block and a second portion of output samples of the first block and to generate a second block of output samples, the second block of output samples having a first portion of output samples of the second block and a second portion of output samples of the second block, to overlap-add the second portion of output samples of the first block and the first portion of output samples of the second block to generate an output portion of output samples, wherein the core encoder is configured to apply a look-ahead operation to another portion of output samples for core encoding the output samples, wherein the another portion of output samples represents a look-ahead portion and is located in time before the output portion of the output samples generated by the overlap-add, wherein the look-ahead portion does not comprise the second portion of output samples of the second block.

9. Apparatus of claim 1, wherein the spectral-time converter is configured to provide a time resolution being higher than two times a length of a core encoder frame, wherein the spectral-time converter is configured to use a synthesis window for generating blocks of output samples and to perform an overlap-add operation, wherein all samples in a look-ahead portion of the core encoder are calculated using the overlap-add operation, or wherein the spectral-time converter is configured to apply a look-ahead operation to the output samples for core encoding output samples located in time before the portion, wherein the look-ahead portion does not comprise a second portion of samples of the second block.

10. Apparatus of claim 1, wherein the spectral domain resampler is configured for truncating the blocks to achieve downsampling or for zero padding the blocks to achieve upsampling.

11. Apparatus of claim 1, wherein the spectral domain resampler is configured for scaling the spectral values of the blocks of the result sequence of blocks using a scaling factor depending on the maximum input frequency and depending on the maximum output frequency.

12. Apparatus of claim 11, wherein the scaling factor is greater than one in the case of upsampling, wherein the output sampling rate is greater than the input sampling rate, or wherein the scaling factor is lower than one in the case of downsampling, wherein the output sampling rate is lower than the input sampling rate, or wherein the time-spectral converter is configured to perform a time-frequency transform algorithm not using a normalization regarding a total number of spectral values of a block of spectral values, and wherein the scaling factor is equal to a quotient between the number of spectral values of a block of the resampled sequence and the number of spectral values of a block of spectral values before the resampling, and wherein the spectral-time converter is configured to apply a normalization based on the maximum output frequency.

13. Apparatus of claim 1, wherein the time-spectral converter is configured to perform a discrete Fourier transform algorithm, or wherein the spectral-time converter is configured to perform an inverse discrete Fourier transform algorithm.

14. Apparatus of claim 1, wherein the multi-channel processor is configured to acquire a further result sequence of blocks of spectral values, and wherein the spectral-time converter is configured for converting the further result sequence of spectral values into a further time domain representation comprising a further output sequence of blocks of sampling values having associated an output sampling rate being equal to the input sampling rate.

15. Apparatus of claim 1, wherein the multi-channel processor is configured to provide and even further result sequence of blocks of spectral values, wherein the spectral-domain resampler is configured for resampling the blocks of the even further result sequence in the frequency domain to acquire a further resampled sequence of blocks of spectral values, wherein a block of the further resampled sequence comprises spectral values up to a further maximum output frequency being different from the maximum input frequency or being different from the maximum output frequency, wherein the spectral-time converter is configured for converting the further resampled sequence of blocks of spectral values into an even further time domain representation comprising an even further output sequence of blocks of sampling values having associated a further output sampling rate being different from the input sampling rate or the output sampling rate.

16. Apparatus of claim 1, wherein the multi-channel processor is configured to generate a mid-signal as the at least one result sequence of blocks of spectral values only using a downmix operation, or an additional side signal as a further result sequence of blocks of spectral values.

17. Apparatus of claim 1, wherein the multi-channel processor is configured to generate a mid-signal as the at least one result sequence, wherein the spectral domain resampler is configured to resample the mid-signal to two separate sequences comprising two different maximum output frequencies being different from the maximum input frequency, wherein the spectral-time converter is configured to convert the two resampled sequences to two output sequences comprising different sampling rates, and wherein the core encoder comprises a first preprocessor for preprocessing the first output sequence at a first sampling rate or a second preprocessor for preprocessing the second output sequence at the second sampling rate, and wherein the core encoder is configured to core encode the first or the second preprocessed output sequence, or wherein the multi-channel processor is configured to generate a side signal as the at least one result sequence, wherein the spectral domain resampler is configured to resample the side signal to two resampled sequences comprising two different maximum output frequencies being different from the maximum input frequency, wherein the spectral-time converter is configured to convert the two resampled sequences to two output sequences comprising different sampling rates, and wherein the core encoder comprises a first preprocessor or a second preprocessor for preprocessing the first or the second output sequences; and wherein the core encoder is configured to core encode the first or the second preprocessed output sequence.

18. Apparatus of claim 1, wherein the spectral-time converter is configured to convert the at least one result sequence into a time domain representation without any spectral domain resampling, and wherein the core encoder is configured to core encode the non-resampled output sequence to acquire the encoded multi-channel signal, or wherein the spectral-time converter is configured to convert the at least one result sequence into a time domain representation without any spectral domain resampling without the side signal, and wherein the core encoder is configured to core encode the non-resampled output sequence for the side signal to acquire the encoded multi-channel signal, or wherein the apparatus further comprises a specific spectral domain side signal encoder, or wherein the input sampling rate is at least one sampling rate of a group of sampling rates comprising 8 kHz, 16 kHz, 32 kHz, or wherein the output sampling rate is at least one sampling rate of a group of sampling rates comprising 8 kHz, 12.8 kHz, 16 kHz, 25.6 kHz and 32 kHz.

19. Apparatus of claim 1, wherein the time-spectral converter is configured to apply an analysis window, wherein the spectral-time converter is configured to apply a synthesis window, wherein the length in time of the analysis window is equal or an integer multiple or integer fraction of the length in time of the synthesis window, or wherein the analysis window and the synthesis window each comprises a zero padding portion at an initial portion or an end portion thereof, or wherein the analysis window and the synthesis window are so that the window size, an overlap region size and a zero padding size each comprise an integer number of samples for at least two sampling rates of the group of sampling rates comprising 12.8 kHz, 16 kHz, 25.6 kHz, 32 kHz, 48 kHz, or wherein a maximum radix of a digital Fourier transform in a split radix implementation is lower than or equal to 7, or wherein a time resolution is fixed to a value lower than or equal to a frame rate of the core encoder.

20. Apparatus of claim 1, wherein the multi-channel processor is configured to process the sequence of blocks to acquire a time alignment using a broadband time alignment parameter and to acquire a narrow band phase alignment using a plurality of narrow band phase alignment parameters, and to calculate a mid-signal and a side signal as the result sequences using aligned sequences.

21. Method of encoding a multi-channel signal comprising at least two channels, comprising:

converting sequences of blocks of sampling values of the at least two channels into a frequency domain representation comprising sequences of blocks of spectral values for the at least two channels;

applying a joint multi-channel processing to the sequences of blocks of spectral values to acquire at least one result sequence of blocks of spectral values comprising information related to the at least two channels;

converting the result sequence of blocks of spectral values into a time domain representation comprising an output sequence of blocks of sampling values; and core encoding the output sequence of blocks of sampling values to acquire an encoded multi-channel signal, wherein the core encoding operates in accordance with a first frame control to provide a sequence of frames, wherein a frame is bounded by a start frame border and an end frame border, and wherein the converting into the frequency domain representation or the converting into the time domain representation operates in accordance with a second frame control being synchronized to the first frame control, wherein the start frame border or the end frame border of each frame of the sequence of frames is in a predetermined relation to a start instant or an end instant of an overlapping portion of a window used by the converting into the frequency domain representation for each block of the sequence of blocks of sampling values or used by the converting into the time domain representation for each block of the output sequence of blocks of sampling values, wherein the converting into the time domain representation comprises processing an output look-ahead portion corresponding to the windowed look-ahead portion using a redress function, wherein the redress function is configured so that an influence of the overlapping portion of the analysis window is reduced or eliminated, wherein the overlapping portion is proportional to a square root of a sine function, wherein the redress function is proportional to the inverse square root of the sine function, and wherein the spectral-time converter is configured to use an overlapping portion being proportional to the sine function raised to a power of 1.5, or wherein the converting into the time domain representation comprises generating a first output block using a synthesis window and a second output block using the synthesis window, wherein a second portion of the second output block is an output look-ahead portion, generating sampling values of a frame using an overlap-add operation between the first output block and another portion of the second output block, the another portion excluding the output look-ahead portion, wherein the core encoding comprises applying a look-ahead operation to the output look-ahead portion in order to determine coding information for core encoding the frame, and core encoding the frame using a result of the look-ahead operation, or wherein a block of sampling values comprises an associated input sampling rate, and a block of spectral values of the sequences of blocks of spectral values comprises spectral values up to a maximum input frequency being related to the input sampling rate, wherein the method further comprises a spectral domain resampling for performing a resampling operation in the frequency domain on data input into the converting into the time domain representation or on data input into the applying a joint multi-channel processing, wherein a block of a resampled sequence of blocks of spectral values comprises spectral values up to a maximum output frequency being different from the maximum input frequency, and wherein the output sequence of blocks of sampling values comprises an associated output sampling rate being different from the input sampling rate.

22. Apparatus for decoding an encoded multi-channel signal, comprising:

a core decoder for generating a core decoded signal;

a time-spectral converter for converting a sequence of blocks of sampling values of the core decoded signal into a frequency domain representation comprising a sequence of blocks of spectral values for the core decoded signal;

a multi-channel processor for applying an inverse multi-channel processing to a sequence comprising the sequence of blocks to acquire at least two result sequences of blocks of spectral values; and a spectral-time converter for converting the at least two result sequences of blocks of spectral values into a time domain representation comprising at least two output sequences of blocks of sampling values, wherein the core decoder is configured to operate in accordance with a first frame control to provide a sequence of frames, wherein a frame is bounded by a start frame border and an end frame border, wherein the time-spectral converter or the spectral-time converter is configured to operate in accordance with a second frame control being synchronized to the first frame control, wherein the start frame border or the end frame border of each frame of the sequence of frames is in a predetermined relation to a start instant or an end instant of an overlapping portion of a window used by the time-spectral converter for each block of the sequence of blocks of sampling values or used by the spectral-time converter for each block of the at least two output sequences of blocks of sampling values, wherein a block of sampling values comprises an associated input sampling rate, and wherein a block of spectral values comprises spectral values up to a maximum input frequency being related to the input sampling rate, wherein the apparatus further comprises a spectral domain resampler for performing a resampling operation in the frequency domain on data input into the spectral-time converter or on data input into the multi-channel processor, wherein a block of a resampled sequence comprises spectral values up to a maximum output frequency being different from the maximum input frequency, and wherein the at least two output sequences of blocks of sampling values have associated an output sampling rate being different from the input sampling rate.

23. Apparatus of claim 22, wherein the core decoded signal comprises the sequence of frames, a frame comprising the start frame border and the end frame border, wherein an analysis window used by the time-spectrum converter for windowing the frame of the sequence of frames comprises an overlapping portion ending before the end frame border leaving a time gap between an end of the overlapping portion and the end frame border, and wherein the core decoder is configured to perform a processing to samples in the time gap in parallel to the windowing of the frame using the analysis window, or wherein a core decoder post-processing is performed to the samples in the time gap in parallel to the windowing of the frame using the analysis window.

24. Apparatus of claim 22, wherein the core decoded signal comprises the sequence of frames, a frame comprising the start frame border and the end frame border, wherein a start of a first overlapping portion of an analysis window coincides with the start frame border, and wherein an end of a second overlapping portion of the analysis window is located before the end frame border, so that a time gap exists between the end of the second overlapping portion and the end frame border, and wherein the analysis window for a following block of the core decoded signal is located so that a middle non-overlapping portion of the analysis window is located within the time gap.

25. Apparatus of claim 22, wherein the analysis window used by the time-spectral converter comprises the same shape and length in time as the synthesis window used by the spectrum-time converter.

26. Apparatus of claim 22, wherein the core decoded signal comprises the sequence of frames, wherein a frame comprises a length, wherein the time-spectral converter is configured to use the window, and wherein a length in time of the window excluding any zero padding portions is smaller than or equal to half the length of the frame.

27. Apparatus of claim 22, wherein the spectral-time converter is configured to apply a synthesis window for acquiring a first output block of windowed samples for a first output sequence of the at least two output sequences;

to apply the synthesis window for acquiring a second output block of windowed samples for the first output sequence of the at least two output sequences;

to overlap-add the first output block and the second output block to acquire a first group of output samples for the first output sequence;

wherein the spectral-time converter is configured to apply a synthesis window for acquiring a first output block of windowed samples for a second output sequence of the at least two output sequences;

to apply the synthesis window for acquiring a second output block of windowed samples for the second output sequence of the at least two output sequences;

to overlap-add the first output block and the second output block to acquire a second group of output samples for the second output sequence;

wherein the first group of output samples for the first output sequence and the second group of output samples for the second output sequence are related to the same time portion of the encoded multi-channel signal or are related to the same frame of the core decoded signal.

28. Apparatus of claim 22, wherein the spectral domain resampler is configured for truncating the blocks to achieve downsampling or for zero padding the blocks to achieve upsampling.

29. Apparatus of claim 22, wherein the spectral domain resampler is configured for scaling the spectral values of the blocks of the result sequence of blocks using a scaling factor depending on the maximum input frequency and depending on the maximum output frequency.

30. Apparatus of claim 22, wherein the scaling factor is greater than one in the case of upsampling, wherein the output sampling rate is greater than the input sampling rate, or wherein the scaling factor is lower than one in the case of downsampling, wherein the output sampling rate is lower than the input sampling rate, or wherein the time-spectral converter is configured to perform a time-frequency transform algorithm not using a normalization regarding a total number of spectral values of a block of spectral values, and wherein the scaling factor is equal to a quotient between the number of spectral values of a block of the resampled sequence and the number of spectral values of a block of spectral values before the resampling, and wherein the spectral-time converter is configured to apply a normalization based on the maximum output frequency.

31. Apparatus of claim 22, wherein the time-spectral converter is configured to perform a discrete Fourier transform algorithm, or wherein the spectral-time converter is configured to perform an inverse discrete Fourier transform algorithm.

32. Apparatus of claim 22, wherein the core decoder is configured to generate a further core decoded signal comprising a further sampling rate being different from an input sampling rate, wherein the time-spectral converter is configured to convert the further core decoded signal into a frequency domain representation comprising a further sequence of blocks of spectral values for the further core decoded signal, wherein a block of spectral values of the further core decoded signal comprises spectral values up to a further maximum input frequency being different from the maximum input frequency and related to the further sampling rate, wherein the spectral domain resampler is configured to resample the further sequence of blocks for the further core decoded signal in the frequency domain to acquire a further resampled sequence of blocks of spectral values, wherein a block of spectral values of the further resampled sequence comprises spectral values up to the maximum output frequency being different from the further maximum input frequency; and wherein the apparatus further comprises a combiner for combining the resampled sequence and the further resampled sequence to acquire the sequence to be processed by the multi-channel processor.

33. Apparatus of claim 22, wherein the core decoder is configured to generate an even further core decoded signal comprising a further sampling rate being equal to an output sampling rate, wherein the time-spectral converter is configured to convert the even further core decoded signal into a frequency domain representation to obtain an even further sequence of blocks of spectral values, wherein the combiner combines the even further sequence of blocks of spectral values and a resampled sequence of blocks in a process of generating the sequence of blocks processed by the multi-channel processor.

34. Apparatus of claim 22, wherein the core decoder comprises at least one of an MDCT based decoding portion, a time domain bandwidth extension decoding portion, an ACELP decoding portion and a bass post-filter decoding portion, wherein the MDCT-based decoding portion or the time domain bandwidth extension decoding portion is configured to generate the core decoded signal comprising the output sampling rate, or wherein the ACELP decoding portion or the bass post-filter decoding portion is configured to generate a core decoded signal at a sampling rate being different from the output sampling rate.

35. Apparatus of claim 22, wherein the time-spectral converter is configured to apply an analysis window to at least two of a plurality of different core decoded signals, the analysis windows comprising the same size in time or comprising the same shape with respect to time, wherein the apparatus further comprises a combiner for combining at least one resampled sequence and any other sequence comprising blocks with spectral values up to the maximum output frequency on a block-by-block basis to acquire the sequence processed by the multi-channel processor.

36. Apparatus of claim 22, wherein the sequence processed by the multi-channel processor corresponds to a mid-signal, and wherein the multi-channel processor is configured to additionally generate a side signal using information on a side signal comprised by the encoded multi-channel signal, and wherein the multi-channel processor is configured to generate the at least two result sequences using the mid-signal and the side signal.

37. Apparatus of claim 22, wherein the multi-channel processor is configured to convert the sequence into a first sequence for a first output channel and a second sequence for a second output channel using a gain factor per parameter band;

to update the first sequence and the second sequence using a decoded side signal or to update the first sequence and the second sequence using a side signal predicted from an earlier block of a sequence of blocks for a mid-signal using a stereo filling parameter for a parameter band;

to perform a phase de-alignment and an energy scaling using information on a plurality of narrowband phase alignment parameters; and to perform a time-de-alignment using information on a broadband time-alignment parameter to acquire the at least two result sequences.

38. Method of decoding an encoded multi-channel signal, comprising:

generating a core decoded signal;

converting a sequence of blocks of sampling values of the core decoded signal into a frequency domain representation comprising a sequence of blocks of spectral values for the core decoded signal;

applying an inverse multi-channel processing to a sequence comprising the sequence of blocks to acquire at least two result sequences of blocks of spectral values; and converting the at least two result sequences of blocks of spectral values into a time domain representation comprising at least two output sequences of blocks of sampling values, wherein the generating the core decoded signal operates in accordance with a first frame control to provide a sequence of frames, wherein a frame is bounded by a start frame border and an end frame border, wherein the converting into the frequency domain representation or the converting into the time domain representation operates in accordance with a second frame control being synchronized to the first frame control, wherein the start frame border or the end frame border of each frame of the sequence of frames is in a predetermined relation to a start instant or an end instant of an overlapping portion of a window used by the converting into the frequency domain representation for each block of the sequence of blocks of sampling values or used by the converting into the time domain representation for each block of the at least two output sequences of blocks of sampling values, wherein a block of sampling values comprises an associated input sampling rate, and wherein a block of spectral values comprises spectral values up to a maximum input frequency being related to the input sampling rate, wherein the method further comprises a spectral domain resampling for performing a resampling operation in the frequency domain on data input into the spectral-time converter into the time domain representation or on data input into the applying an inverse multi-channel processing, wherein a block of a resampled sequence comprises spectral values up to a maximum output frequency being different from the maximum input frequency, and wherein the at least two output sequences of blocks of sampling values have associated an output sampling rate being different from the input sampling rate.

39. Non-transitory digital storage medium having a computer program stored thereon to perform, when said computer program is run by a computer, the method of encoding a multi-channel signal comprising at least two channels, said method comprising:

converting sequences of blocks of sampling values of the at least two channels into a frequency domain representation comprising sequences of blocks of spectral values for the at least two channels;

applying a joint multi-channel processing to the sequences of blocks of spectral values to acquire at least one result sequence of blocks of spectral values comprising information related to the at least two channels;

converting the result sequence of blocks of spectral values into a time domain representation comprising an output sequence of blocks of sampling values; and core encoding the output sequence of blocks of sampling values to acquire an encoded multi-channel signal, wherein the core encoding operates in accordance with a first frame control to provide a sequence of frames, wherein a frame is bounded by a start frame border and an end frame border, and wherein the converting into the frequency domain representation or the converting into the time domain representation operates in accordance with a second frame control being synchronized to the first frame control, wherein the start frame border or the end frame border of each frame of the sequence of frames is in a predetermined relation to a start instant or an end instant of an overlapping portion of a window used by the converting into the frequency domain representation for each block of the sequence of blocks of sampling values or used by the converting into the time domain representation for each block of the output sequence of blocks of sampling values, wherein the converting into the time domain representation comprises processing an output look-ahead portion corresponding to the windowed look-ahead portion using a redress function, wherein the redress function is configured so that an influence of the overlapping portion of the analysis window is reduced or eliminated, wherein the overlapping portion is proportional to a square root of a sine function, wherein the redress function is proportional to the inverse square root of the sine function, and wherein the spectral-time converter is configured to use an overlapping portion being proportional to the sine function raised to a power of 1.5, or wherein the converting into the time domain representation comprises generating a first output block using a synthesis window and a second output block using the synthesis window, wherein a second portion of the second output block is an output look-ahead portion, generating sampling values of a frame using an overlap-add operation between the first output block and another portion of the second output block, the another portion excluding the output look-ahead portion, wherein the core encoding comprises applying a look-ahead operation to the output look-ahead portion in order to determine coding information for core encoding the frame, and core encoding the frame using a result of the look-ahead operation, or wherein a block of sampling values comprises an associated input sampling rate, and a block of spectral values of the sequences of blocks of spectral values comprises spectral values up to a maximum input frequency being related to the input sampling rate, wherein the method further comprises a spectral domain resampling for performing a resampling operation in the frequency domain on data input into the converting into the time domain representation or on data input into the applying a joint multi-channel processing, wherein a block of a resampled sequence of blocks of spectral values comprises spectral values up to a maximum output frequency being different from the maximum input frequency, and wherein the output sequence of blocks of sampling values comprises an associated output sampling rate being different from the input sampling rate.

40. Non-transitory digital storage medium having a computer program stored thereon to perform, when said computer program is run by a computer, the method of decoding an encoded multi-channel signal, said method comprising:

generating a core decoded signal;

converting a sequence of blocks of sampling values of the core decoded signal into a frequency domain representation comprising a sequence of blocks of spectral values for the core decoded signal;

applying an inverse multi-channel processing to a sequence comprising the sequence of blocks to acquire at least two result sequences of blocks of spectral values; and converting the at least two result sequences of blocks of spectral values into a time domain representation comprising at least two output sequences of blocks of sampling values, wherein the generating the core decoded signal operates in accordance with a first frame control to provide a sequence of frames, wherein a frame is bounded by a start frame border and an end frame border, wherein the converting into the frequency domain representation or converting into the time domain representation operates in accordance with a second frame control being synchronized to the first frame control, wherein the start frame border or the end frame border of each frame of the sequence of frames is in a predetermined relation to a start instant or an end instant of an overlapping portion of a window used by the converting into the frequency domain representation for each block of the sequence of blocks of sampling values or used by the converting into the time domain representation for each block of the at least two output sequences of blocks of sampling values, and wherein a block of sampling values comprises an associated input sampling rate, and wherein a block of spectral values comprises spectral values up to a maximum input frequency being related to the input sampling rate, wherein the method further comprises a spectral domain resampling for performing a resampling operation in the frequency domain on data input into the spectral-time converter into the time domain representation or on data input into the applying an inverse multi-channel processing, wherein a block of a resampled sequence comprises spectral values up to a maximum output frequency being different from the maximum input frequency, and wherein the at least two output sequences of blocks of sampling values have associated an output sampling rate being different from the input sampling rate.

* * * * *